US006995643B2

(12) United States Patent
Fujiwara et al.

(10) Patent No.: US 6,995,643 B2
(45) Date of Patent: Feb. 7, 2006

(54) MAGNETICALLY BIASING BOND MAGNET FOR IMPROVING DC SUPERPOSITION CHARACTERISTICS OF MAGNETIC COIL

(75) Inventors: Teruhiko Fujiwara, Sendai (JP); Masayoshi Ishii, Sendai (JP); Haruki Hoshi, Sendai (JP); Keita Isogai, Sendai (JP); Hatsuo Matsumoto, Sendai (JP); Toru Ito, Miyagi (JP); Tamiko Ambo, Tokyo (JP)

(73) Assignee: NEC Tokin Corporation, Miyagi (JP)

( * ) Notice: Subject to any disclaimer, the term of this patent is extended or adjusted under 35 U.S.C. 154(b) by 2 days.

(21) Appl. No.: 11/031,230

(22) Filed: Jan. 6, 2005

(65) Prior Publication Data

US 2005/0116804 A1 Jun. 2, 2005

Related U.S. Application Data

(62) Division of application No. 09/950,568, filed on Sep. 10, 2001, now Pat. No. 6,856,231.

(30) Foreign Application Priority Data

| | | |
|---|---|---|
| Sep. 8, 2000 | (JP) | 2000-272656 |
| Oct. 25, 2000 | (JP) | 2000-325858 |
| Nov. 20, 2000 | (JP) | 2000-352722 |
| Nov. 22, 2000 | (JP) | 2000-356669 |
| Nov. 22, 2000 | (JP) | 2000-356705 |
| Nov. 28, 2000 | (JP) | 2000-360646 |
| Nov. 28, 2000 | (JP) | 2000-360866 |
| Nov. 28, 2000 | (JP) | 2000-361077 |
| Jan. 31, 2001 | (JP) | 2001-22892 |
| Apr. 17, 2001 | (JP) | 2001-117665 |

(51) Int. Cl.
*H01F 21/00* (2006.01)

(52) U.S. Cl. ..... 336/110; 336/178

(58) Field of Classification Search ..... 336/83, 336/110, 178, 211–217, 233–234; 148/105, 148/108, 300–301; 428/323, 328; 335/299–306
See application file for complete search history.

(56) References Cited

U.S. PATENT DOCUMENTS 4,103,221 A * 7/1978 Fukui et al. ..... 323/362

(Continued)

FOREIGN PATENT DOCUMENTS

| | | |
|---|---|---|
| JP | 50-133453 | 10/1975 |
| JP | 60-10605 A | 1/1985 |
| JP | 61-279106 A | 12/1986 |
| JP | 11-204319 A | 7/1999 |
| JP | 11-354344 A | 12/1999 |

*Primary Examiner*—Tuyen T Nguyen
(74) *Attorney, Agent, or Firm*—Frishauf, Holtz, Goodman, & Chick, P.C.

(57) ABSTRACT

In order to provide an inductance part having excellent DC superposition characteristic and core-loss, a magnetically biasing magnet, which is disposed in a magnetic gap of a magnetic core, is a bond magnet comprising magnetic powder and plastic resin with the content of the resin being 20% or more on the base of volumetric ratio and which has a specific resistance of 0.1Ω·cm or more. The magnetic powder used is rare-earth magnetic powder having an intrinsic coercive force of 5 kOe or more, Curie point of 300° C. or more, and an average particle size of 2.0–50 μm. A magnetically biasing magnet used in an inductance part that is treated by the reflow soldering method has a resin content of 30% or more and the magnetic powder used therein is Sm—Co magnetic powder having an intrinsic coercive force of 10 kOe or more, Curie point of 500° C. or more, and an average particle size of 2.5–50 μm. A thin magnet having a thickness of 500 μm or less can be realized for a small-sized inductance part.

22 Claims, 43 Drawing Sheets

U.S. PATENT DOCUMENTS 5,521,398 A 5/1996 Pelekanos et al.
6,432,158 B1 * 8/2002 Harada et al. ..... 75/245
6,590,485 B2 7/2003 Fujiwara et al.
6,621,398 B2 9/2003 Fujiwara et al.
6,856,231 B2 * 2/2005 Fujiwara et al. ..... 336/233
6,906,608 B2 * 6/2005 Fujiwara et al. ..... 336/110

* cited by examiner

MAGNETICALLY BIASING BOND MAGNET FOR IMPROVING DC SUPERPOSITION CHARACTERISTICS OF MAGNETIC COIL

This is a divisional application of Ser. No. 09/950,568, filed Sep. 10, 2001 now U.S. Pat. No. 6,856,231, now allowed, which is hereby incorporated in its entirety herein by this reference.

TECHNICAL FIELD

This invention relates to a permanent magnet for magnetically biasing a magnetic core (which will hereinunder be often referred to as "core" simply) which is used in an inductance element such as a choke coil, transformer or the like. Further, this invention relates to a magnetic core having a permanent magnet as a magnetically biasing magnet and an inductance element using the magnetic coil.

BACKGROUND TECHNIQUE

To a choke coil and a transformer used in, for example, a switching power supply or the like, an AC current is usually applied thereto together with a DC current superposed thereto. Therefore, a core used in those choke coil and transformer is required to have a magnetic characteristic of a good magnetic permeability so that the core is not magnetically saturated by the superposition of the DC current (the characteristic will be referred to as "DC superposition characteristic" or simply as "superposition characteristic").

As magnetic cores in application fields within high frequency bands, there have been used a ferrite core and a dust core which have individual features due to physical properties of their materials, the ferrite core has a high intrinsic magnetic permeability and a low saturated magnetic flux density while the dust core has a low intrinsic magnetic permeability and a high saturated magnetic flux density. Accordingly, the dust core is often used as one having a toroidal shape. On the other hand, the ferrite magnetic core has an E-shape core part having a central leg formed with a magnetic gap so as to prevent magnetic saturation from being caused by the superposition of DC current.

Recently, since electronic parts are required to be small-sized as electronic devices are more compact-sized, the magnetic core with the magnetic gap is small-sized too. So, there is a strong demand for magnetic cores having an increased magnetic permeability against superposition of DC current.

Generally, it is necessary for the demand to select a magnetic core having a high saturation magnetization, that is, to select a magnetic core that is not magnetically saturated by a high magnetic field applied. The saturation magnetization is inevitably determined by materials and cannot be made as high as desired.

As a solution, it has been conventionally proposed to dispose a permanent magnet in a magnetic gap formed in a magnetic path of a magnetic core, that is, to magnetically bias the magnetic core, to thereby cancel a DC magnetic flux caused by the superposition of DC current.

The magnetic bias by use of the permanent magnet is a good solution to improve the DC superposition characteristic, but it have hardly been brought into a practical use because use of a sintered metallic magnet resulted in considerable increase of a core loss of the magnetic core, while use of a ferrite magnet led in unstable superposition characteristic.

In order to resolve the problems, for example, JP-A 50-133453 discloses to use, as a magnetically biasing magnet, a bond magnet comprising rare-earth magnetic powder with a high magnetic coercive force and binder which are mixed together with each other and compacted into a shape, thereby the DC superposition characteristic and temperature elevation of the core being improved.

Recently, a power supply has been more and more strongly required to improve its power transformation efficiency to such a high level that it is difficult to determine good and bad of magnetic cores for choke coils and transformers by core temperatures measured. Therefore, it is inevitable to determine it from core loss data measured by use of a core-loss measuring device. According to the study by the present inventors, it was confirmed that the core loss has a degraded value in cores having the resistance value disclosed in JP-A 50-133453.

As electronic devices have recently been small-sized, inductance parts are required smaller and smaller. Accordingly, magnetically biasing magnets are demand smaller and smaller in thickness.

Further, there have recently been demands for coil parts of a surface-mount type. Those coil parts are subjected to reflow soldering process so as to be surface-mounted on a circuit board. It is desired that a magnetic core of the coil part be not degraded in its magnetic properties under conditions of the reflow soldering process. Further, the magnet is desired to have oxidation resistance.

It is a theme of this invention to provide a magnet suitable to a magnetically biasing magnet which is disposed in the vicinity of at least one magnetic gap formed in a magnetic path of a magnetic core in a small-sized inductance part for magnetically bias the core through opposite ends of the magnetic gap.

It is an object of this invention to provide a permanent magnet that can provide an excellent DC superposition characteristics and an excellent core-loss characteristic to an inductance part in use as a magnetically biasing magnet for a magnetic core of the part.

It is another object of this invention to provide a permanent magnet for magnetically biasing magnet that is not degraded in its magnetic properties even if it is subjected to a temperature in the reflow soldering process.

It is yet another object to provide a magnetic core that is excellent in the magnetic properties and core-loss characteristic.

It is another object of this invention to provide an inductance part having a magnetic core having excellent DC superposition characteristics and core-loss characteristics.

DISCLOSURE OF THE INVENTION

According to this invention, there is provided a permanent magnet which comprises a plastic resin and magnetic powder dispersed in the plastic resin, wherein said magnet has a specific resistance of 0.1Ω·cm or more and said magnetic powder has an intrinsic coercive force of 5 kOe or more, a Curie Point Tc of 300° C. or more, and a particle size which is equal to or less than 150 μm.

It is preferable that the magnetic powder has an average particle size is 2.0–50 μm.

In the permanent magnet, a content of the plastic resin is preferably 20% or more on the base of a volumetric percentage.

In the permanent magnet, the magnetic powder is of a rare-earth magnetic powder.

It is preferable that the permanent magnet is a compressibility of 20% or more by compacting.

In the permanent magnet, the rare-earth magnetic powder used in the bond magnet includes silane coupling agent and/or titanium coupling agent added thereto.

The permanent magnet preferably has a magnetic anisotropy generated by a magnetic alignment subjected in a production process thereof.

In the permanent magnet, it is preferable that the magnetic powder has a surface coating of surfactant.

It is preferable that the permanent magnet has a surface having a centerline average profile surface roughness of 10 μm or less.

It is also preferable that the permanent magnet has a thickness of 50–10000 μm.

According to an embodiment of the present invention, the permanent magnet preferably has a specific resistance of 1Ω·cm or more. The permanent magnet may preferably be produced by molding and/or hot pressing.

According to another embodiment of this invention, the permanent magnet has a thickness of 500 μm or less. The magnet is preferably produced from mixed slurry of the plastic resin and the magnetic powder by a thin film forming process such as a doctor blade method, a printing method or the like. The permanent magnet also has a surface gloss of 25% or more.

In the permanent magnet, the plastic resin is preferably at least one selected from a group of polypropylene resin, 6-nylone resin, 12-nylone resin, polyimide resin, polyethylene resin, and epoxy resin.

It is preferable that the permanent magnet has a surface coating of a heat resistant paint or a heat resistant resin having a heat resistance temperature of 120° C. or more.

In the permanent magnet, the magnetic powder is rare-earth magnetic powder selected from a group of SmCo, NdFeB, and SmFeN.

According to an aspect of the permanent magnet of this invention, there is provided a permanent magnet wherein the magnetic powder has an intrinsic coercive force of 10 kOe or more, a Curie temperature of 500° C. or more, and an average particle size of 2.5–50 μm.

In the permanent magnet according to the aspect, the magnetic powder is preferably an SmCo rare-earth magnetic powder. A preferable one of the SmCo rare-earth powder is one represented by:

$$Sm(Co_{bal}Fe_{0.15-0.25}Cu_{0.05-0.06}Zr_{0.02-0.03})_{7.0-8.5}$$

In the permanent magnet according to the aspect, it is preferable that the content of the plastic resin is 30% or more on the base of a volumetric percentage.

In the permanent magnet according to the aspect, it is preferable that the plastic resin is a thermo-plastic resin having a softening point of 250° C. or more.

In the permanent magnet according to the aspect, it is preferable that the plastic resin is a thermosetting plastic resin having a carburizing point of 250° C. or more.

In the permanent magnet according to the aspect, it is preferable that the plastic resin is at lest one selected form a group of polyimide resin, polyamideimide resin, epoxy resin, polyphenylene sulfide, silicone resin, polyester resin, aromatic polyamide resin, and liquid crystal polymer.

It is preferable that the permanent magnet according to the aspect is provided with a surface heat-resistant coating having a heat resistance temperature of 270° C. or more.

According to another aspect of this invention, there is obtained a magnetic core having at least one magnetic gap in a magnetic path thereof and having a magnetically biasing magnet disposed in the vicinity of the magnetic gap for providing a magnetic bias from opposite ends of the magnetic gap to the core, wherein the magnetically biasing magnet is the above-described permanent magnet according to this invention.

It is preferable that the magnetic gap of the magnetic core has a gap length of about 50–10000 μm. According to an embodiment, the magnetic gap has a gap length greater than 500 μm. According to another embodiment, the magnetic gap has a gap length of 500 μm or less.

According to yet another aspect of this invention, there is obtained an inductance part which comprises the magnetic core having the magnetically biasing magnet according to this invention, and at least one winding wound by one or more turns on the core.

BEST MODES FOR CARRYING OUT THE INVENTION

Now, embodiments of this invention will be described below with reference to the drawings.

Figure 1:
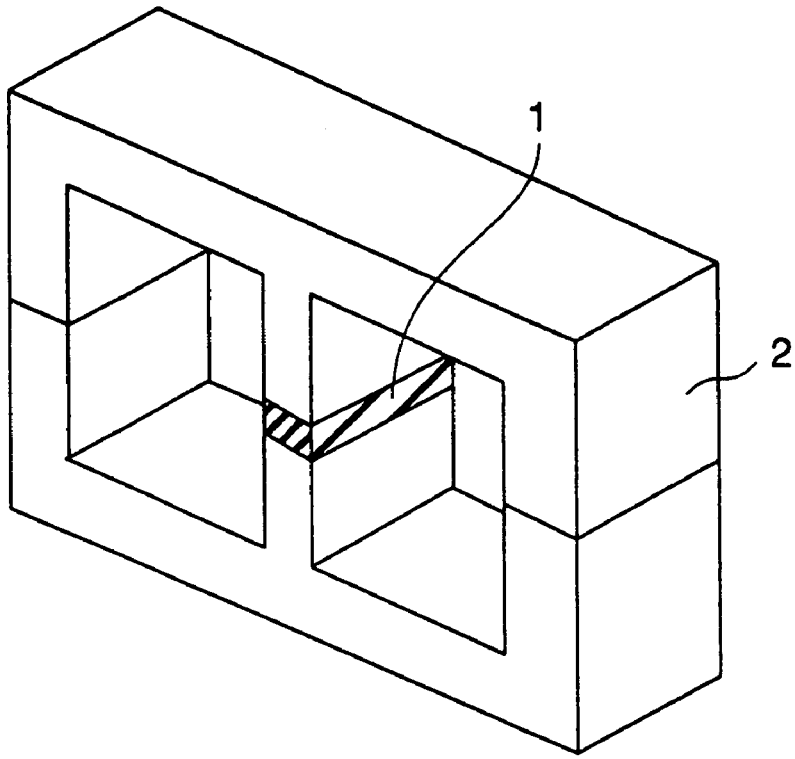
FIG. 1 is a perspective view of a magnetic core according to an embodiment of this invention.

Referring to FIG. 1, a magnetic core according to an embodiment of this invention comprises two E-shape ferrite cores 2 butted to each other. There is a gap left between facing ends of middle legs of two E-shape ferrite cores 2, in which gap a permanent magnet 1 is inserted and disposed for providing a biasing magnetic field.

Figure 2:
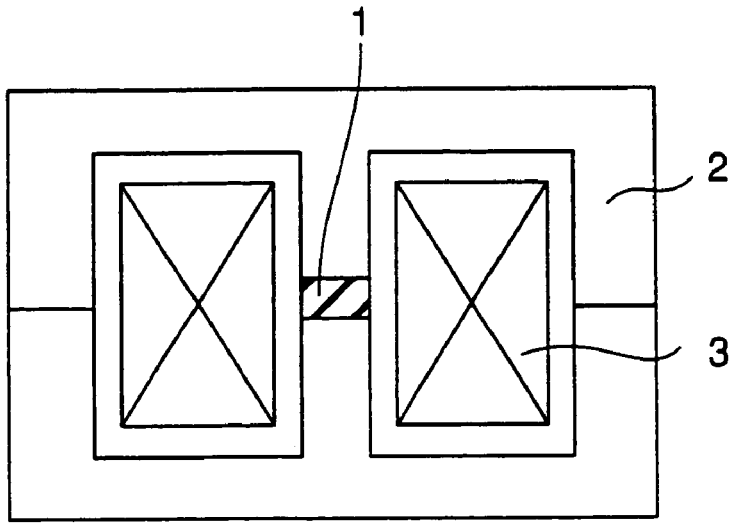
FIG. 2 is a front view of an inductance part comprising a magnetic core of FIG. 1 and a winding wound on the core.

Referring to FIG. 2, there is shown an inductance part composed by applying a wire winding 3 onto the magnetic core shown in FIG. 1.

Figure 3:
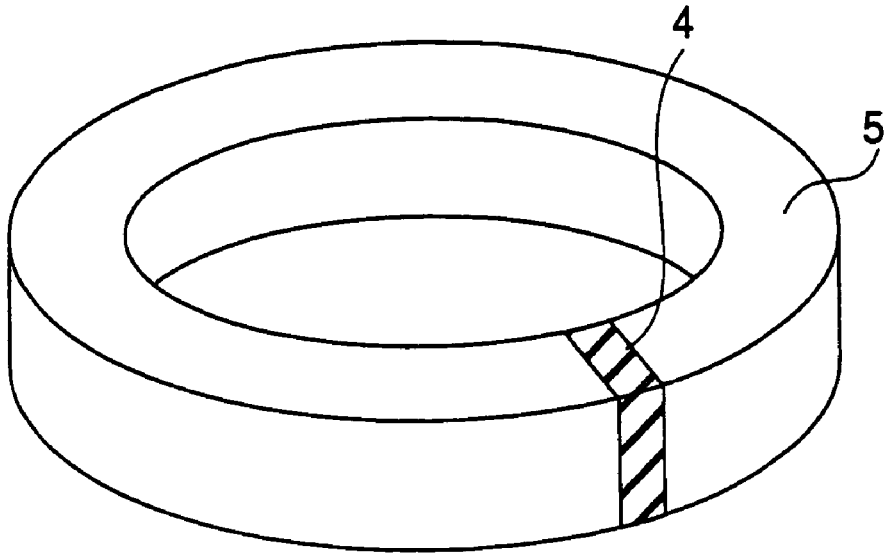
FIG. 3 is a perspective view of a magnetic core according to another embodiment of this invention.

Referring to FIG. 3, there is shown a magnetic core according to another embodiment of this invention. The magnetic core is a dust core 5 of a toroidal-shape which has a gap in a magnetic path thereof in which a permanent magnet 4 is disposed for providing a biasing magnetic field.

Figure 4:
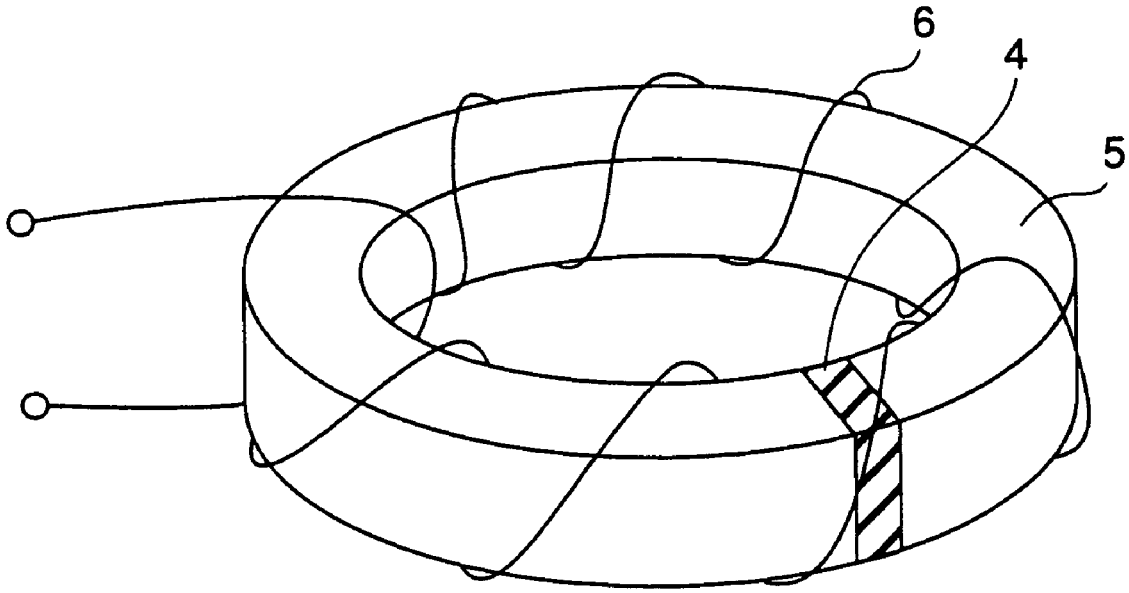
FIG. 4 is a perspective view of an inductance part comprising a magnetic core of FIG. 3 and a winding wound on the core.
Figure 5:
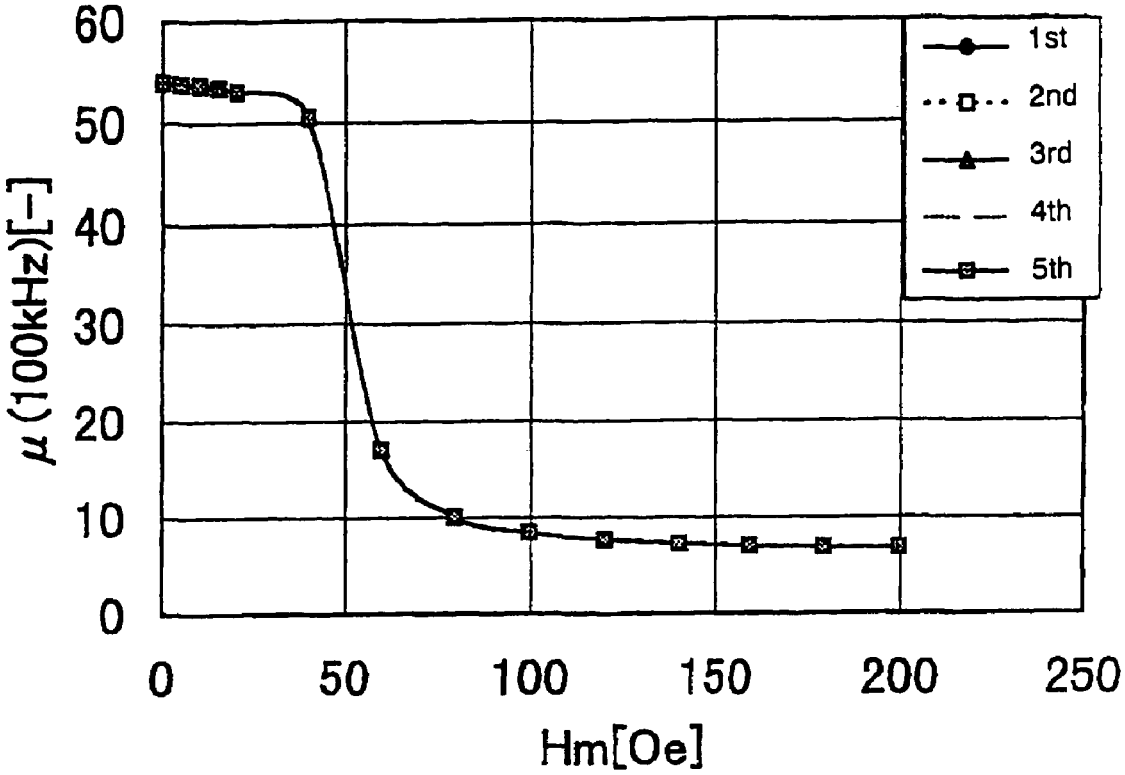
FIG. 5 graphically shows measured data of permeability μ variation (DC superposition characteristic) of a magnetic core with no magnetically biasing magnet, as a comparative sample in Example 3, in response to repeated application of various superposed DC magnetic fields Hm.
Figure 6:
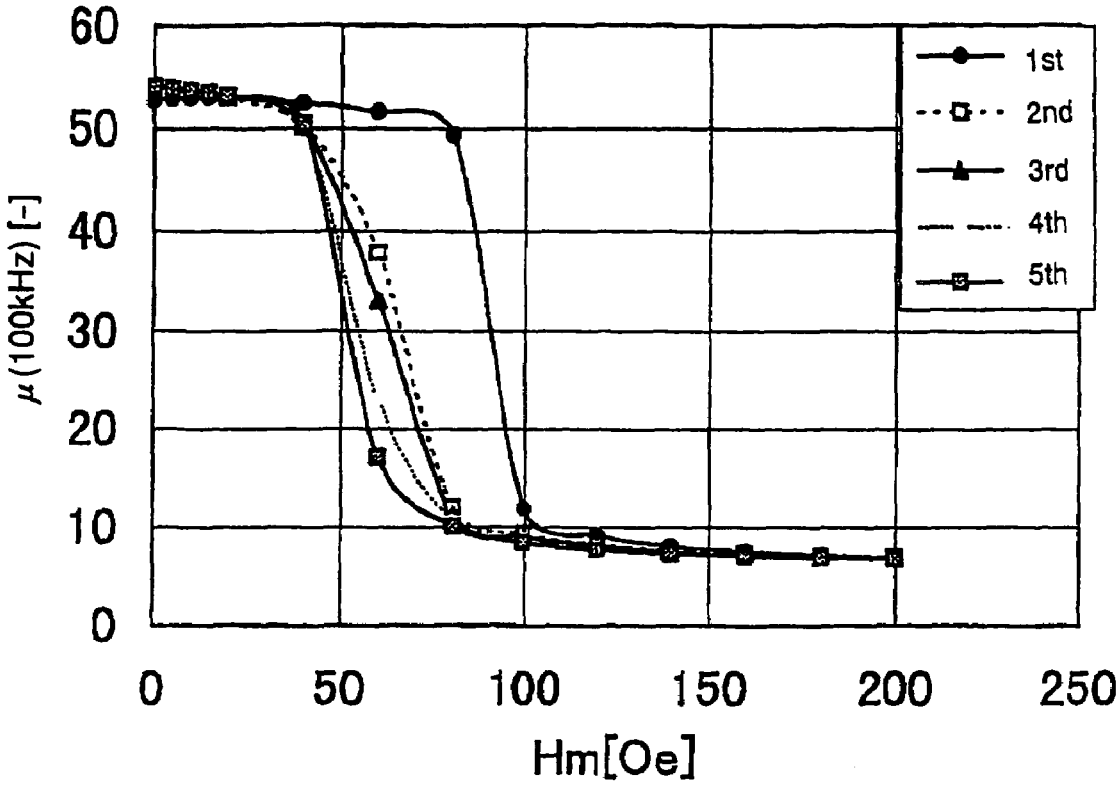
FIG. 6 graphically shows measured data of permeability μ variation (DC superposition characteristic) of a magnetic core with a ferrite magnet (sample S-1) in Example 3 as the magnetically biasing magnet in response to repeated application of various superposed DC magnetic fields Hm.
Figure 7:
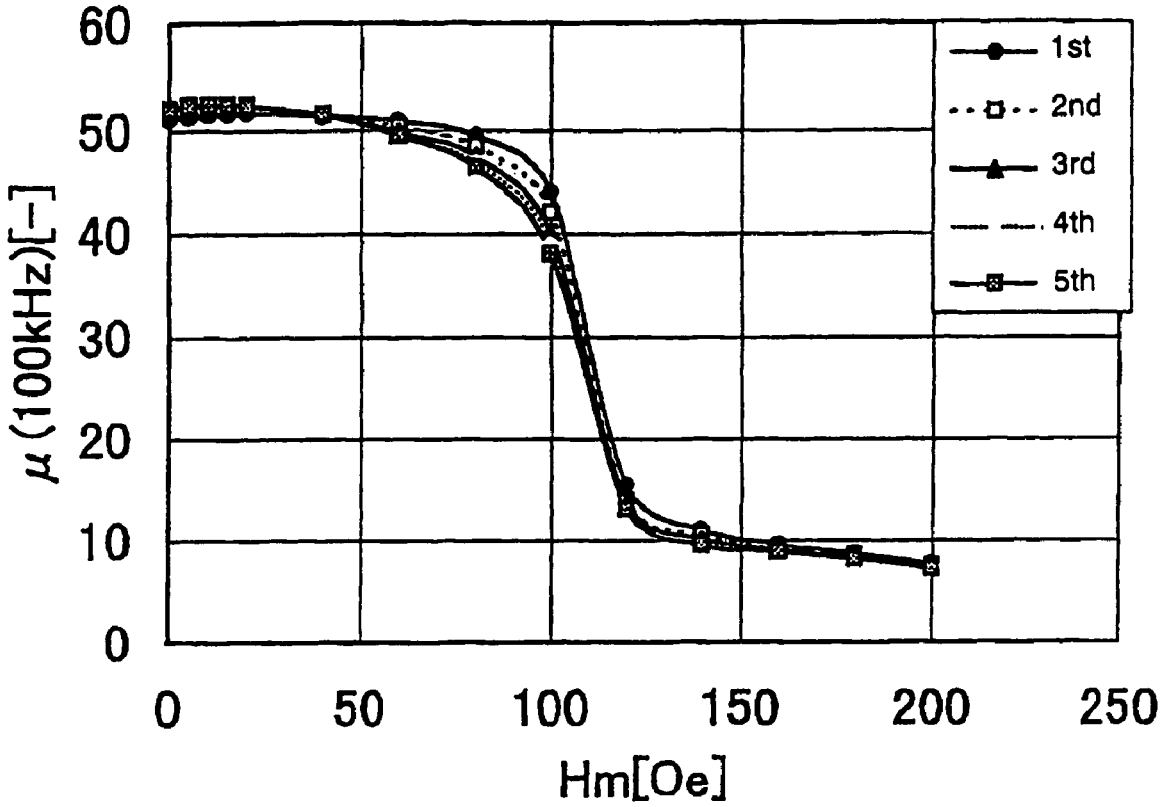
FIG. 7 graphically shows measured data of permeability μ variation (DC superposition characteristic) of a magnetic core with an Sm—Fe—N magnet (sample S-2) in Example 3 as the magnetically biasing magnet in response to repeated application of various superposed DC magnetic fields Hm.
Figure 8:
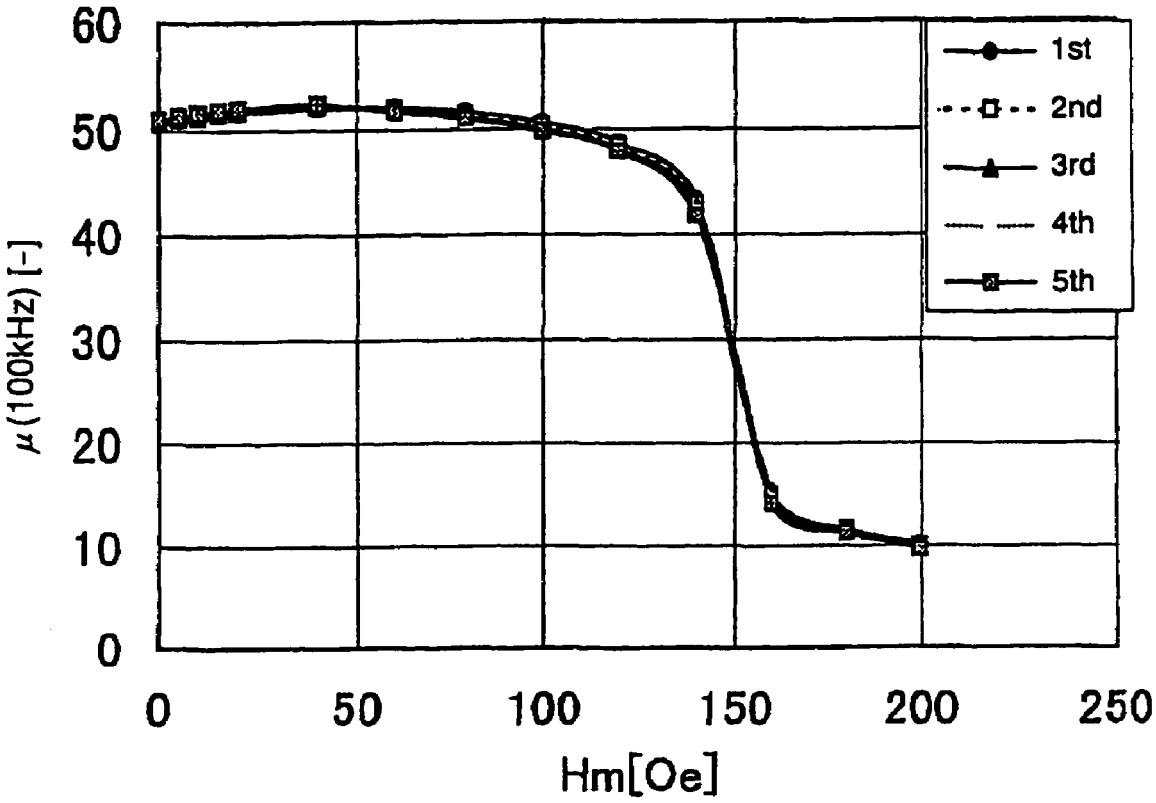
FIG. 8 graphically shows measured data of permeability μ variation (DC superposition characteristic) of a magnetic core with an Sm—Co magnet (sample S-3) in Example 3 as the magnetically biasing magnet in response to repeated application of various superposed DC magnetic fields Hm.

Referring to FIG. 4, there is shown an inductance part which is composed by applying a wire winding 6 on the magnetic core of FIG. 3.

The present co-inventors studied a possibility of a permanent magnet for providing a biasing magnetic field as shown at 1 and 4 in FIGS. 1–4. The co-inventors resultantly obtained a knowledge that a use of a permanent magnet having a specific resistance of 0.1Ω·cm or more (preferably 1Ω·cm or more) and an intrinsic coercive force iHc of 5 kOe or more can provide a magnetic core which has an excellent DC superposition characteristics and a non-degraded core-loss characteristic. This means that the property of the magnet necessary for obtaining an excellent DC superposition characteristic is the intrinsic coercive force rather than the energy product. Thus, this invention is based on the findings that the use of a permanent magnet having a high specific resistance and a high intrinsic coercive force can provide a sufficient high DC superposition characteristic.

The permanent magnet having a high specific resistance and a high intrinsic coercive force as described above can be realized by a rare-earth bond magnet which is formed of rare-earth magnetic powder having an intrinsic coercive force iHc of 5 kOe or more and a binder mixed together, then compacted. However, the magnetic powder used is not limited to the rare-earth magnetic powder but any kind of magnetic powder which has a high coercive force such as an intrinsic coercive force iHc of 5 kOe or more. The rare-earth magnetic powder includes SmCo series, NdFeB series, SmFeN series, and others. Further, taking thermal magnetic reduction into consideration, the magnetic powder used is required to have a Curie point Tc of 300° C. or more and an intrinsic coercive force iHc of 5 kOe or more.

The average particle size of the magnetic powder is desired 50 $\mu$M or less at maximum because the use of magnetic powder having the average particle size larger than 50 $\mu$m results in degradation of the core-loss characteristic. While the minimum value of the average particle size is required 2.0 $\mu$m or more because the powder having the average particle size less than 2.0 μm is significant in magnetization reduction due to oxidation of particles caused by grinding.

A constant high value of a specific resistance equal to or higher than 0.1Ω·cm can be realized by adjusting an amount of binder or a plastic resin. When the amount of the plastic resin is less than 20% on the base of volumetric percent, compacting is difficult.

By addition of coupling agent such as silane coupling agent or titanium coupling agent in the magnetic powder, or by coating surfaces of the powder particles with a surfactant, dispersion of the powder in the compact is made good or uniform so that the resultant permanent magnet has properties improved to enable to provide a magnetic core having a high performance.

In order to obtain a higher performance, compacting may be carried out in an aligning magnetic field to provide a magnetic anisotropy to the compact body.

In order to enhance oxidation resistance of the magnet, it is preferable to cover the permanent magnet surface with a heat resistant plastic resin and/or a heat resistant paint. Thereby, it is possible to realize both of the oxidation resistance and the high performance.

For the binder, any insulative plastic resin can be used which can be mixed with the magnetic powder and compacted, without affecting to the magnetic powder. Exemplarily, those resins include polypropylene resin, 6-nylone resin, 12-nylone resin, polyimide resin, polyethylene resin, and epoxy resin.

Now, description will be made as regards a magnetically biasing magnet for a magnetic core used in an inductance part surface-mounted by a reflow soldering process, as described above.

Considering a temperature in the reflow soldering process, the magnetic powder used is necessary to have an intrinsic coercive force iHc of 10 kOe or more and a Curie point Tc of 500° C. or more. As an example of the magnetic powder, SmCo magnet is recommended among various rare-earth magnets.

The average particle size of the magnetic powder needs 2.5 μm at minimum. This is because the powder smaller than it is oxidized at a powder heat treatment and a reflow soldering process and thereby becomes significant in magnetization reduction.

The plastic resin content is preferably 30% or more on the base of the volumetric percent, taking into consideration a condition of temperature in the reflow soldering process and a reliable compacting.

Considering that the plastic resin is neither carbonized nor softened at the temperature in the reflow soldering process, it is preferable to use a thermosetting plastic resin having a carbonization point of 250° C. or more or a thermoplastic resin having a softening point of 250° C. or more.

Exemplarily, those resins include polyimide resin, polyamideimide resin, epoxy resin, polyphenylene sulfide, silicone resin, polyester resin, aromatic polyamide resin, and liquid crystal polymer.

The permanent magnet can be enhanced in the heat resistance by use of a surface coating of thermosetting plastic resin (for example, epoxy resin or fluorocarbon resin) or a heat resistant paint having a heat resistance temperature of 270° C. or more.

The average particle size of the magnetic powder is more preferably 2.5–25 μm. If it is larger than the value, profile surface roughness excessively become large to thereby lower the magnetic biasing amount.

It is preferable that the magnet is 10 μm or less in a centerline average profile surface roughness Ra. When the surface is excessively rough, gaps are left between the soft magnetic core and the thin plate magnet to thereby lower a permeance constant so that a magnetic flux density effecting the magnetic core is lowered.

A magnetic core for a choke coil or a transformer can be effectively made of any kind of materials which have a soft magnetism. Generally speaking, the materials include ferrite of MnZn series or NiZn series, dust core, silicon steel plate, amorphous or others. Further, the magnetic core is not limited to a special shape but the permanent magnet according to this invention can be used in a magnetic core having a different shape such as toroidal core, E-E core, E-I core or others. Each of these magnetic core has at least one magnetic gap formed in its magnetic path in which gap the permanent magnet is disposed. Although the gap is not restricted in a length thereof, the DC superposition characteristic is degraded when the gap length is excessively small. When the gap length is, on the other hand, excessively large, the magnetic permeability is lowered. Accordingly, the gap length is determined automatically. It is preferably 50–10000 μm.

In order to make a whole size of a core small, a limit of the gap length is preferably 500 μm. In the case, the permanent magnet is accordingly 500 μm or less in thickness.

Now, examples according to this invention will be described below, where the followings are applied if no special notice is given.

Size of a Magnetic Core:

In a E-E core, a length of a magnetic path is 7.5 cm, an effective sectional area is 0.74 $cm^2$, and a gap length is given by G.

Permanent Magnet:

Its sectional size and shape is similar to those of the magnetic core, and its thickness is given by T.

Production Method of the Permanent Magnet:

The magnetic powder and the plastic resin are mixed and a bond magnet having a predetermined size and shape is formed by molding and/or hot pressing, or by a doctor blade method as a thin film forming process.

An aligning magnetic field is applied if it is required.

In the Doctor blade method, mixture is suspended in a solvent to form a slurry. The slurry is applied by use of a doctor blade to form a green sheet, which is cut into a predetermined size, and then being hot pressed if it is required.

Measuring Magnetic Properties:

Intrinsic coercive force: A test piece is formed which has a diameter of 10 mm and a thickness of 10 mm and is measured by a DC B-H curve tracer to determine its intrinsic coercive force (iHc).

Measuring a Specific Resistance:

The test piece is measured by a so called four terminal method, where two electrodes are applied to opposite ends of the test piece, a constant DC current is flown across the two electrodes through the test piece, and a voltage potential difference is measured between two points on a middle area of the test peace, from which the specific resistance is obtained.

Magnetization:

A magnetic piece is disposed in a magnetic gap of a magnetic core and is magnetized in the magnetic path of the core by the use of an electromagnet or a pulse-magnetizing machine.

Measuring a Core-loss of a Magnetic Core:

It is measured by use of an AC B-H curve tracer (SY-8232 by Iwasaki Tsushinki K.K.) under a condition where an AC current (frequency f and an AC magnetic field Ha) is flown through a wire winding wound on a magnetic core.

Measuring a DC Superposition Characteristics:

A permanent magnet is disposed in a gap of a magnetic core of an inductance part, an AC current (frequency f) is flown through a coil together with a DC current superposed (to generate a superposed magnetic field Hm in a direction opposite to a magnetized direction of the permanent magnet) to measure an inductance by the use of an LCR meter, from which a magnetic permeability of the magnetic core is calculated referring to core constants and a winding number of the coil to determine the DC superposition characteristics (magnetic permeability).

Measuring Gloss:

The gloss is a value representing a strength of reflection from a sheet surface irradiated by a light, and is given by a ratio of a measured strength of a light reflected from a test portion to a measured strength of a light reflected from a gloss standard plate.

Measuring Surface Magnetic Flux (Flux):

It is obtained by reading a variation on a flux meter (for example, TDF-5 made by TOEI) which is connected to a search coil through which a test piece is passed.

Measuring Center-line Average Profile Surface Roughness:

Irregularities of a surface of a test piece are measured by a needle contact method to obtain a profile curve, on which a centerline is drawn to equalize total areas upper and lower of the centerline. A distance from the centerline at a position is measured. A mean square root deviation of the distances at different many points is calculated. The deviation from the centerline is given as a centerline surface roughness.

Examples are as follows.

EXAMPLE 1

Relation Between Specific Resistance and Core-loss

Magnetic powder:

$Sm_2Fe_{17}N_3$

Average particle size: 3 μm

Intrinsic coercive force iHc: 10.5 kOe

Curie point Tc: 470° C.

Binder: Epoxy resin

Amount (volume %): Adjusted to obtain following specific resistances

Production method of Magnet: Molding, without aligning magnetic field

Magnet: Thickness T: 1.5 mm

Shape and Area: corresponding to the section of a middle leg of E-shape core

Specific resistance (Ω·cm):

S-1: 0.01

S-2: 0.1

S-3: 1

S-4: 10

S-5: 100

Intrinsic coercive force: 5 kOe or more

Magnetization: Electromagnet

Magnetic core: E-E core (FIGS. 1 and 2), MnZn ferrite

Magnetic gap length G: 1.5 mm

Measurement of Core-loss: Measured at f=100 kHz, Ha=0.1 T (Tesla)

Measurement of DC superposition characteristics (magnetic permeability μ): Measured at f=100 kHz, Hm=100 Oe The same magnetic core is used for each of samples and the core-loss measured in each sample is shown in Table 1.

TABLE 1

| | | Sample | | | | |
|---|---|---|---|---|---|---|
| | | S-1 | S-2 | S-3 | S-4 | S-5 |
| Specific resistance (Ω · cm) | Non-use magnet (only gap) | 0.01 | 0.1 | 1 | 10 | 100 |
| Core-loss ($kW/m^3$) | 80 | 1,500 | 420 | 100 | 90 | 85 |

It is seen from Table 1 that the core-loss rapidly increases when the specific resistance is below 0.1Ω·cm and rapidly decreases at 1Ω·cm or more. Therefore, it is desired that the specific resistance is 0.1Ω·cm, preferably 1Ω·cm or more, at minimum.

When no magnet is used in the magnetic gap, the core-loss is 80 ($kW/m^3$) which is lower than that in use of the magnet. However, the DC superposition characteristic (magnetic permeability) was 15, which is very low.

EXAMPLE 2

Relation Between Particle Size of Magnetic Powder and Core-loss

Magnetic powder: $Sm_2Co_{17}$

Curie point Tc: 810° C.

Energy Product: 28 MGOe

S-1: Maximum particle size: 200 μm

Intrinsic coercive force iHc: 12 kOe

S-2: Maximum particle size: 175 μm

Intrinsic coercive force iHc: 12 kOe

S-3: Maximum particle size: 150 μm

Intrinsic coercive force iHc: 12 kOe

S-4: Maximum particle size: 100 μm

Intrinsic coercive force iHc: 12 kOe

S-5: Maximum particle size: 50 μm

Intrinsic coercive force iHc: 11 kOe

Binder: Epoxy resin

Resin content: 10 weight % in each sample

Production method of Magnet: Molding, without aligning magnetic field

Magnetization: Electromagnet

Magnet: Thickness T: 0.5 mm

Shape and Area: 7 mm×10 mm

Specific resistance:

S-1: 1.2Ω·cm

S-2: 1.5Ω·cm

S-3: 2.0Ω·cm

S-4: 3.0Ω·cm

S-5: 5.0Ω·cm

Intrinsic coercive force: Same as magnetic powder

Magnetic core: toroidal core (FIGS. 3 and 4): Fe—Si—Al (Sendust (trademark)) dust core Size:

Outer diameter: 28 mm,

Inner diameter: 14 mm,

Height: 10 mm

Magnetic gap length G: 0.5 mm

Measurement of core-loss: Measured at f=100 kHz, Ha=0.1 T

Measurement of DC superposition characteristics (magnetic permeability): f=100 kHz, Hm=200 Oe The core-loss measured in each sample is shown in the following Table 2.

TABLE 2

| | | Sample | | | | |
|---|---|---|---|---|---|---|
| | | S-5 | S-4 | S-3 | S-2 | S-1 |
| Particle size | No magnet | −50 μm | −100 μm | −150 μm | −175 μm | −200 μm |
| Core-loss (kW/m$^3$) | 100 | 110 | 125 | 150 | 250 | 500 |

It is seen from Table 2 that the core-loss rapidly increases when the maximum particle size of the magnetic powder excesses 150 μm.

When no magnet is used in the magnetic gap, the core-loss is 100 (kW/m$^3$) which is lower than that in use of the magnet. However, the DC superposition characteristic (magnetic permeability) was 15, which is very low.

EXAMPLE 3

Relation Between Coercive Force of Magnet and DC Superposition Characteristics (Magnetic Permeability)

Magnetic powder:

S-1: Ba ferrite

Intrinsic coercive force iHc: 4.0 kOe

Curie point Tc: 450° C.

S-2: $Sm_2Fe_{17}N_3$

Intrinsic coercive force iHc: 5.0 kOe

Curie point Tc: 470° C.

S-3: $Sm_2Co_{17}$

Intrinsic coercive force iHc: 10.0 kOe

Curie point Tc: 810° C.

Particle size (Average): 3.0 μm in all samples

Binder: Polypropylene resin (Softening point 80° C.) in each sample

Amount: 50 volume %

Production method of Magnet: Molding, without aligning magnetic field

Magnet: Thickness T: 1.5 mm

Sectional shape: corresponding to the section of a middle leg of the core

Specific resistance:

S-1: $10^4$Ω·cm or more

S-2: $10^3$Ω·cm or more

S-3: $10^3$Ω·cm or more

Intrinsic coercive force: Same as magnetic powder

Magnetization: Pulse magnetization machine

Magnetic core: E-E core (FIGS. 1 and 2), MnZn ferrite

Magnetic gap length G: 1.5 mm

Measurement of DC superposition characteristics (magnetic permeability μ): Measured at f=100 kHz, Hm=0 to 200 Oe varied Using the same magnetic core, the measurement is repeated by five times in each sample, and the measured DC superposition characteristic is shown in FIGS. 5–8.

It is seen from these figures that DC superposition characteristics is significantly degraded in the core attached with a ferrite magnet having a coercive force of only 4 kOe as the measuring times are repeated. On the contrary, when a bond magnet having a large coercive force is attached to the core, it is not so varied in repeated measurements but shows a very stable characteristics. It is understandable from these results that the ferrite magnet is demagnetized or magnetized in a reversed direction by an opposite magnetic field applied to the magnet because it is low in the coercive force so that the DC superposition characteristics is degraded. Further, it is seen that an excellent DC superposition characteristics can be obtained when a magnet disposed in the core is a rare-earth bond magnet having a coercive force of 5 kOe or more.

EXAMPLE 4

Relation Between Particle Size of Magnetic Powder and Core-loss as Well as Surface Flux Magnetic powder: $Sm_2Co_{17}$ Average particle size (μm):

S-1: 1.0

S-2: 2.0

S-3: 25

S-4: 50

S-5: 55

S-6: 75

Binder: Polyethylene resin

Amount: 40 volume %

Production method of Magnet: Molding, without aligning magnetic field

Magnet: Thickness: 1.5 mm

Shape and Area: corresponding to the section of a middle leg of E-shape core

Specific resistance: 0.01 to 100Ω·cm (by adjusting resin content)

Intrinsic coercive force: 5 kOe or more in all samples

Magnetization:

Electromagnet

Magnetic core: E-E core (FIGS. 1 and 2), MnZn ferrite

Magnetic gap length G: 1.5 mm

Core-loss: Measured at f=100 kHz and Hz=0.1 T

The surface magnetic flux and the core-loss measured in each sample are shown in Table 3.

TABLE 3

| | | Sample | | | | | |
|---|---|---|---|---|---|---|---|
| | | S-1 | S-2 | S-3 | S-4 | S-5 | S-6 |
| particle size ($\mu$m) | No magnet (Gap only) | 1.0 | 2.0 | 25 | 50 | 55 | 75 |
| Core loss (kW/m$^3$) | 520 | 650 | 530 | 535 | 555 | 650 | 870 |
| Surface flux of magnet (Gauss) | — | 130 | 200 | 203 | 205 | 206 | 209 |

After measurement of the core-loss, the magnetically biasing magnet 1 is removed from the core 2, and the surface magnetic flux of the magnet was measured by use of TDF-5 made by TOEI. The surface fluxes were calculated from the measured values and a size of the magnet and are shown in Table 3.

In Table 3, the core-loss for an average particle size of 1.0 $\mu$m is relatively large. This is because that the oxidation of the powder was accelerated due to a large surface area of the powder. Further, the core-loss for an average particle size of 55 $\mu$m or more is relatively large. This is because that the eddy current loss was increased as the average particle size of the powder increases.

Further, the surface magnetic flux of Sample S-1 of an average particle size of 1.0 $\mu$m is relatively small. This is because that the powder is oxidized in grinding or drying so that the magnetic portion to be magnetized is reduced.

EXAMPLE 5

Relation Between Resin Content and Specific Resistance as Well as Core-loss

Magnetic powder: $Sm_2Fe_{17}N_3$
- Average particle size: 5.0 $\mu$m
- Intrinsic coercive force iHc: 5 kOe
- Curie point Tc: 470° C.

Binder: 6-nylone resin
- Resin content (Volume %):
  - S-1: 10
  - S-2: 15
  - S-3: 20
  - S-4: 32
  - S-5: 42

Production method of Magnet: Molding, without aligning magnetic field

Magnet: Thickness T: 1.5 mm,
- Shape and Area: corresponding to the section of a middle leg of E-shape core
- Specific resistance (Ω·cm): See Table 4
- Intrinsic coercive force: 5 kOe or more in all samples Magnetization: Electromagnet Magnetic core: E-E core (FIGS. 1 and 2), MnZn ferrite
- Magnetic gap length G: 1.5 mm Core-loss: Measured at f=100 kHz/Ha=0.1 T The core-loss measured in each sample is shown in Table 4.

TABLE 4

| | | Sample | | | | |
|---|---|---|---|---|---|---|
| | | S-1 | S-2 | S-3 | S-4 | S-5 |
| Specific resistance (Ω · cm) | Non-use magnet (only gap) | 0.01 | 0.1 | 1.0 | 10 | 100 |
| Resin content (vol %) | — | 10 | 15 | 20 | 32 | 42 |
| Core-loss (kW/m$^3$) | 80 | 1,500 | 420 | 95 | 90 | 85 |

It is seen from Table 4 that, in use of a bond magnet having a resin content of 20 vol % or more and specific resistance of 1·cm or more, the core exhibits an excellent core-loss.

EXAMPLE 6

Relation Between Resin Content and DC Superposition Characteristics

Magnetic powder: $Sm_2Fe_{17}N_3$
- Average particle size: 5 $\mu$m
- Intrinsic coercive force iHc: 5.0 kOe
- Curie point Tc: 470° C.

Binder: 12-nylone resin
- Resin content (volume %):
  - S-1: 10,
  - S-2: 15,
  - S-3: 20,
  - S-4: 30

Production method of Magnet: Molding, without aligning magnetic field

Magnet: Thickness T: 1.5 mm
- Shape and Area: corresponding to the section of a middle leg of E-shape core
- Specific resistance:
  - S-1: 0.01Ω·cm
  - S-2: 0.05Ω·cm
  - S-3: 0.2Ω·cm
  - S-4: 15Ω·cm
- Intrinsic coercive force: 5 kOe or more in all samples Magnetization: Electromagnet Magnetic core: E-E core (FIG. 1), MnZn ferrite
- Magnetic gap length G: 1.5 mm Measurement of a frequency response of DC superposition characteristics (magnetic permeability): DC superposition characteristics (magnetic permeability $\mu$) was measured at various frequency within a range of f=1–100,000 kHz.

Figure 9:
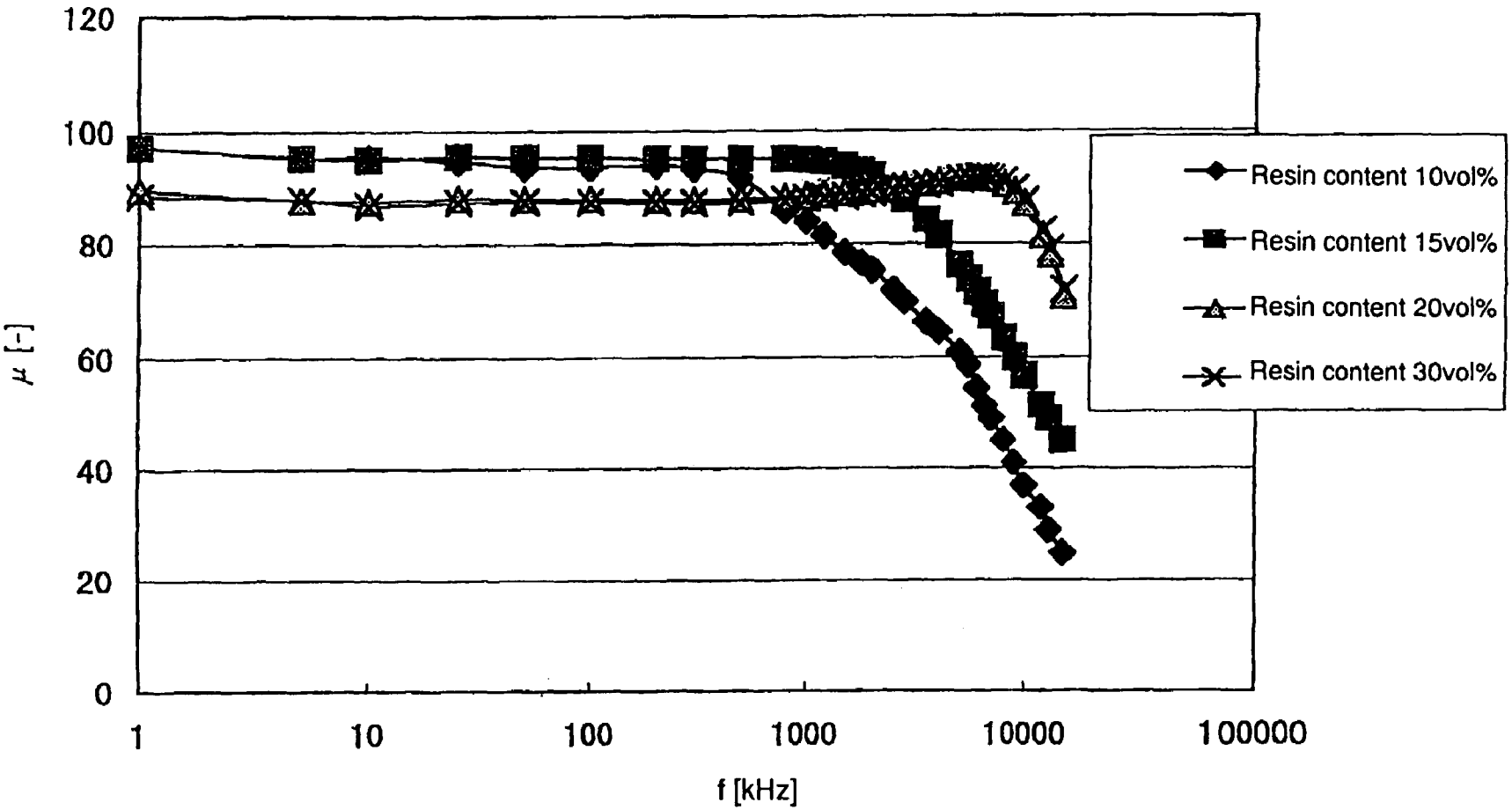
FIG. 9 graphically shows measured data of a frequency response of a DC superposition characteristic (magnetic permeability) μ of a magnetic core using each of sample magnets S-1 to S-4 in Example 6 which have different plastic resin contents.

Using the same magnetic core for each of samples, the frequency response of the magnetic permeability $\mu$) measured is shown in FIG. 9.

It is seen from FIG. 9 that, in use of a bond magnet having the resin content of 20 vol % or more, the magnetic core exhibits an excellent frequency response of the magnetic permeability $\mu$ in a frequency range to a high frequency.

EXAMPLE 7

Relation Between Addition of Coupling Agent and DC Superposition Characteristics Magnetic powder: $Sm_2Fe_{17}N_3$
- Average particle size: 5 $\mu$m Intrinsic coercive force iHc: 5.0 kOe
Curie point Tc: 470° C.
Coupling agent:
S-1: titanium coupling agent 0.5 wt %
S-2: silane coupling agent 0.5 wt %
S-3: no coupling agent
Binder: epoxy resin
Resin content: 30 volume %
Production method of Magnet: Molding, without aligning magnetic field
Magnet: Thickness T: 1.5 mm
Shape and Area: corresponding to the section of a middle leg of E-shape core
Specific resistance:
S-1: 10Ω·cm
S-2: 15Ω·cm
S-3: 2Ω·cm
Intrinsic coercive force: 5 kOe or more in all samples
Magnetization: Electromagnet
Magnetic core: E-E core (FIGS. 1 and 2), MnZn ferrite
Magnetic gap length G: 1.5 mm
Measurement of a frequency response of DC superposition characteristics (magnetic permeability): Magnetic permeability $\mu$ was measured at various frequency within a range of f=1–100,000 kHz.

Figure 10:
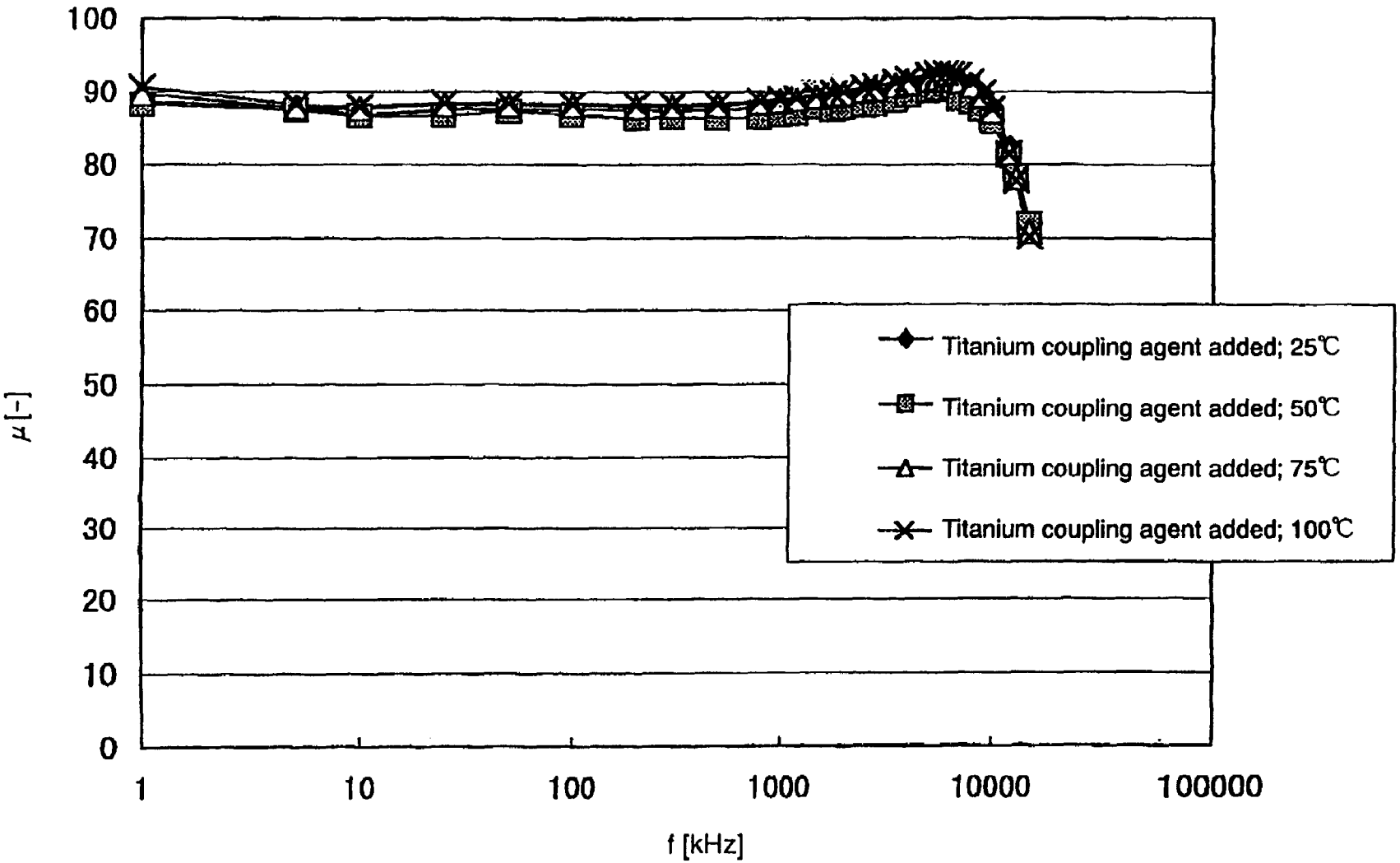
FIG. 10 graphically shows measured data of a frequency response of a DC superposition characteristic (magnetic permeability) μ of a magnetic core using a magnetically biasing magnet (sample S-1) containing an addition of titanium coupling agent in Example 7, in different temperatures.
Figure 11:
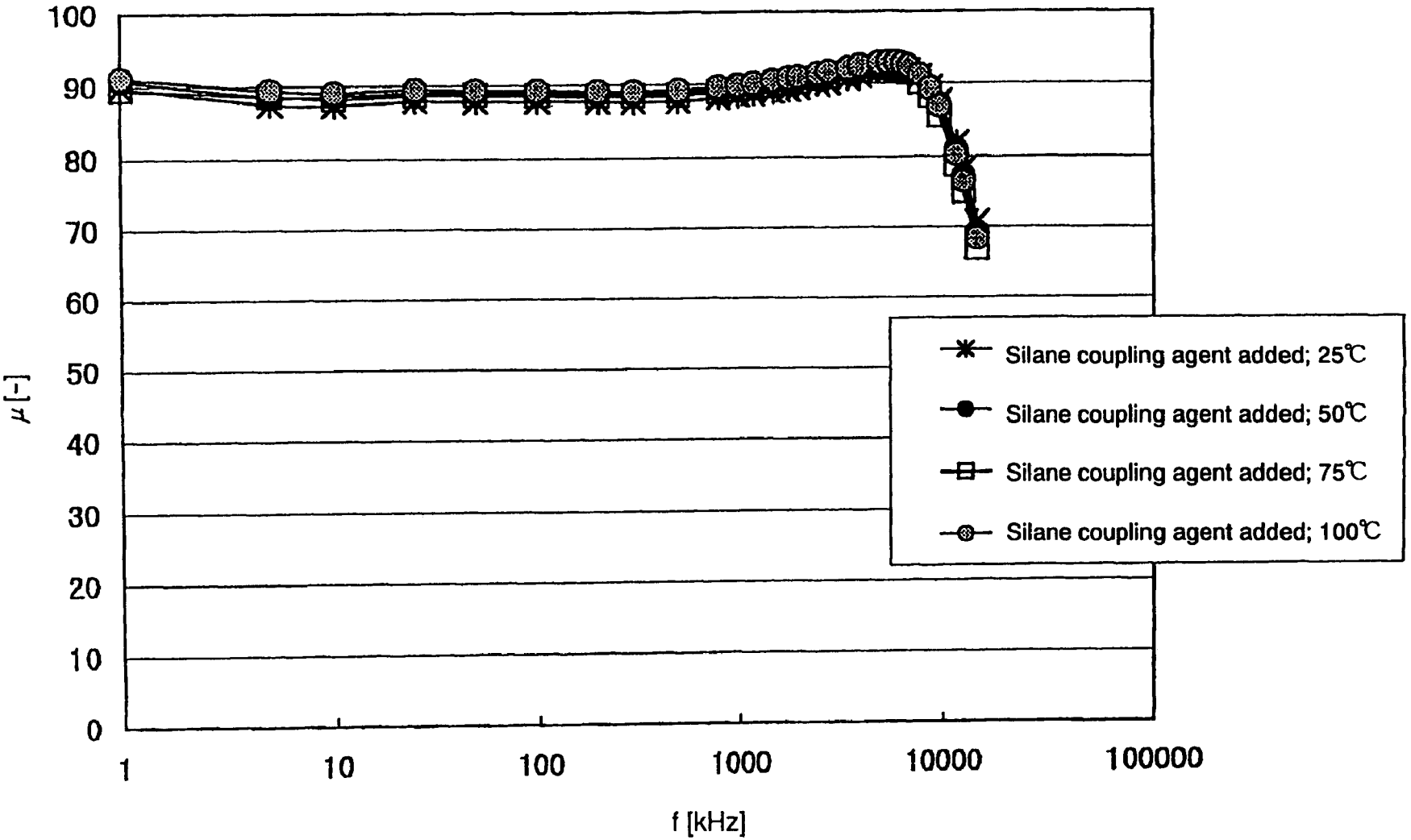
FIG. 11 graphically shows measured data of a frequency response of a DC superposition characteristic (magnetic permeability) μ of a magnetic core using a magnetically biasing magnet (sample S-2) containing an addition of silane coupling agent in Example 7, in different temperatures.
Figure 12:
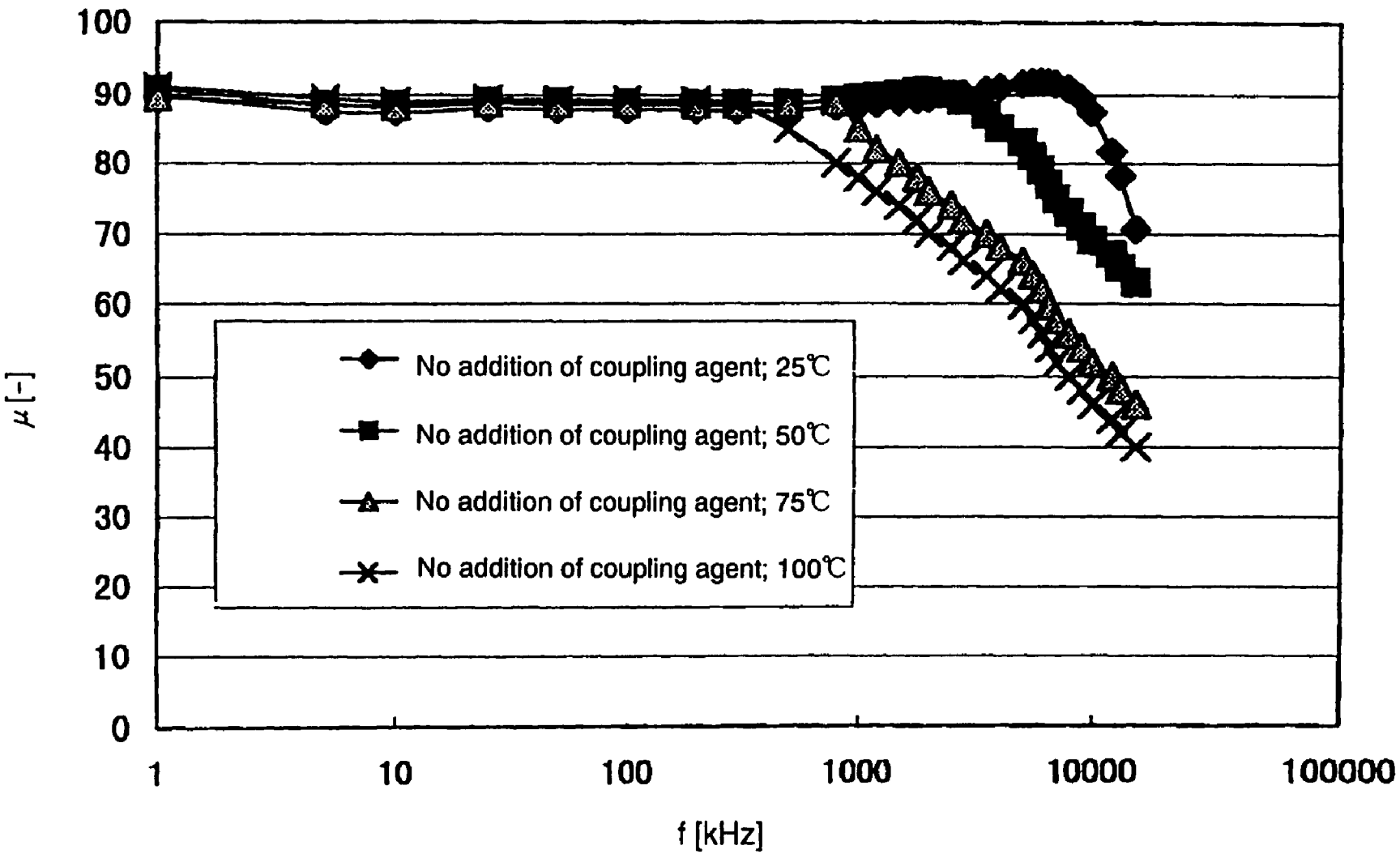
FIG. 12 graphically shows measured data of a frequency response of a DC superposition characteristic (magnetic permeability) μ of a magnetic core using a magnetically biasing magnet (sample S-3) containing no coupling agent in Example 7, in different temperatures.

For using each of samples S-1 to S-3, the frequency response of the DC superposition characteristics measured is shown in FIGS. 10–12.

It is seen from FIGS. 10–12 that, in the magnetic core using each of the bond magnets containing titanium coupling agent and silane coupling agent, respectively, the frequency response of the magnetic permeability $\mu$ is stable in a temperature range to a high temperature. The reason why the one including the coupling agent exhibits the excellent temperature characteristic is due to a fact that dispersion of the powder in the resin is well done by addition of the coupling agent so that the volumetric change of the magnet caused by temperature variation is reduced.

EXAMPLE 8

Relation Between Surface Coating of the Magnet and Magnetic Flux

Magnetic powder: $Sm_2Fe_{17}N_3$
Average particle size: 3 $\mu$m
Intrinsic coercive force iHc: 10.0 kOe
Curie point Tc: 470° C.
Binder: 12-nylone resin
Resin content: 40 volume %
Production method of Magnet: Molding, without aligning magnetic field
Magnet: Thickness: 1.5 mm
Shape and Area: corresponding to the section of a middle leg of E-shape core
Specific resistance: 100Ω·cm
Intrinsic coercive force: same as magnetic powder
Surface coating:
S-1: epoxy resin
S-2: no coating
Magnetization: Pulse magnetizing machine
Magnetizatioin field 10 T
Magnetic core: E-E core (FIGS. 1 and 2), MnZn ferrite
Magnetic gap length G: 1.5 mm The surface coating was formed by dipping a magnet in a epoxy resin solution, taking out and drying it, then heat treating it at a thermosetting temperature of the resin to cure it.

Each of sample S-1 and comparative sample S-2 was heat treated for 30 minutes at a temperature every 20° C. increment from 120° C. to 220° C. It was taken out from a furnace just after every heat-treatment and was subjected to measurement of a surface magnetic flux (amount of magnetic flux) and a DC superposition characteristic. The measured results are shown in FIGS. 13–15.

Figure 13:
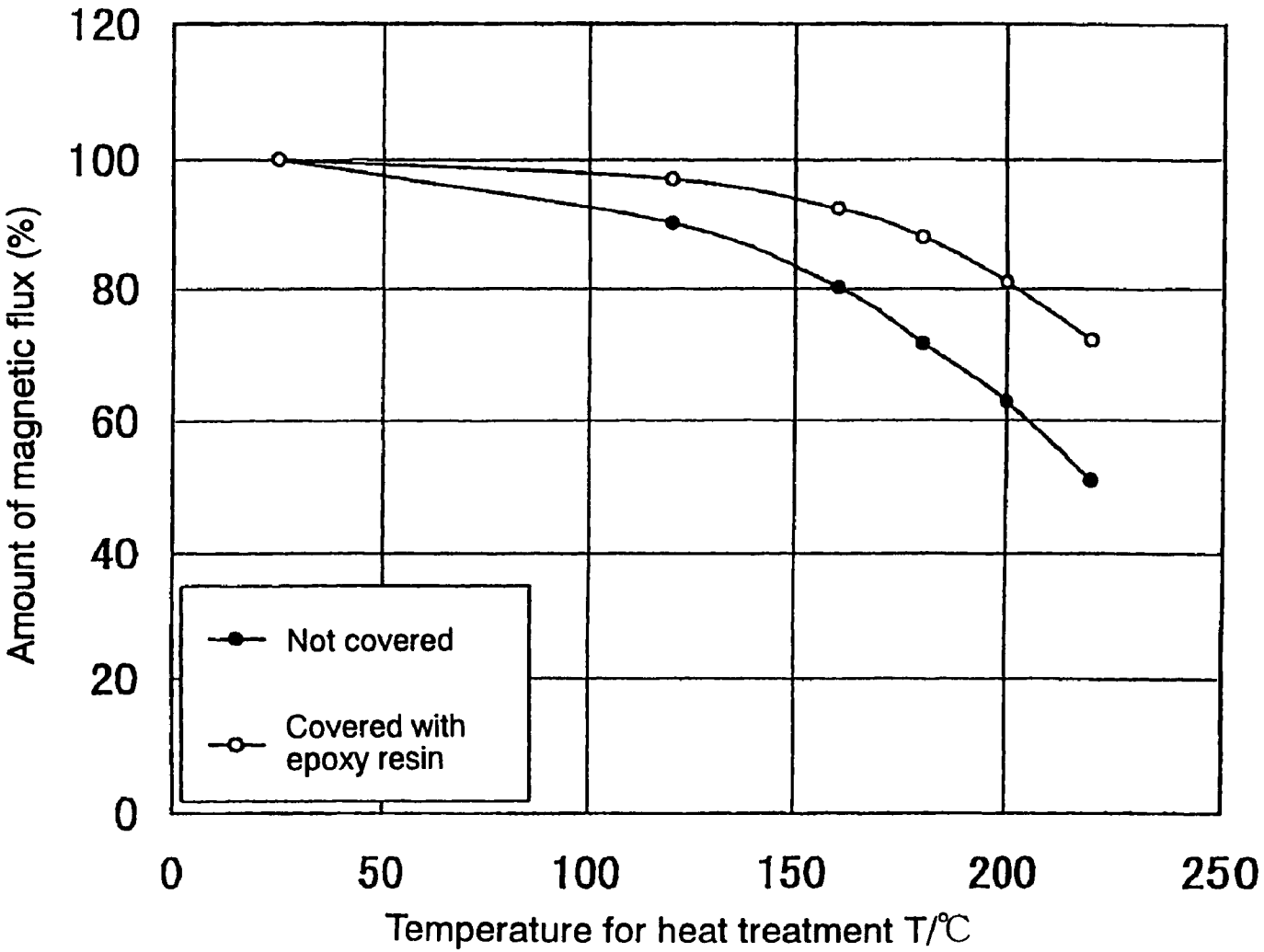
FIG. 13 graphically shows measured data of variation of a magnetic flux amount of each of a bond magnet (S-2) uncovered with any plastic coating and another bond magnet (S-1) covered with an epoxy coating in response to different heat treatments in Example 8.

FIG. 13 shows a variation of the surface magnetic flux responsive to the heat treatment. According to the results, the magnet with no coating was demagnetized about 49% at 220° C. In comparison with this, it was found out that the core inserted with a magnet coated with epoxy resin is very small in degradation caused by the heat treatment, that is, about 28% at 220° C., and has a stable characteristic. This is considered that oxidation of the magnet is suppressed by the epoxy resin coated on the surface to thereby restrict reduction of the magnetic flux.

Further, each of the bond magnets is inserted in a core and the DC superposition characteristic was measured. The result is shown in FIGS. 14 and 15.

Figure 14:
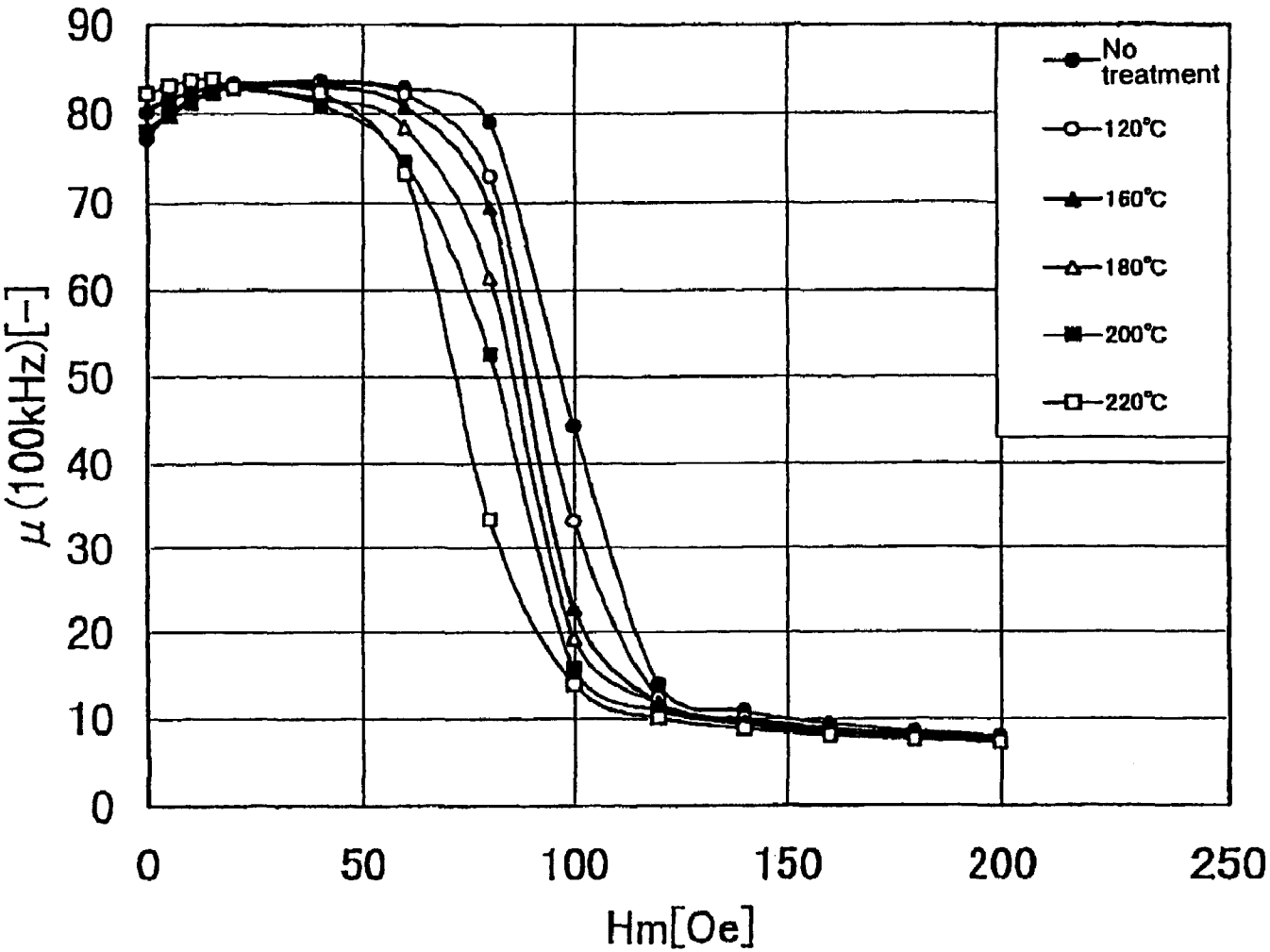
FIG. 14 graphically shows measured data of a variation of a DC superposition characteristic (magnetic permeability $\mu$) of a magnetic core using, as a magnetically biasing magnet disposed in a magnetic gap, the bond magnet (sample S-2) uncovered with a plastic coating in Example 8, when the core is heat treated at different temperatures.
Figure 15:
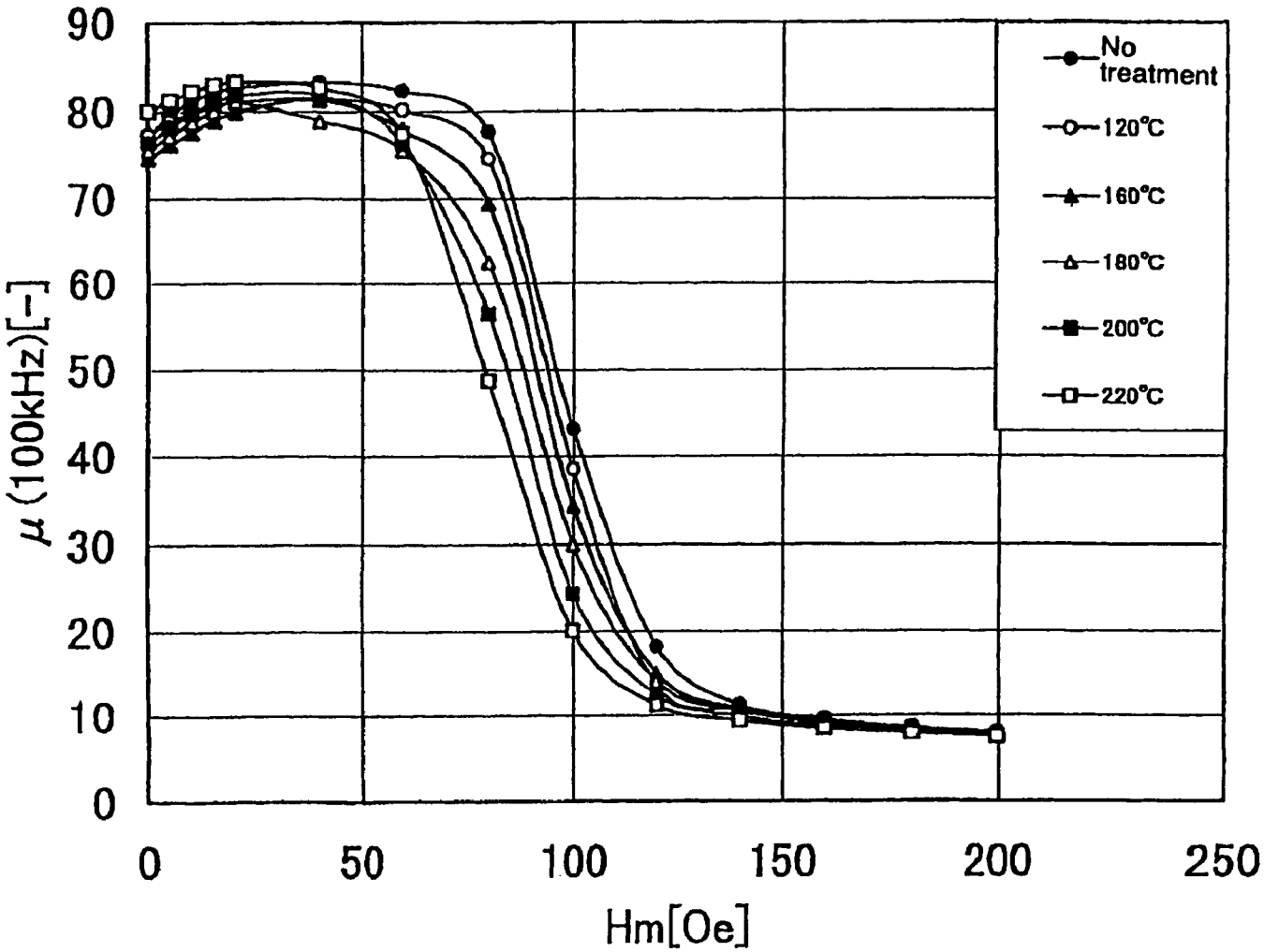
FIG. 15 graphically shows measured data of a variation of a DC superposition characteristic (magnetic permeability $\mu$) of a magnetic core using, as a magnetically biasing magnet disposed in a magnetic gap, the bond magnet (sample S-1) covered with an epoxy coating in Example 8, when the core is heat treated at different temperatures.

Referring to FIG. 14, it is seen that, in the core using the resin-uncovered magnet of sample S-2, the magnetic permeability shifts to a low magnetic field side about 30 Oe and the characteristic degrades significantly at 220° C., because the magnetic flux is reduced due to the heat-treatment as shown in FIG. 13 to reduce a biasing magnetic field from the magnet. In comparison with this, it shifts to the low magnetic field side only about 17 Oe in case of sample S-1 covered with epoxy resin as shown in FIG. 15.

Thus, the DC superposition characteristic is significantly improved by use of epoxy resin coating comparing with non-coating.

EXAMPLE 9

Relation Between Surface Coating of the Magnet and Magnetic Flux

This is similar to Example 8 except that the magnetic powder, binder and surface coating are $Sm_2Co_{17}$, polypropylene resin and fluorocarbon resin, respectively.

Figure 17:
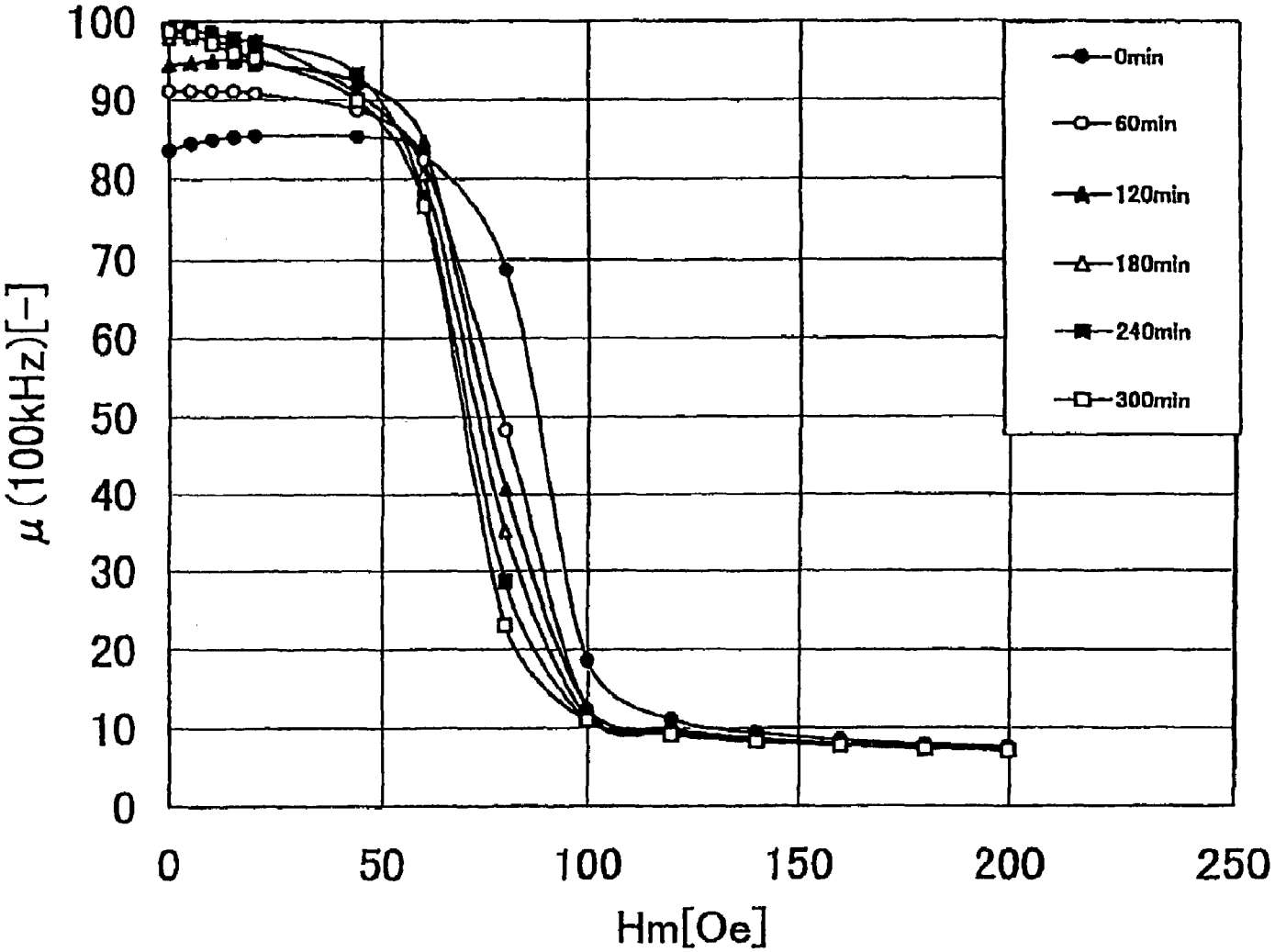
FIG. 17 graphically shows measured data of a variation of a DC superposition characteristic (magnetic permeability $\mu$) to different heat-treatment time periods of a magnetic core using, as a magnetically biasing magnet disposed in a magnetic gap, a bond magnet (sample S-2) uncovered with a plastic coating when the core is heat treated for different time periods in Example 9.
Figure 18:
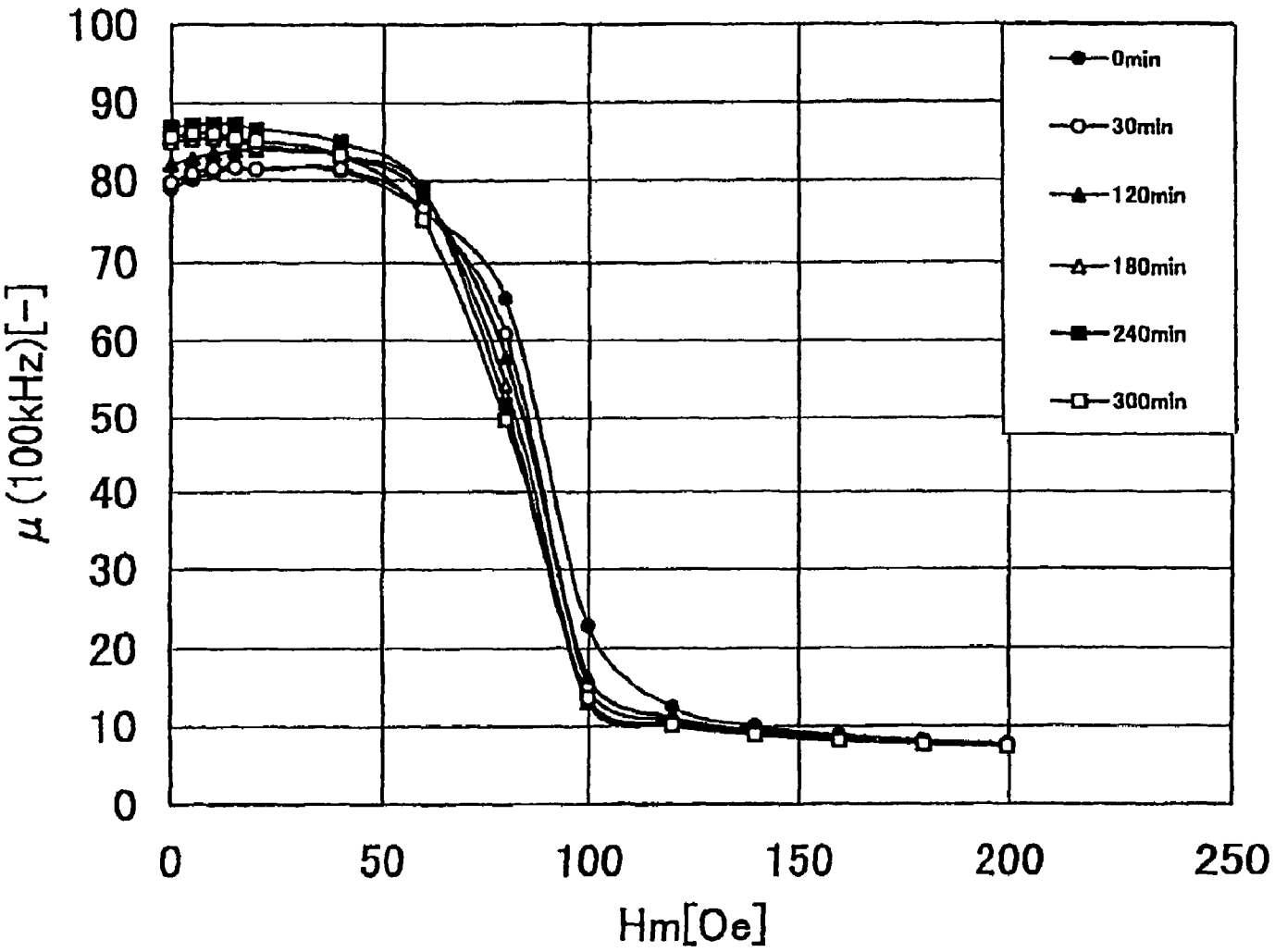
FIG. 18 graphically shows measured data of a variation of a DC superposition characteristic (magnetic permeability $\mu$) to different heat-treatment time periods of a magnetic core using, as a magnetically biasing magnet in a magnetic gap, a bond magnet (sample S-1) covered with a fluorocarbon resin coating when the core is heat treated for different time periods in Example 9.

Each of a bond magnet (sample S-1) covered with fluorocarbon resin another bond magnet (sample S-2) uncovered with any resin was heat treated in an atmosphere at 220° C. for five hours in total, but being taken out every 60 minutes to be subjected to the measurement of magnetic flux and the measurement of DC superposition characteristics. The results are shown in FIGS. 16–18.

Figure 16:
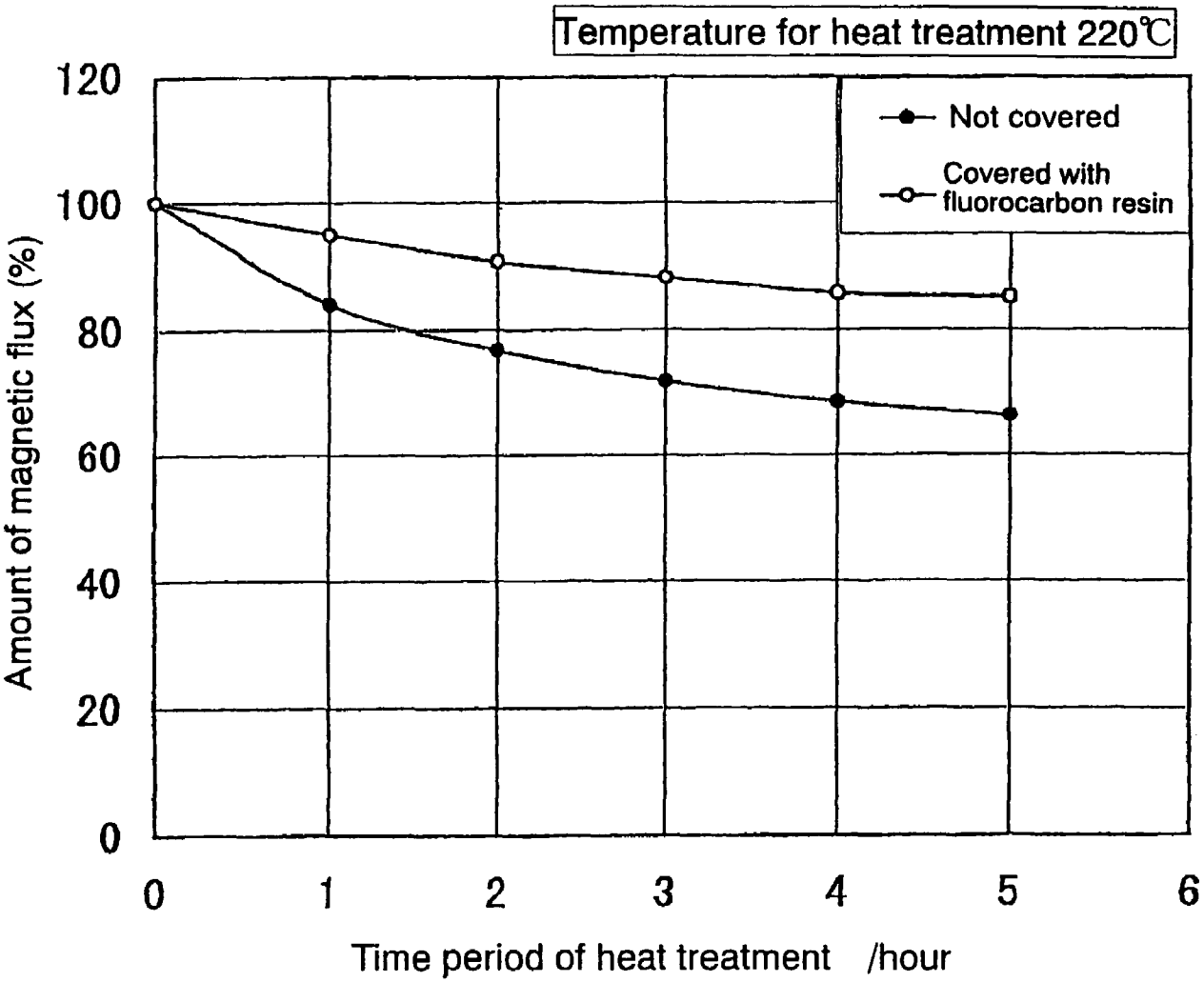
FIG. 16 graphically shows measured data of variation of a magnetic flux amount to different heat-treatment time periods of each of a bond magnet (S-2) uncovered with any plastic coating and another bond magnet (S-1) covered with an fluorocarbon resin coating in response to different heat treatments in Example 9.

FIG. 16 shows a variation of the surface magnetic flux responsive to the heat treatment. It is seen from the results that, comparing with the uncovered magnet of sample S-2 being demagnetized by 34% after five hours, sample S-1 magnet covered with fluorocarbon resin is very small in demagnetization such as 15% after five hours and exhibits a stable characteristic.

This is considered that the surface of the magnet is restricted from oxidation by coating of the fluorocarbon resin so that reduction of the magnetic flux can be suppressed.

The bond magnets of sample S-2 and S-1 were separately disposed in the same magnetic core and the DC superposition characteristic was measured. The results are shown in FIGS. 17 and 18. Referring to FIG. 17, the core with the resin-uncovered sample magnet S-2 inserted was shifted in the magnetic permeability to the lower magnetic field side by about 20 Oe after five hours to significantly degrade the characteristics, because a biasing magnetic field from the magnet is reduced due to the decrease in magnetic flux by the heat treatment as shown in FIG. 16.

Comparing with this, in a core using the fluorocarbon resin covered magnet of sample S-1, the DC superposition characteristic of the core it was shifted only about 8 Oe to the lower magnetic field side as shown in FIG. 18.

Thus, the DC superposition characteristic is significantly improved by use of a biasing magnet covering with fluorocarbon resin than the uncovered one.

It will be noted from the above that the bond magnet having a surface covered with the fluorocarbon resin is restricted from oxidation and provides a excellent characteristics. Further, the similar results have been confirmed to be obtained by use of other heat resistant resin and heat resistant paint.

EXAMPLE 10

Relation Between Formability and Kind and Content of Resin

Magnetic powder: $Sm_2Co_{17}$
- Average particle size: 5.0 $\mu$m
- Intrinsic coercive force iHc: 15.0 kOe
- Curie point Tc: 810° C.

Binder:
- S-1: polypropylene resin,
- S-2: 6-nylone resin,
- S-3: 12-nylone resin The magnetic powder was mixed with each of resins as the binder at different resin contents in the range of 15–40 volume % and formed a magnet with a thickness of 0.5 mm by a hot pressing without application of aligning magnetic field.

As a result, it was seen that the formation could not be possible by use of any one of the resins described if the resin content is less than 20 volume %.

EXAMPLE 11

Relation Between Magnet Powder and DC Superposition Charactristics

Figure 19:
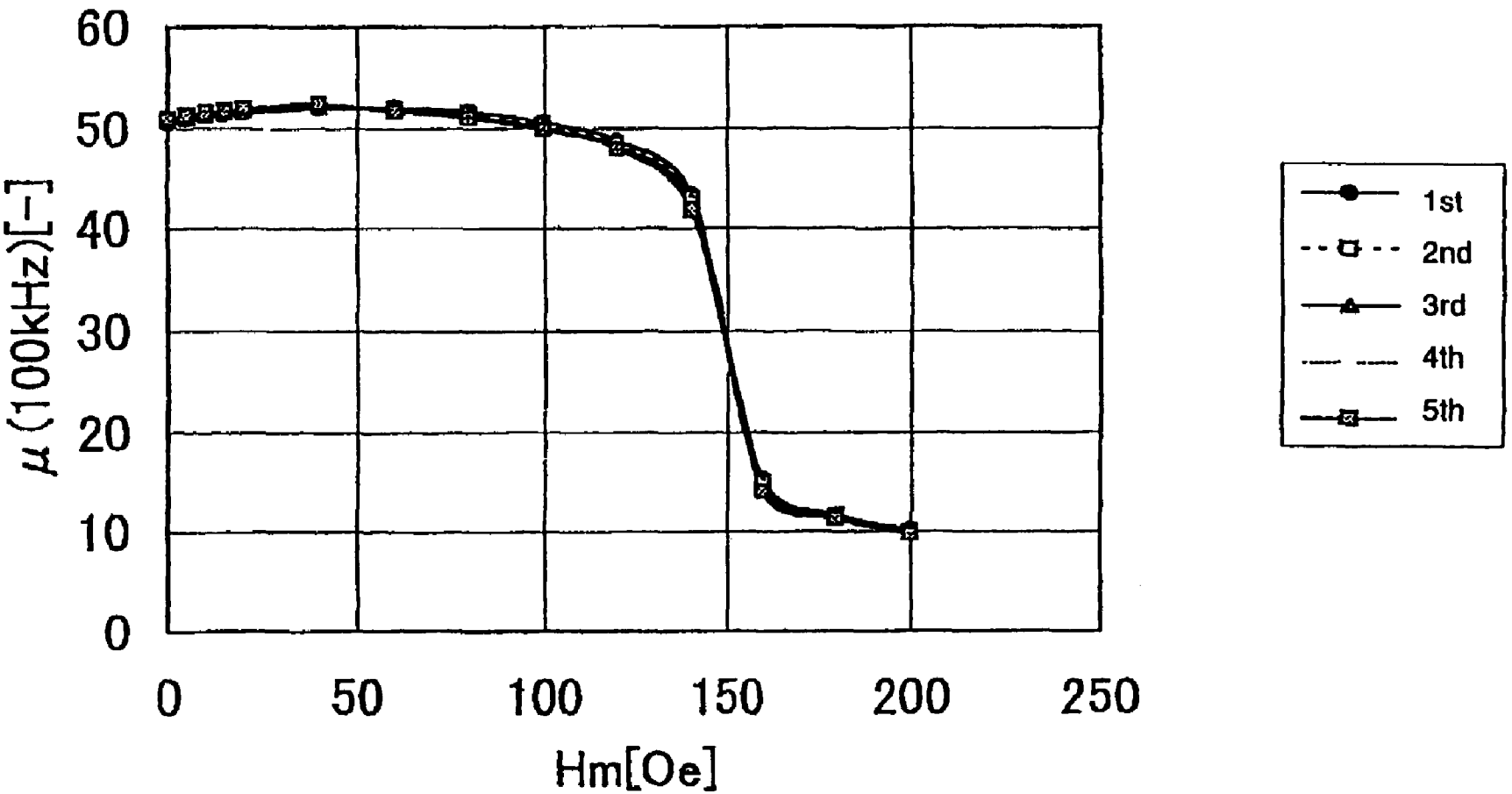
FIG. 19 graphically shows measured data of a variation of a DC superposition characteristic (magnetic permeability $\mu$) to different measuring time numbers of a magnetic core using, as a magnetically biasing magnet in a magnetic gap, a bond magnet (sample S-1) comprising $Sm_2Fe_{17}N_3$ magnetic powder and polypropylene resin in Example 11.
Figure 20:
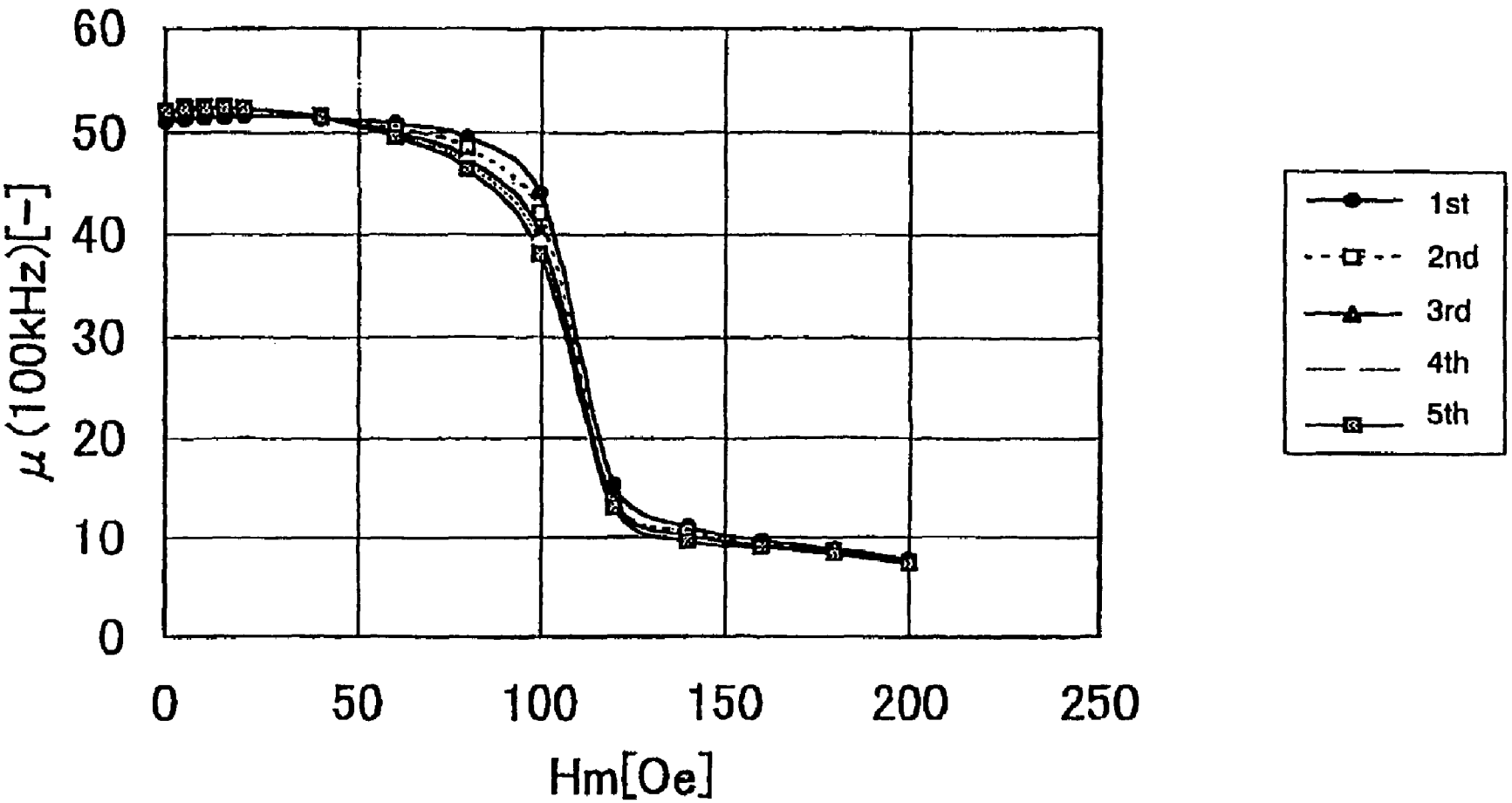
FIG. 20 graphically shows measured data of a variation of a DC superposition characteristic (magnetic permeability $\mu$) to different measuring time numbers of a magnetic core using, as a magnetically biasing magnet in a magnetic gap, a bond magnet (sample S-2) comprising $Sm_2Fe_{17}N_3$ magnetic powder and 12-nylone resin in Example 11.
Figure 21:
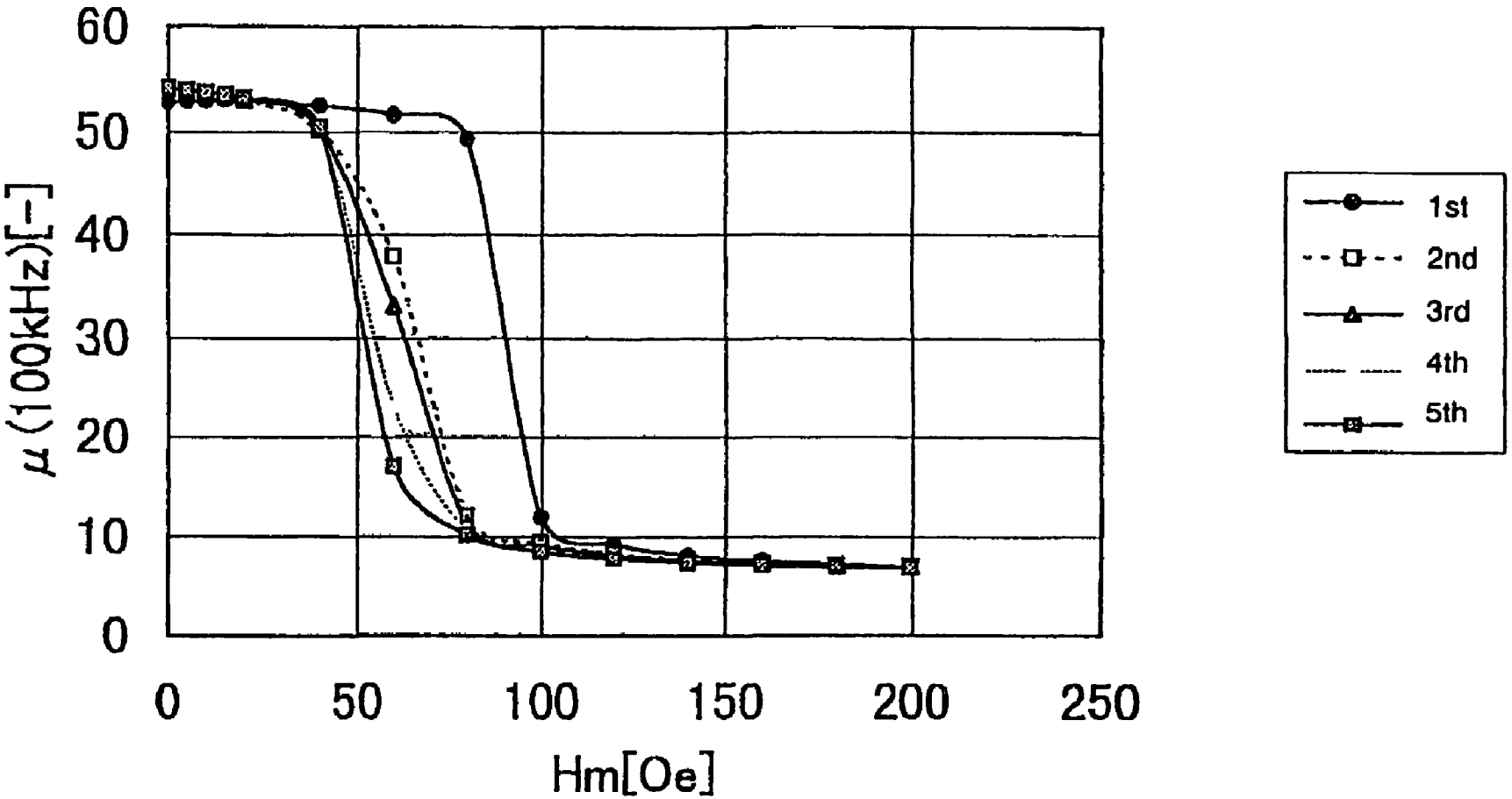
FIG. 21 graphically shows measured data of a variation of a DC superposition characteristic (magnetic permeability $\mu$) to different measuring time numbers of a magnetic core using, as a magnetically biasing magnet in a magnetic gap, a bond magnet (sample S-3) comprising Ba ferrite magnetic powder and 12-nylone resin in Example 11.
Figure 22:
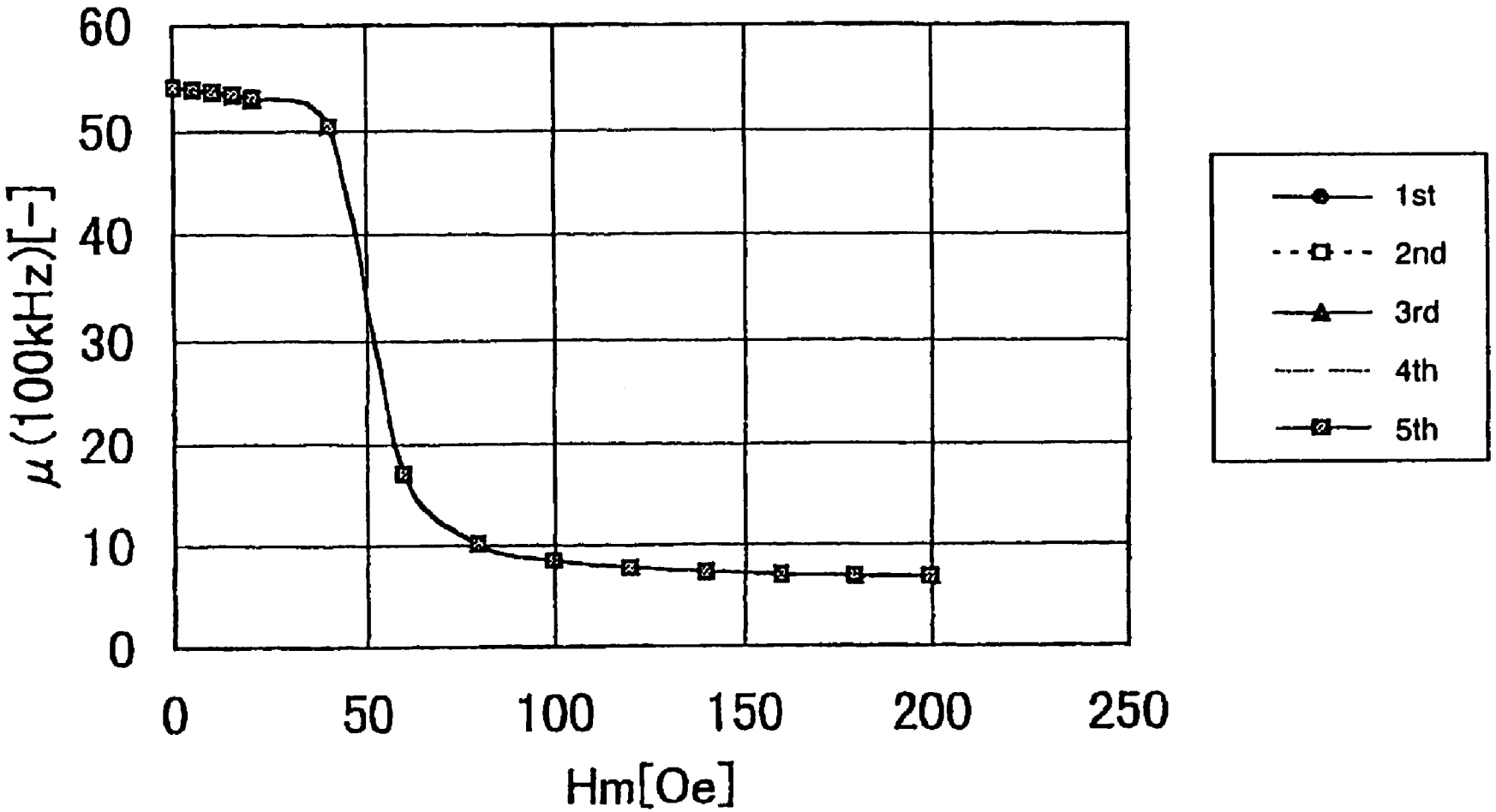
FIG. 22 graphically shows measured data of a variation of a DC superposition characteristic (magnetic permeability $\mu$) to different measuring time numbers of a magnetic core using no magnetically biasing magnet in a magnetic gap in Example 11.

Magnetic powder:
- S-1: $Sm_2Fe_{17}N_3$
  - Average particle size: 3.0 $\mu$m
  - Intrinsic coercive force iHc: 10 kOe
  - Curie point Tc: 470° C.
  - Amount: 100 wt. parts
- S-2: $Sm_2Fe_{17}N_3$
  - Average particle size: 5.0 $\mu$m
  - Intrinsic coercive force iHc: 5 kOe
  - Curie point Tc: 470° C.
  - Amount: 100 wt. parts
- S-3: Ba ferrite
  - Average particle size: 1.0 $\mu$m
  - Intrinsic coercive force iHc: 4 kOe
  - Curie point Tc: 450° C.
  - Amount: 100 wt. parts Binder:
- S-1: Polypropylene resin
  - Resin content: 40 volume parts
- S-2: 12-nylone resin
  - Resin content: 40 volume parts
- S-3: 12-nylone resin
  - Resin content: 40 volume parts Production method of Magnet: Molding, without aligning magnetic field Magnet: Thickness: 0.5 mm
- Shape and area: corresponding to the section of a middle leg of the E-shape core
- Specific resistance:
  - S-1: 10Ω·cm
  - S-2: 5Ω·cm
  - S-3: $10^4$Ω·cm or more
- Intrinsic coercive force:
  - S-1, S-2: 5 kOe or more
  - S-3: 4 kOe or less
- Magnetization: Pulse magnetization machine
- Magnetizing Field 4 T Magnetic core: E-E core (FIG. 1), MnZn ferrite
- Magnetic gap length G: 0.5 mm Measurement of DC superposition characteristics (magnetic permeability):
- Measured at f=100 kHz, Hm=0 to 200 Oe varied Using each of samples S-1 to S-3 in the same magnetic core, DC superposition characteristic was measured five times, and the results are shown in FIGS. 19–21. As a comparative test, the DC superposition characteristic without any biasing magnet in the magnetic gap was measured and the result is shown in FIG. 22.

It is noted from FIG. 21 that, in the magnetic core with a magnet of sample S-3 disposed therein which contain Ba ferrite magnetic powder having a coercive force of only 4 kOe dispersed in the 12-nylone resin, the DC superposition characteristic was significantly degraded as the measuring time number was increased. On the contrary, it is noted that in the use of magnets of samples S-1 and S-2 where $Sm_2Fe_{17}N_3$ magnetic powder having coercive force of 10 kOe and 5 kOe dispersed in polypropylene resin and 12-nylone resin, respectively, the characteristics do not significantly change by measurement repeated as shown in FIGS. 19 and 20, respectively, and were very stable.

It is considered from the results that the Ba ferrite magnet is small in the coercive force and therefore demagnetized or magnetized in opposite direction by a magnetic field applied to the magnet in the opposite direction, so that the DC superposition characteristics was degraded. It was also seen that an excellent DC superposition characteristic can be obtained by use of a permanent magnet having coercive force of 5 kOe or more as the biasing magnet disposed in the magnetic gap.

EXAMPLE 12

Relation Between Particle Size of Magnetic Powder and Core-loss

Magnetic powder: $Sm_2Co_{17}$
- Curie point Tc: 810° C.
- S-1: Average particle size: 1.0 $\mu$m
  - Coercive force: 5 kOe
- S-2: Average particle size: 2.0 $\mu$m
  - Coercive force: 8 kOe
- S-3: Average particle size: 25 $\mu$m
  - Coercive force: 10 kOe
- S-4: Average particle size: 50 $\mu$m
  - Coercive force: 11 kOe S-5: Average particle size: 55 μm
Coercive force: 11 kOe
Binder: 6-nylone resin
Resin content: 30 volume %
Production method of Magnet: Molding, without aligning magnetic field
Magnet: Thickness: 0.5 mm
Shape and Area: corresponding to the section of a middle leg of the E-shape core
Specific resistance:
S-1: 0.05Ω·cm
S-2: 2.5Ω·cm
S-3: 1.5Ω·cm
S-4: 1.0Ω·cm
S-5: 0.5Ω·cm
Intrinsic coercive force: Same as magnetic powder
Magnetization: Pulse magnetizing machine
Magnetizing Field 4 T
Magnetic core: E-E core (FIG. 1), MnZn ferrite
Magnetic gap length G: 0.5 mm
Core-loss: Measured at f=300 kHz, Ha=0.1 T
The core-loss measured in each sample is shown in Table 5.

TABLE 5

| | Sample | | | | |
|---|---|---|---|---|---|
| | S-1 | S-2 | S-3 | S-4 | S-5 |
| Particle size (μm) | 1.0 | 2.0 | 25 | 50 | 55 |
| Core-loss (kW/m$^3$) | 690 | 540 | 550 | 565 | 820 |

It is seen from Table 5 that an excellent core-loss characteristics can be obtained by use of a magnet containing a magnetic powder having an average particle size of 2.0–50 μm as a biasing permanent magnet.

EXAMPLE 13

Relation Between Gloss and Flux (Surface Magnetic Flu)

Magnetic powder: $Sm_2Fe_{17}N_3$
Average particle size: 3 μm
Coercive force iHc: 10 kOe
Curie point Tc: 470° C.
Binder: 12-nylone resin
Resin content: 35 volume %
Production method of Magnet: Molding, without aligning magnetic field
Magnetization: Pulse magnetizing machine
Magnetizing field 4 T
Magnet: Size: 1 cm×1 cm, Thickness: 0.4 mm
Specific resistance: 3Ω·cm
Intrinsic coercive force: 10 kOe
The surface magnetic flux and the gloss were measured in each sample and are shown in Table 6.

TABLE 6

| | | | | | | |
|---|---|---|---|---|---|---|
| Gloss(%) | 12 | 17 | 23 | 26 | 33 | 38 |
| Flux(Gauss) | 37 | 49 | 68 | 100 | 102 | 102 |

It is noted from the results in Table 6 that the thin magnet having a gloss of 25% or more is excellent in the magnetic properties. This is because the thin magnet having a gloss of 25% or more has a packing factor of 90% or more.

The packing factor is defined as a volumetric rate of an alloy in a compact body and is obtained by dividing a weight by a volume of the compact to obtain a density of the compact and then dividing the density by a true density of the alloy to thereby obtain the packing factor.

In this example, a result with respect to a test for one using 12-nylone resin was demonstrated. However it was also confirmed that similar results were obtained in use of other resin such as polyethylene resin, polypropylene resin, and 6-nylone resin.

EXAMPLE 14

Relation of Gloss and Flux with Compressibility

Magnetic powder: $Sm_2Fe_{17}N_3$
Average particle size: 5 μm
Coercive force iHc: 5 kOe
Curie point Tc: 470° C.
Binder: polyimide resin
Resin content: 40 volume %
Production method of Magnet: Doctor blade method, without aligning magnetic field, hot-pressing after drying
Magnetization: Pulse magnetizing machine
Magnetizing field 4 T
Magnet: Size: 1 cm×1 cm, Thickness: 500 μm
Specific resistance: 50Ω·cm
Intrinsic coercive force: same as magnetic powder
Varying pressures in the hot pressing, samples were produced which have different compressibility ratios in a range of 0 to 22(%). The compressibility ratio by the hot pressing is defined as compressibility ratio=1−(thickness after hot-pressed)/thickness before hot-pressing).
The gloss and the surface magnetic flux were measured for each of samples. The results are shown in Table 7.

TABLE 7

| | | | | | | |
|---|---|---|---|---|---|---|
| Gloss(%) | 8 | 17 | 22 | 25 | 29 | 40 |
| Flux(Gauss) | 33 | 38 | 49 | 99 | 100 | 101 |
| Compressibility ratio(%) | 0 | 5 | 13 | 20 | 21 | 22 |

It is noted from the results in Table 7 that the excellent magnetic properties are obtained in a gloss of 25% or more. This is because the thin magnet having a gloss of 25% or more has a packing factor of 90% or more. With respect to compressibility ratio, excellent magnetic properties are also obtained when the compressibility is 20% or more. This is because the thin magnet having a compressibility ratio of 20% or more has a packing factor of 90% or more.

In this example, results with respect to a test for one using polyethylene resin in the contents and composition described above were demonstrated. However it was also confirmed that similar results were obtained under different contents and in use of other resin such as polypropylene resin, and nylon resin.

EXAMPLE 15

Relation Between Addition of Surfactant and Core-loss

Magnetic powder: $Sm_2Fe_{17}N_3$
Average particle size: 2.5 μm
Coercive force iHc: 12 kOe
Curie point Tc: 470° C.

Additives: Surfactant:
S-1: sodium phosphate 0.3 wt %
S-2: carboxymethyl cellulose sodium 0.3 wt %
S-3: sodium silicate 0.3 wt %
Binder: polypropylene resin
Resin content (volume %): 35 volume %
Production method of Magnet: Molding, without aligning magnetic field
Magnet: Thickness: 0.5 mm
Shape and Area: corresponding to the section of a middle leg of E-shape core
Specific resistance: 10Ω·cm in all of S-1, S-2 and S-3
Intrinsic coercive force: same as the magnetic powder
Magnetization: Pulse magnetizing machine
Magnetizing field 4 T
Magnetic core: E-E core (FIG. 1), MnZn ferrite
Magnetic gap length G: 0.5 mm
Core-loss: Measured at f=300 kHz, Ha=0.1 T As a comparative sample (S-4), a magnet was prepared which is different in an average particle size of the magnetic powder of 5.0 μm and in non use of surfactant, and its core-loss was measured in the similar manner.

The core-loss data measured are shown in Table 8.

TABLE 8

| | Surfactant | Core-loss ($kW/m^3$) |
|---|---|---|
| S-1 | sodium phosphate | 480 |
| S-2 | carboxymethyl cellulose sodium | 500 |
| S-3 | sodium silicate | 495 |
| S-4 | Non | 590 |

It is seen from Table 8 that the samples containing surfactant exhibit an excellent core-loss characteristics. This is because the addition of the surfactant prevents primary particles from aggregating to thereby restrict eddy current loss. This example demonstrated results of a test using phosphates. It was confirmed that excellent core-loss could also be obtained by use of other surfactants.

EXAMPLE 16

Relation Between Specific Resistance and Core-loss

Magnetic powder: $Sm_2Fe_{17}N_3$
Average particle size: 5 μm
Intrinsic coercive force iHc: 5.0 kOe
Curie point Tc: 470° C.
Binder: polypropylene resin
Resin content: adjusted
Production method of Magnet: Molding, without aligning magnetic field
Magnet: Thickness: 0.5 mm
Shape and Area: corresponding to the section of a middle leg of E-shape core
Specific resistance (Ω·cm):
S-1: 0.05
S-2: 0.1
S-3: 0.2
S-4: 0.5
S-5: 1.0
Intrinsic coercive force: 5.0 kOe
Magnetization: Pulse magnetization machine
Magnetizing Field 4 T
Magnetic core: E-E core (FIG. 1), MnZn ferrite
Magnetic gap length G: 0.5 mm
Core-loss: Measured at f=300 kHz, Ha=0.1 T The core-loss measured is shown in Table 9.

TABLE 9

| | sample | | | | |
|---|---|---|---|---|---|
| | S-1 | S-2 | S-3 | S-4 | S-5 |
| Specific resistance (Ω · cm) | 0.05 | 0.1 | 0.2 | 0.5 | 1.0 |
| Core-loss ($kW/m^3$) | 1180 | 545 | 540 | 530 | 525 |

It is seen from Table 9 that, in a specific resistance of 0.1Ω·cm or more, the magnetic core exhibits an excellent core-loss. This is because the eddy current loss can be restricted by increase of specific resistance of the thin plate magnet.

Next, description will be made as to an inductance part to be subjected to the reflow soldering treatment and a biasing magnet used therein.

EXAMPLE 17

Relation Between Kind of Magnet Powder and DC Superposition Characteristics

Magnetic powder:
S-1: $Nd_2Fe_{14}B_3$
Average particle size: 3–3.5 μm
Coercive force iHc: 9 kOe
Curie point Tc: 310° C.
S-2: $Sm_2Fe_{17}N_3$
Average particle size: 3–3.5 μm
Coercive force iHc: 8.8 kOe
Curie point Tc: 470° C.
S-3: $Sm_2Co_{17}$
Average particle size: 3–3.5 μm
Intrinsic coercive force iHc: 17 kOe
Curie point Tc: 810° C.
Binder: Polyimide resin (softening point: 300° C.)
Resin content: 50 volume %
Production method of Magnet: Molding, without aligning magnetic field
Magnet: Thickness: 1.5 mm
Shape and area: corresponding to the section of a middle leg of the E-shape core
Specific resistance (Ω·cm): 10–30
Intrinsic coercive force (iHc):
S-1: 9 kOe
S-2: 8.8 kOe
S-3: 17 kOe
Magnetization: Pulse magnetization machine
Magnetizing field 4 T
Magnetic core: E-E core (FIG. 1); MnZn ferrite
Magnetic gap length G: 1.5 mm
Measurement of DC superposition characteristics (magnetic permeability): Measured at f=100 kHz, Hm=0 to 200 Oe varied With respect to a test core sample where each of the samples magnets was disposed in the magnetic gap of the same core, DC superposition characteristics were measured before and after a treatment where the test core sample was kept for one hour in a high temperature container at a temperature of 270° C. which is a temperature condition for a reflow soldering furnace, then cooled to the room temperature and left at the room temperature for two hours. A comparative test core sample without nothing disposed in the magnetic gap was prepared and subjected to the measurement of the DC superposition characteristic in the similar manner as described above. The measured results are shown in FIG. 23.

Figure 23:
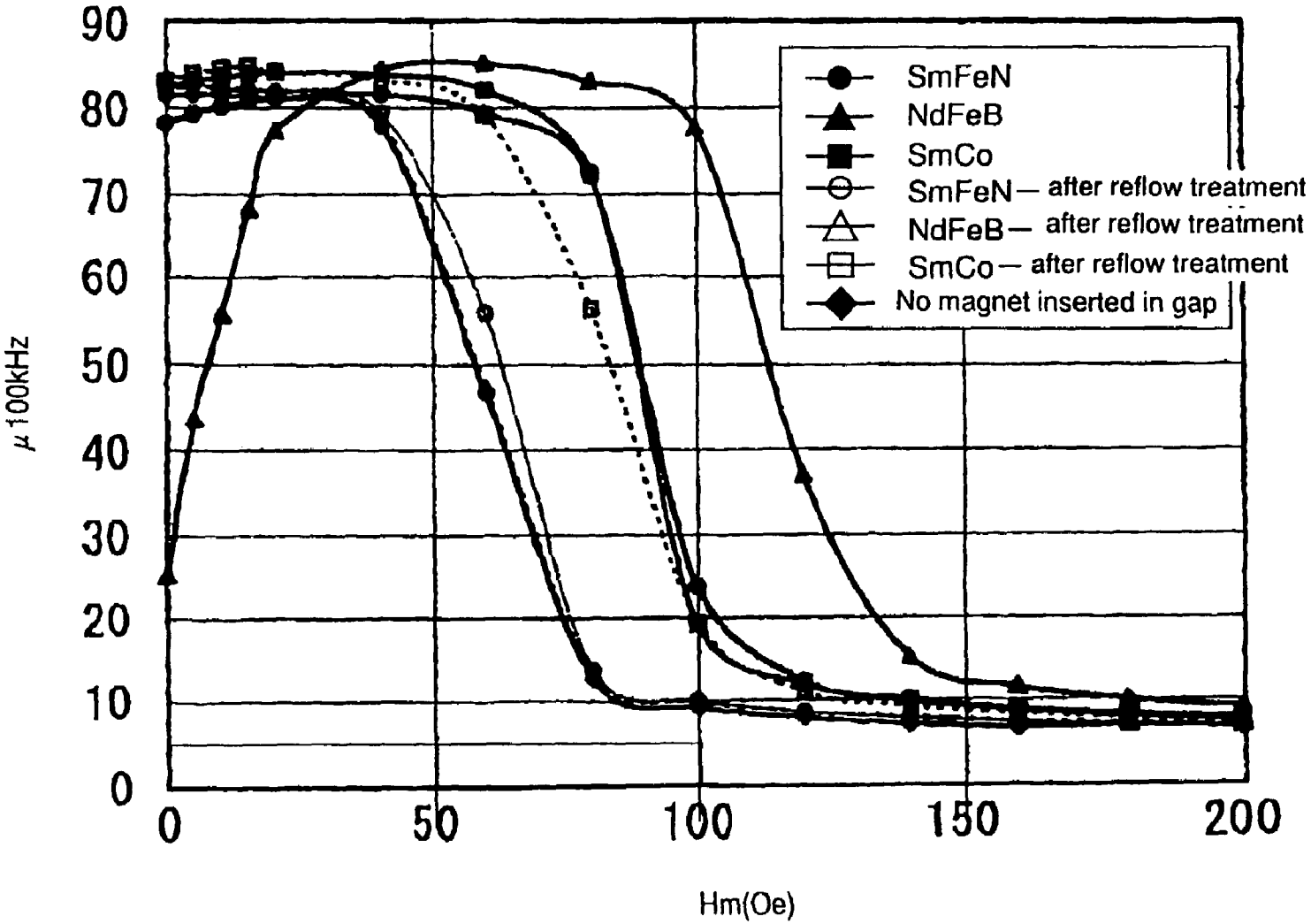
FIG. 23 graphically shows measured data of a variation of a DC superposition characteristic (magnetic permeability $\mu$) before and after a reflow soldering treatment of a magnetic core using, as a magnetically biasing magnet disposed in a magnetic gap, each of sample magnets (S-1 to S-3) in Example 17.

It is noted from FIG. 23 that the DC superposition characteristic before the reflow treatment is extended in the all core samples with the sample magnets inserted in the magnetic gap higher than the comparative test core sample without insertion. However, the DC superposition characteristic after the reflow treatment was degraded in the test samples using $Nd_2Fe_{14}B$ bond magnet and $Sm_2Fe_{17}N_3$ bond magnet inserted, respectively, and did not become superior to the comparative sample with nothing inserted. Further, it is also noted that, in the core sample using the bond magnet of $Sm_2Co_{17}$ having a high Tc, the superiority is maintained even after the reflow treatment.

EXAMPLE 18

Relation Between Kind of Resin and DC Superpositions Characteristics

Magnetic powder: $Sm_2Co_{17}$
- Average particle size: 3–3.5 μm
- Curie point Tc: 900° C.
- Intrinsic coercive force (iHc): 17 kOe Binder:
- S-1: Polyethylene resin (softening point: 160° C.)
- S-2: polyimide resin (softening point: 300° C.)
- S-3: epoxy resin (curing point: 100° C.)
- Resin content: 50 volume %

Production method of Magnet: Molding, without aligning magnetic field

Magnet: Thickness: 1.5 mm
- Shape and area: corresponding to the section of a middle leg of E-shape core
- Specific resistance (Ω·cm): 10–30
- Intrinsic coercive force (iHc): (in all of) S-1, S-2 and S-3: 1.7 kOe Magnetization: Pulse magnetization machine
- Magnetizing field: 4 T Magnetic core: E-E core (FIG. 1), MnZn ferrite
- Magnetic gap length G: 1.5 mm DC superposition characteristics (magnetic permeability):
- Measured at f=100 kHz, Hm=0 to 200 Oe With respect to a test core sample where each of the samples magnets was disposed in the magnetic gap of the same core, DC superposition characteristics were measured before and after a heat treatment where the test sample was kept for one hour in a high temperature container at a temperature of 270° C. which is a temperature condition for a reflow soldering furnace, then cooled to the room temperature and left at the room temperature for two hours. The measured results are shown in FIG. 24.

Figure 24:
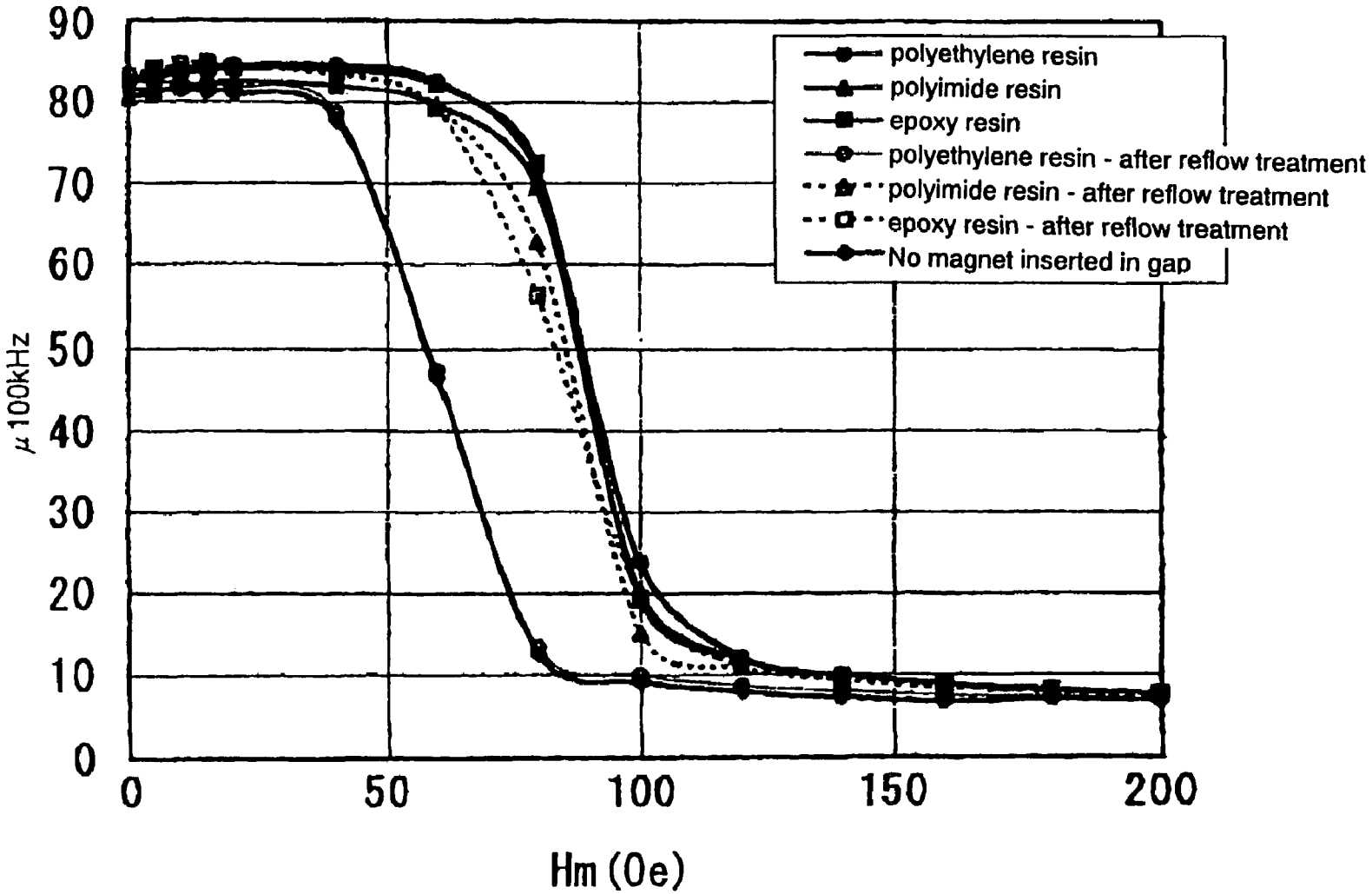
FIG. 24 graphically shows measured data of a variation of a DC superposition characteristic (magnetic permeability $\mu$) before and after a reflow soldering treatment of a magnetic core using, as a magnetically biasing magnet disposed in a magnetic gap, each of sample magnets (S-1 to S-3) containing different binders in Example 18.

It is noted from FIG. 24 that, in the core sample using the bond magnets using polyimide resin with a softening point of 300° C. and epoxy resin as a thermosetting resin having a curing point of 100° C., respectively, the DC superposition characteristic after the reflow treatment is almost similar to those before the reflow treatment.

On the contrary, in the core sample with the bond magnet using poly-ethylene resin having a softening point of 160° C., the resin was softened after the reflow treatment so that the DC superposition characteristic was equivalent with a comparative test sample with nothing inserted in the magnetic gap.

EXAMPLE 19

Relation Between Kind of Magnet (Coercive Force) and DC Superposition Characteristics Magnetic powder:
- S-1: Ba ferrite
  - Average particle size: 3–3.5 μm
  - Curie point Tc: 310° C.
  - Intrinsic coercive force (iHc): 5.0 kOe
- S-2: $Sm_2Fe_{17}N_3$
  - Average particle size: 3–3.5 μm
  - Curie point Tc: 470° C.
  - Intrinsic coercive force (iHc): 8.0 kOe
- S-3: $SM_2Co_{17}$
  - Average particle size: 3–3.5 μm
  - Curie point Tc: 810° C.
  - Intrinsic coercive force (iHc): 17.0 kOe Binder: Polyimide resin (Softening point 300° C.)
- Resin content: 50 volume %

Production method of Magnet: Molding, without aligning magnetic field

Magnet: Thickness: 1.5 mm
- Shape and area: corresponding to the section of a middle leg of the E-shape core
- Specific resistance (Ω·cm): 10–30
- Intrinsic coercive force (iHc): Same as magnetic powder Magnetization: Pulse magnetization machine
- Magnetizing field 4 T Magnetic core: E-E core (FIG. 1), MnZn ferrite
- Magnetic gap length G: 1.5 mm DC superposition characteristics (magnetic permeability):
- Measured at f=100 kHz, Hm=0 to 150 (Oe) varied With respect to a test core sample where each of the samples magnets was disposed in the magnetic gap of the same core, DC superposition characteristics were measured before and after a reflow treatment where the test sample was kept for one hour in a high temperature container at a temperature of 270° C. which is a temperature condition for a reflow soldering furnace, then cooled to the room temperature and left at the room temperature for two hours. A comparative test sample without nothing disposed in a magnetic gap was prepared and subjected to the measurement of the DC superposition characteristic in the similar manner as described above. The measured results are shown in FIG. 25.

Figure 25:
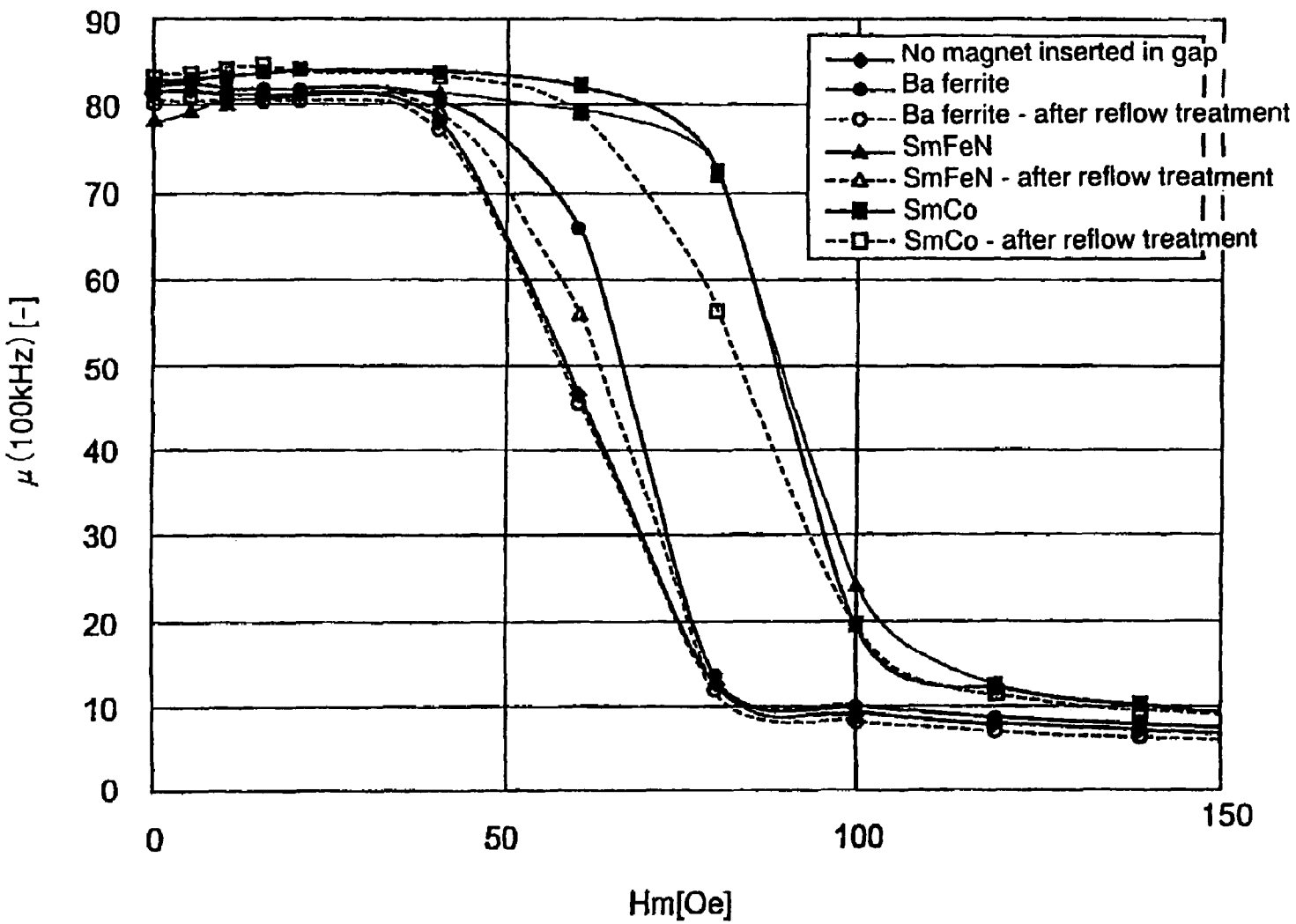
FIG. 25 graphically shows measured data of a variation of a DC superposition characteristic (magnetic permeability $\mu$) before and after a reflow soldering treatment of a magnetic core using, as a magnetically biasing magnet disposed in a magnetic gap, each of sample magnets (S-1 to S-3) in Example 19.

It is noted from FIG. 25 that the DC superposition characteristic before the reflow treatment is excellent in the all test samples with the magnetically biasing permanent magnets inserted in the magnetic gap in comparison with the comparative test sample without use of the magnetically biasing permanent magnet.

On the other hand, the DC superposition characteristic after the reflow treatment was degraded in the test samples using Ba ferrite bond magnet and $Sm_2Fe_{17}N_3$ bond magnet, respectively, both of which are low in Hc. This is because these permanent magnets are low in the intrinsic coercive force iHc and therefore easily thermally demagnetized. Further, it is also noted that, in use of the bond magnet of $Sm_2Co_{17}$ having a high intrinsic coercive force iHc, the superiority is excellent comparing with other samples, even after the reflow treatment.

EXAMPLE 20

Relation Between Kind of Magnet (Curie Point) and DC Superposition Characteristics Magnetic powder:
S-1: $Nd_2Fe_{14}B$
Average particle size: 3–3.5 μm
Curie point Tc: 310° C.
Intrinsic coercive force (iHc): 9 kOe
S-2: $Sm_2Fe_{17}N_3$
Average particle size: 3–3.5 μm
Curie point Tc: 470° C.
Intrinsic coercive force (iHc): 8.8 kOe
S-3: $Sm_2Co_{17}$
Average particle size: 3–3.5 μm
Curie point Tc: 810° C.
Intrinsic coercive force (iHc): 17 kOe
Binder: Polyimide resin (Softening point 300° C.)
Resin content: 50 volume %
Production method of Magnet: Molding, without aligning magnetic field
Magnet: Thickness: 1.5 mm
Shape and area: corresponding to the section of a middle leg of the E-shape core
Specific resistance (Ω·cm): 10–30 (in all samples)
Intrinsic coercive force (iHc): Same as magnetic powder
Magnetization: Pulse magnetization machine
Magnetizing field 4 T
Magnetic core: E-E core (FIG. 1), MnZn ferrite
Magnetic gap length G: 1.5 mm
DC superposition characteristics (magnetic permeability):
Measured at f=100 kHz, Hm=0 to 150 Oe varied With respect to a test core sample where each of the samples magnets was disposed in the magnetic gap of the same core, DC superposition characteristics were measured before and after a reflow treatment where the test sample was kept for one hour in a high temperature container at a temperature of 270° C. which is a temperature condition for a reflow soldering furnace, then cooled to the room temperature and left at the room temperature for two hours. A comparative test sample without nothing disposed in a magnetic gap was prepared and subjected to the measurement of the DC superposition characteristic in the similar manner as described above. The measured results are shown in FIG. 26.

Figure 26:
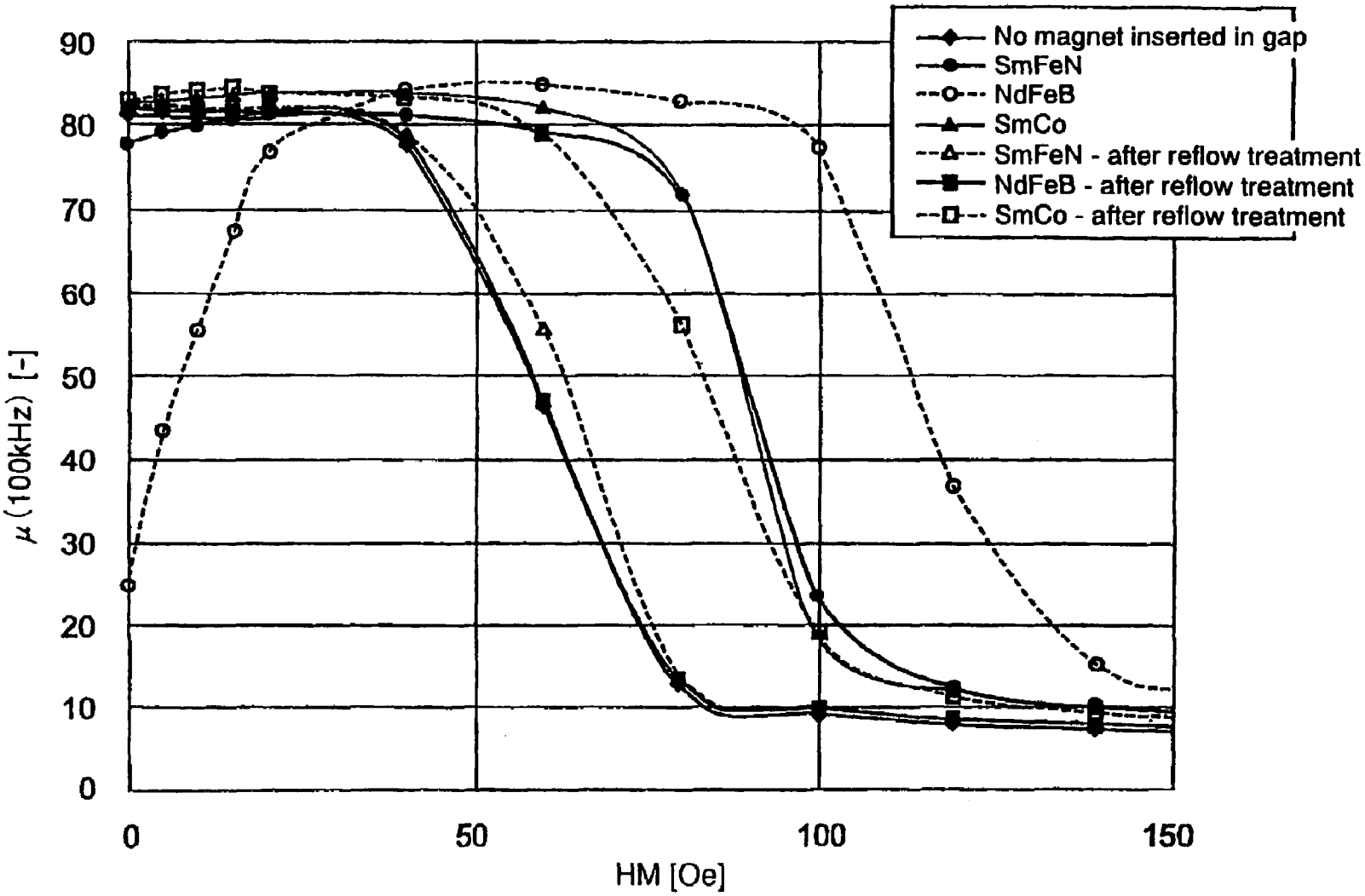
FIG. 26 graphically shows measured data of a variation of a DC superposition characteristic (magnetic permeability $\mu$) before and after a reflow soldering treatment of a magnetic core using, as a magnetically biasing magnet disposed in a magnetic gap, each of sample magnets (S-1 to S-3) in Example 20.

It is noted from FIG. 26 that the DC superposition characteristic before the reflow treatment is excellent in the all test samples with the magnetically biasing permanent magnets inserted in the magnetic gap in comparison with the comparative test sample without use of the magnetically biasing permanent magnet.

On the other hand, the DC superposition characteristic after the reflow treatment was degraded in the test samples using $Ns_2Fe_{17}B$ ferrite bond magnet and $Sm_2Fe_{17}N_3$ bond magnet, respectively, both of which are relatively low in the Curie point, so that there is no superiority to the comparative test core sample with nothing inserted. Further, it is also noted that, in the test core sample using the bond magnet of $Sm_2Co_{17}$ having a high Curie point Tc, the superiority is maintained even after the reflow treatment.

EXAMPLE 21

Relation Between Particle Size of Magnetic Powder and Core-loss

Magnetic powder: $Sm_2Co_{17}$
Average particle size (μm):
S-1: 150
S-2: 100
S-3: 50
S-4: 10
S-5: 5.6
S-6: 3.3
S-7: 2.4
S-8: 1.8
Binder: epoxy resin
Resin content: 50 volume %
Production method of Magnet: Molding, without aligning magnetic field
Magnet: Thickness: 0.5 mm
Shape and Area: corresponding to the section of a middle leg of the E-shape core
Specific resistance: 0.01–100Ω·cm (by adjusting resin content)
Intrinsic coercive force: see Table 10
Magnetization: Pulse magnetizing machine
Magnetizing field 4 T
Magnetic core: E-E core (FIGS. 1 and 2), MnZn ferrite
Magnetic gap length G: 0.5 mm Using the same core for each of the samples, the core-losses were measured at f=300 kHz, Hm=1000 G. The measured data are shown in Table 11.

TABLE 10

| | Sample | | | | | | | |
|---|---|---|---|---|---|---|---|---|
| | S-1 | S-2 | S-3 | S-4 | S-5 | S-6 | S-7 | S-8 |
| Average particle size | 150 μm | 100 μm | 50 μm | 10 μm | 5.6 μm | 3.3 μm | 2.5 μm | 1.8 μm |
| Br (kG) | 3.5 | 3.4 | 3.3 | 3.1 | 3.0 | 2.8 | 2.4 | 2.2 |
| Hc (kOe) | 25.6 | 24.5 | 23.2 | 21.5 | 19.3 | 16.4 | 12.5 | 9.5 |

TABLE 11

| | | Sample | | | | | | | |
|---|---|---|---|---|---|---|---|---|---|
| | | S-1 | S-2 | S-3 | S-4 | S-5 | S-6 | S-7 | S-8 |
| Particle size | No magnet | 150 μm | 100 μm | 50 μm | 10 μm | 5.6 μm | 3.3 μm | 2.4 μm | 1.8 μm |
| Core-loss (kW/m$^3$) | 520 | 1280 | 760 | 570 | 560 | 555 | 550 | 520 | 520 |

Figure 27:
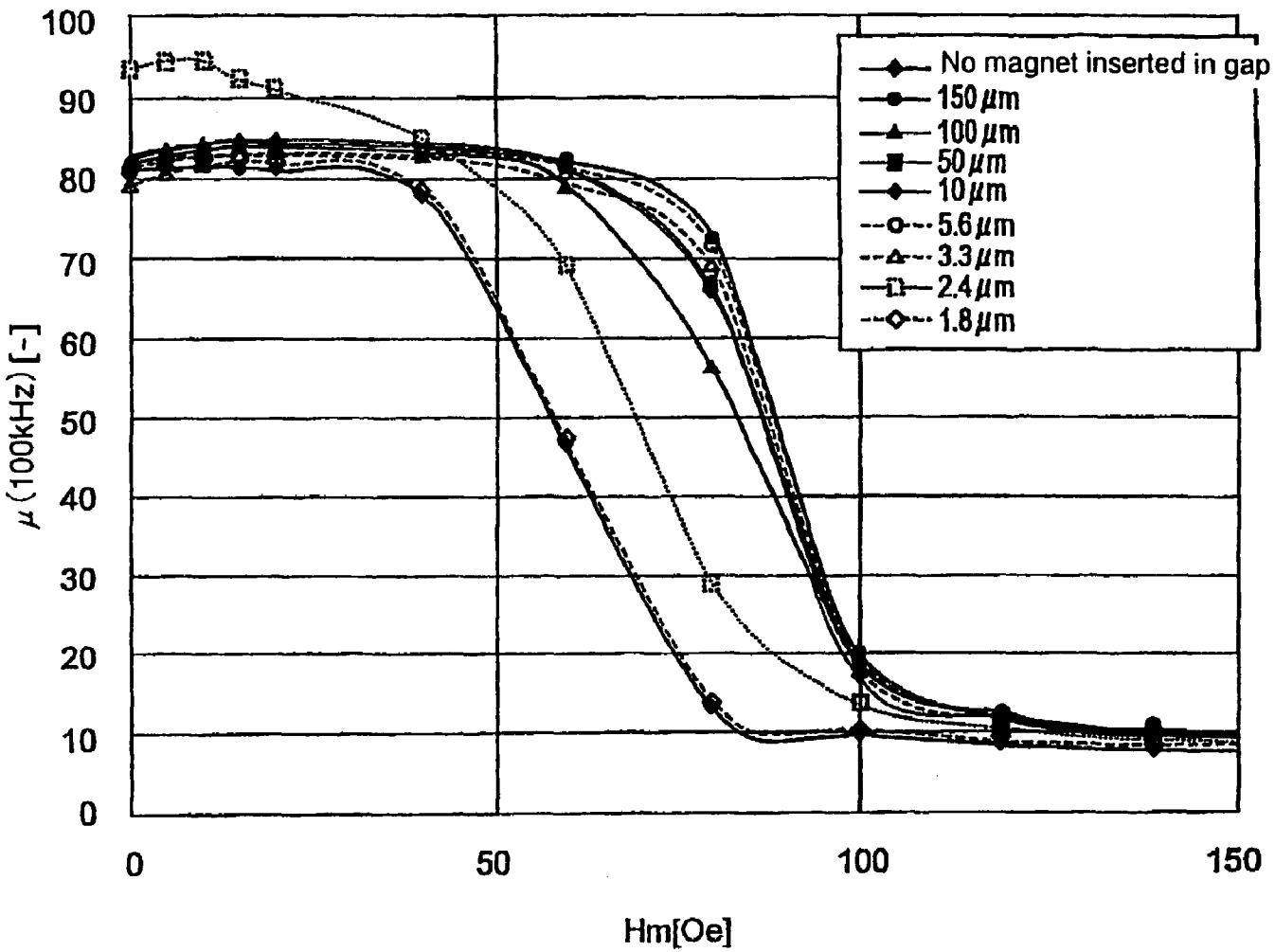
FIG. 27 graphically shows measured data of a variation of a DC superposition characteristic (magnetic permeability $\mu$) before and after a reflow soldering treatment of a magnetic core using, as a magnetically biasing magnet disposed in a magnetic gap, each of sample magnets (S-1 to S-8) using the magnetic powder different from each other in the average particle size in Example 21.

With respect to a test core sample where each of the samples magnets was disposed in the magnetic gap of the same core, DC superposition characteristics were measured before and after a reflow treatment where the test core sample was kept for one hour in a high temperature container at a temperature of 270° C. which is a temperature condition for a reflow soldering furnace, then cooled to the room temperature and left at the room temperature for two hours. A comparative test sample without nothing disposed in a magnetic gap was prepared and subjected to the measurement of the DC superposition characteristic in the similar manner as described above. The measured results are shown in FIG. 27.

It is seen from Table 11 that the core loss rapidly increases when the maximum value of the average particle size of magnetic powder exceeds 50 μm. It is also seen form FIG. 27 that the DC superposition characteristic is degraded when the particle size of the magnetic powder is smaller than 2.5 μm. Accordingly, it is noted that, by use of a magnet containing a magnetic powder having an average particle size of 2.5–50 μm as a biasing permanent magnet, the magnetic core can be obtained which is excellent in the DC superposition characteristic even after reflow treatment and not degraded in the core-loss characteristics.

EXAMPLE 22

Relation Between Specific Resistance and Core-loss

Magnetic powder: $Sm_2Co_{17}$
- Average particle size: 3 μm
- Intrinsic coercive force iHc: 17 kOe
- Curie point Tc: 810° C.

Binder: Epoxy resin
- Resin content (Volume %):
  - Adjusted to obtain following specific resistances Production method of Magnet: Molding, without aligning magnetic field Magnet: Thickness T: 1.5 mm
- Shape and Area: corresponding to the section of a middle leg of E-shape core
- Specific resistance (Ω·cm):
  - S-1: 0.01
  - S-2: 0.1
  - S-3: 1
  - S-4: 10
  - S-5: 100
- Intrinsic coercive force: 5 kOe or more Magnetization: Pulse magnetizing machine Magnetizing field 4 T Magnetic core: E-E core (FIGS. 1 and 2), MnZn ferrite
- Magnetic gap length G: 1.5 mm Core-loss: Measured at f=300 kHz, Ha=1000 G The same magnetic core is used for each of samples and the core-loss measured in each sample is shown in Table 12.

TABLE 12

| | | Sample | | | | |
|---|---|---|---|---|---|---|
| | | S-1 | S-2 | S-3 | S-4 | S-5 |
| Specific resistance (Ω · cm) | No magnet (only gap) | 0.01 | 0.1 | 1 | 10 | 100 |
| Core-loss ($kW/m^3$) | 520 | 2,100 | 1,530 | 590 | 560 | 530 |

It is seen from Table 12 that the core-loss rapidly degrades when the specific resistance is below 1Ω·cm. Therefore, it is noted that when the DC magnetic-bias permanent magnet has the specific resistance of 1Ω·cm or more, the magnetic core can be obtained which is small in degradation of the core-loss and excellent in DC superposition characteristics.

EXAMPLE 23

Relation Between Kind of Magnet (Coercive Force) and DC Superposition Characteristics Magnetic powder:
- S-1: $Sm(Co_{0.78}Fe_{0.11}Cu_{0.10}Zr_{0.01})_{7.4}$ (second generation Sm—Co magnet)
  - Average particle size: 5 μm
  - Curie point Tc: 820° C.
  - Intrinsic coercive force (iHc): 8 kOe
- S-2: $Sm(Co_{0.742}Fe_{0.20}Cu_{0.055}Zr_{0.03})_{7.5}$ (third generation Sm—Co magnet)
  - Average particle size: 5.0 μm
  - Curie point Tc: 810° C.
  - Intrinsic coercive force (iHc): 20 kOe Binder: Epoxy resin (Curing point 150° C.)
- Resin content: 50 volume %

Production method of Magnet: Molding, without aligning magnetic field

Magnet: Thickness: 0.5 mm
- Shape and area: corresponding to the section of a middle leg of the E-shape core
- Specific resistance (Ω·cm): 1Ω·cm or more in all samples
- Intrinsic coercive force (iHc): Same as magnetic powder Magnetization: Pulse magnetization machine
- Magnetizing field 4 T Magnetic core: E-E core (FIG. 1), MnZn ferrite
- Magnetic gap length G: 0.5 mm DC superposition characteristics (magnetic permeability):
- Measured at f=100 kHz, Hm=0 to 150 (Oe) varied With respect to a test core sample where each of the samples magnets was disposed in the magnetic gap of the same core, DC superposition characteristics were measured before and after a reflow treatment where the core test sample was kept for one hour in a high temperature container at a temperature of 270° C. which is a temperature condition for a reflow soldering furnace, then cooled to the room temperature and left at the room temperature for two hours. A comparative test sample without nothing disposed in a magnetic gap was prepared and subjected to the measurement of the DC superposition characteristic in the similar manner as described above. The measured results are shown in FIG. 28.

Figure 28:
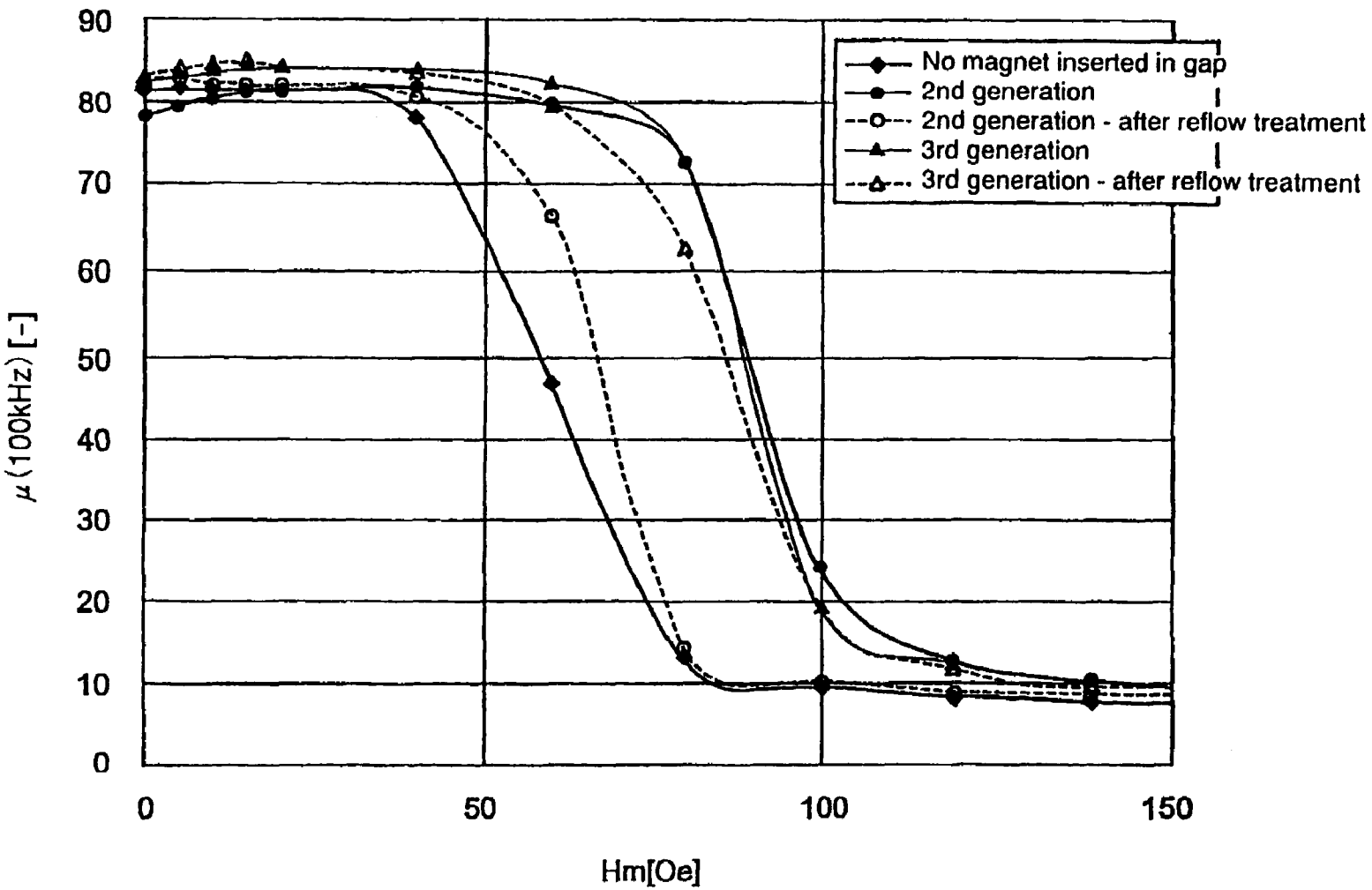
FIG. 28 graphically shows measured data of a variation of a DC superposition characteristic (magnetic permeability $\mu$) before and after a reflow soldering treatment of a magnetic core using, as a magnetically biasing magnet disposed in a magnetic gap, each of sample magnets (S-1 and S-2) using different Sm—Co magnet powders in Example 23.

It is noted from FIG. 28 that the DC superposition characteristic is excellent even after the reflow treatment in use of a bond magnet having the third generation $Sm_2Co_{17}$ magnetic powder of sample S-2 for the magnetically biasing permanent magnet. Accordingly, the bond magnet having the magnetic powder of $Sm(Co_{bal}Fe_{0.15\text{-}0.25}Cu_{0.05\text{-}0.06}Zr_{0.02\text{-}0.03})_{7.0\text{-}8.85}$ can provide an excellent DC superposition characteristics.

EXAMPLE 24

Relation Between Kind of Resin and DC Superposition Characteristics

Magnetic powder:
$Sm_2Co_{17}$
Average particle size: 3.0–3.5 μm
Coercive force iHc: 10 kOe
Curie point Tc: 810° C.
Binder:
S-1: Polyethylene resin (softening point: 160° C.)
Resin content: 50 volume %
S-2: polyimide resin (softening point: 300° C.)
Resin content: 50 volume %
S-3: epoxy resin (curing point: 100° C.)
Resin content: 50 volume %
Production method of Magnet: Molding, without aligning magnetic field
Magnet: Thickness: 0.5 mm
Shape and area: corresponding to the section of a middle leg of the E-shape core
Specific resistance: 10–30 Ω·cm or more
Intrinsic coercive force: same as those of magnetic powder
Magnetization: Pulse magnetization machine
Magnetizing field 4 T
Magnetic core: E-E core (FIG. 1), MnZn ferrite
Magnetic gap length G: 0.5 mm
DC superposition characteristics (magnetic permeability):
Measured at f=100 kHz, Hm=0 to 150 (Oe) varied Measurement of DC superposition characteristic was carried out about the same magnetic core using each of magnet samples containing the resins S-1 to S-3, respectively.

With respect to a test core sample where each of the samples magnets was disposed in the magnetic gap of the same core, DC superposition characteristics were measured before and after a reflow treatment where the test core sample was kept for one hour in a high temperature container at a temperature of 270° C. which is a temperature condition for a reflow soldering furnace, then cooled to the room temperature and left at the room temperature for two hours. A comparative test core sample without nothing disposed in a magnetic gap was prepared and subjected to the measurement of the DC superposition characteristic in the similar manner as described above. The measured results are shown in FIG. 29.

Figure 29:
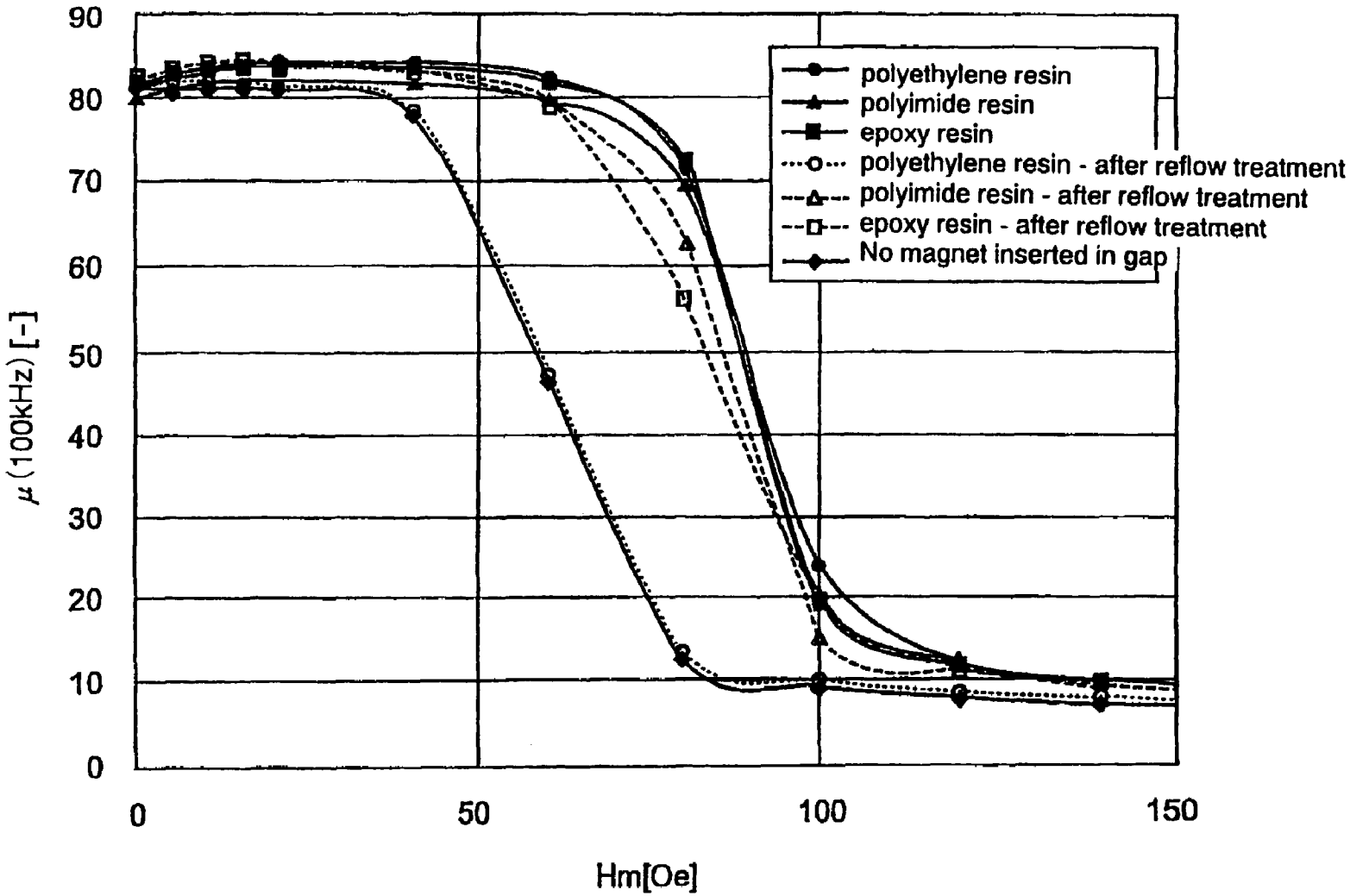
FIG. 29 graphically shows measured data of a variation of a DC superposition characteristic (magnetic permeability $\mu$) before and after a reflow soldering treatment of a magnetic core using, as a magnetically biasing magnet disposed in a magnetic gap, each of sample magnets (S-1 to S-3) using different plastic resins for the binder in Example 24.

It is noted from FIG. 29 that, in the test cores using bond magnets using polyimide resin with a softening point of 300° C. and epoxy resin as a thermosetting resin having a curing point of 100° C., respectively, the DC superposition characteristic after the reflow treatment is almost similar to those before the reflow treatment. On the contrary, in use of polyethylene resin having a softening point of 160° C., the resin was softened so that the DC superposition characteristic was equivalent with a comparative test sample with nothing inserted in the magnetic gap.

EXAMPLE 25

Relation Between Addition of Coupling Agent and Core-loss

Magnetic powder:
$Sm_2Co_{17}$
Average particle size: 3–3.5 μm
Intrinsic coercive force iHc: 17 kOe
Curie point Tc: 810° C.
Coupling agent:
S-1: silane coupling agent 0.5 wt %
S-2: no coupling agent
Binder: epoxy resin
Resin content (volume %): 50 volume %
Production method of Magnet: Molding, without aligning magnetic field
Magnet: Thickness T: 1.5 mm
Shape and Area: corresponding to the section of a middle leg of E-shape core
Specific resistance (Ω·cm): S-1: 10, S-2: 100
Intrinsic coercive force: 17 kOe
Magnetization: Pulse magnetizing machine
Magnetizing field: 4 T
Magnetic core: E-E core (FIGS. 1 and 2), MnZn ferrite
Magnetic gap length G: 1.5 mm
Core-loss: Measured at f=300 kHz and Ha=1000 G The core-loss of the same magnetic core using each of the samples was measured and is shown in Table 13.

TABLE 13

| | Treated by Coupling agent | Non-treated by Coupling agent |
|---|---|---|
| Core-loss ($kW/m^3$) | 525 | 550 |

It is noted from Table 13 that the core-loss is decreased by addition of coupling agent. This is considered due to the reason why the insulation between particles of the powder is improved by the coupling treatment.

Further, there was obtained a result that the DC superposition characteristics after reflow treatment was excellent in use of the bond magnet using the magnetic powder treated by the coupling agent. This is considered due to the reason why oxidation during the reflow treatment was prevented by the coupling treatment. As described above, the good results were realized by the coupling treatment of the magnetic powder.

EXAMPLE 26

Relation Between Anisotropic Magnet and DC Superposition Characteristic

Magnetic powder:
$Sm_2Co_{17}$
Average particle size: 3–3.5 μm
Curie point Tc: 810° C.
Intrinsic coercive force (iHc): 17 kOe
Binder: Epoxy resin (Curing point: about 250° C.)
Resin content: 50 volume %
Production method of Magnet: Molding,
S-1: Aligning magnetic field in thickness direction: 2 T
S-2: Without aligning magnetic field
Magnet: Thickness: 1.5 mm
Shape and Area: corresponding to the section of a middle leg of E-shape core
Specific resistance (Ω·cm): 1Ω·cm
Intrinsic coercive force (iHc): 17 kOe
Magnetization: Pulse magnetizing machine
Magnetizing field 2 T
Magnetic core: E-E core (FIG. 1), MnZn ferrite
Magnetic gap length G: 1.5 mm
DC superposition characteristic (magnetic permeability):
Measured at f=100 kHz and Hm=0–150 (Oe) varied The DC superposition characteristics of the same magnetic core using each of the samples S-1 and S-2, which were aligned and not aligned in the magnetic field, respectively, was measured before and after a reflow treatment where a test core sample was kept for one hour in a high temperature container at a temperature of 270° C. which is a temperature condition for a reflow soldering furnace, then cooled to the room temperature and left at the room temperature for two hours. The results are shown in FIG. 30.

Figure 30:
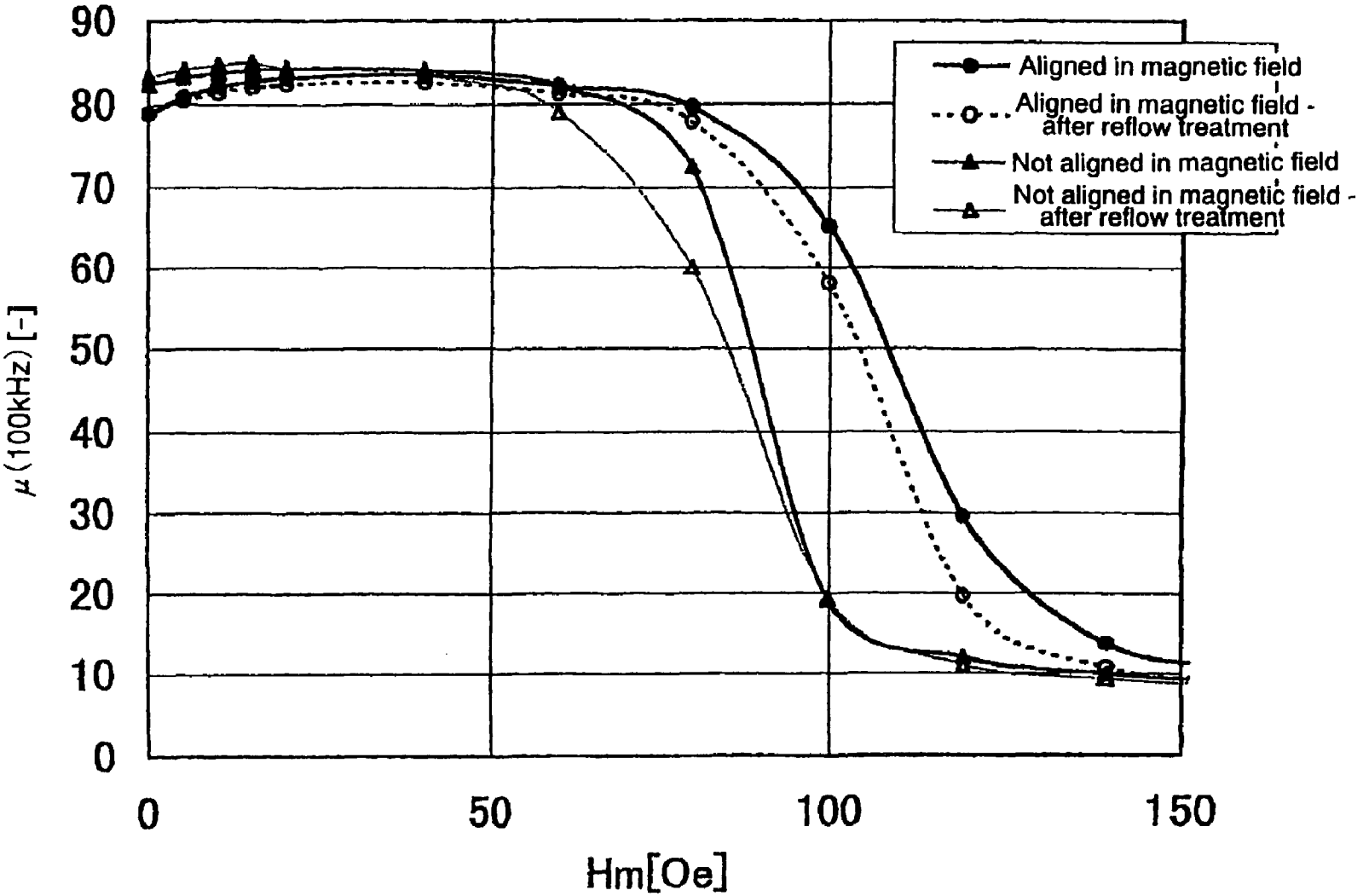
FIG. 30 graphically shows measured data of a variation of a DC superposition characteristic (magnetic permeability $\mu$) before and after a reflow soldering treatment of a magnetic core using, as a magnetically biasing magnet disposed in a magnetic gap, each of samples magnets (S-1 and S-2) which are produced by using and non-using an aligning magnetic field, respectively, in Example 26.

It is seen from FIG. 30 that the anisotropic magnet aligned in the magnetic field provides an excellent DC superposition characteristics before and after the reflow treatment in comparison with the other magnet not aligned in the magnetic field.

EXAMPLE 27

Relation Between Magnetization Field and DC Superposition Characteristic

Magnetic powder: $Sm_2Co_{17}$
- Average particle size: 3–3.5 μm
- Curie point Tc: 810° C.
- Intrinsic coercive force (iHc): 17 kOe Binder: Epoxy resin (Curing point: about 250° C.)
- Resin content: 50 volume %

Production method of Magnet: Molding, without aligning magnetic field

Magnet: Thickness: 1.5 mm
- Shape and Area: corresponding to the section of a middle leg of E-shape core
- Specific resistance (Ω·cm): 1Ω·cm
- Intrinsic coercive force (iHc): 17 kOe Magnetizing field:
- S-1: 1 T (electromagnet)
- S-2: 2 T (electromagnet)
- S-3: 2.5 T (electromagnet)
- S-4: 3 T (pulse magnetizing)
- S-5: 3.5 T (pulse magnetizing)

Magnetic core: E-E core (FIG. 1), MnZn ferrite
- Magnetic gap length G: 1.5 mm DC superposition characteristic (magnetic permeability):
- Measured at f=100 kHz and Hm=0–150 (Oe) varied The DC superposition characteristics of the same magnetic core using each of the samples S-1 to S-5 was measured before and after a reflow treatment where a test core sample was kept for one hour in a high temperature container at a temperature of 270° C. which is a temperature condition for a reflow soldering furnace, then cooled to the room temperature and left at the room temperature for two hours. The results are shown in FIG. 31.

Figure 31:
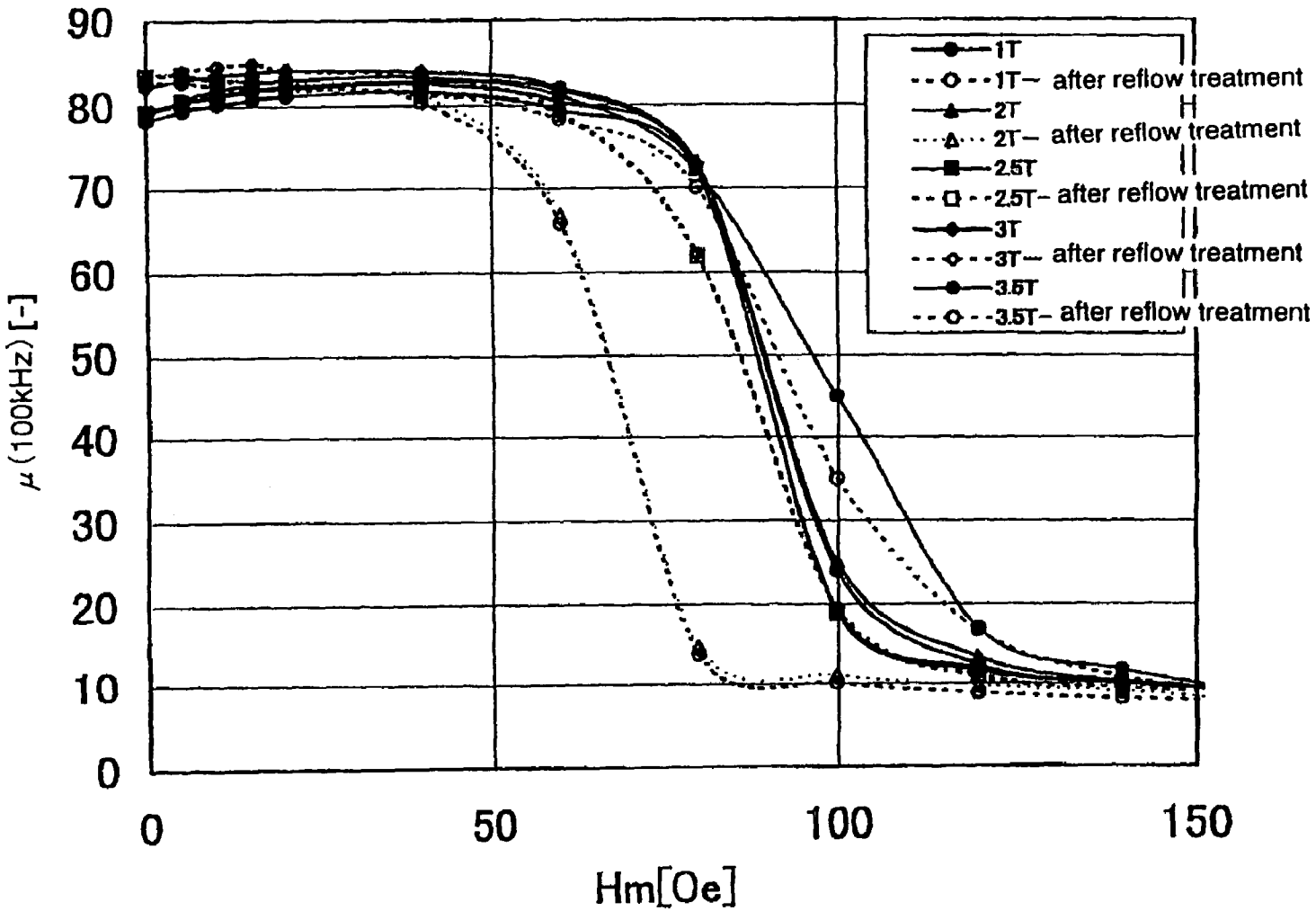
FIG. 31 graphically shows measured data of a variation of a DC superposition characteristic (magnetic permeability $\mu$) before and after a reflow soldering treatment of a magnetic core using, as a magnetically biasing magnet disposed in a magnetic gap, each of samples magnets (S-1 to S-5) magnetized by different magnetic fields in Example 27.

It is seen from FIG. 31 that the good results are obtained in the magnetizing field of 2.5 T (Tesla) or more.

EXAMPLE 28

Relation Between Surface Coating of the Magnet and Magnetic Flux as Well as DC Superposition Characteristics Magnetic powder: $Sm_2Co_{17}$
- Average particle size: 3 μm
- Intrinsic coercive force iHc: 17 kOe
- Curie point Tc: 810° C.

Binder: Epoxy resin
- Resin content: 40 volume %

Production method of Magnet: Molding, without aligning magnetic field

Magnet: Thickness: 1.5 mm
- Shape and Area: corresponding to the section of a middle leg of E-shape core
- Specific resistance: 1Ω·cm
- Intrinsic coercive force: 17 kOe
- Surface coating:
  - S-1: epoxy resin
  - S-2: no coating Magnetization: Pulse magnetizing machine
- Magnetizing field 10 T Magnetic core: E-E core (FIGS. 1 and 2), MnZn ferrite
- Magnetic gap length G: 1.5 mm DC superposition characteristics (magnetic permeability):
- Measured at f=100 kHz and Hm=0–250 Oe varied Dipping a magnet in an epoxy resin solution, taking out and drying it, then heat treating it at a thermosetting temperature of the resin to cure it formed the surface coating.

Figure 33:
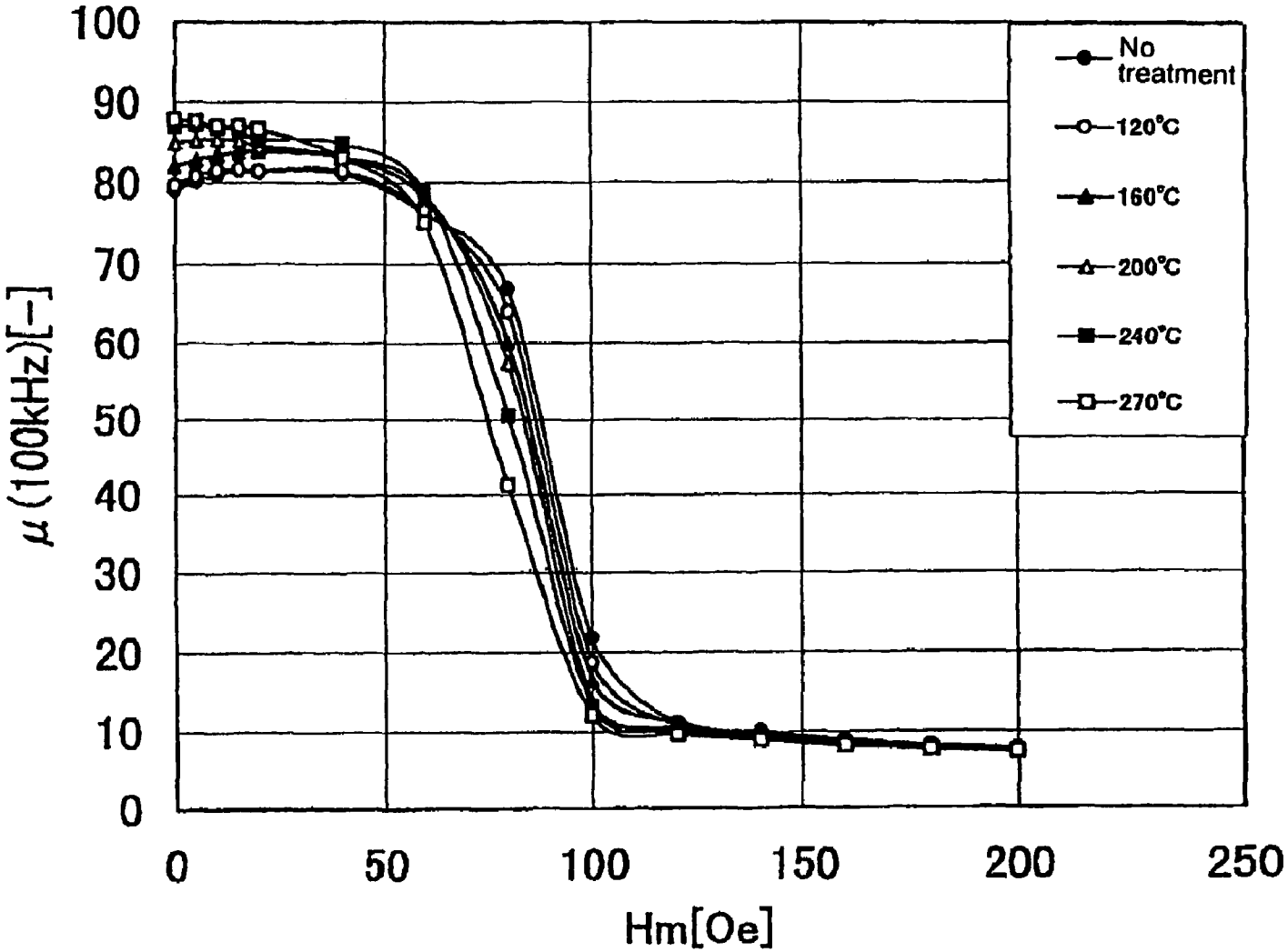
FIG. 33 graphically shows measured data of a variation of a DC superposition characteristic (magnetic permeability $\mu$) of a magnetic core using, as a magnetically biasing magnet disposed in a magnetic gap, the bond magnet (sample S-2) uncovered with a plastic coating in Example 28, when the core is heat treated at different temperatures.
Figure 34:
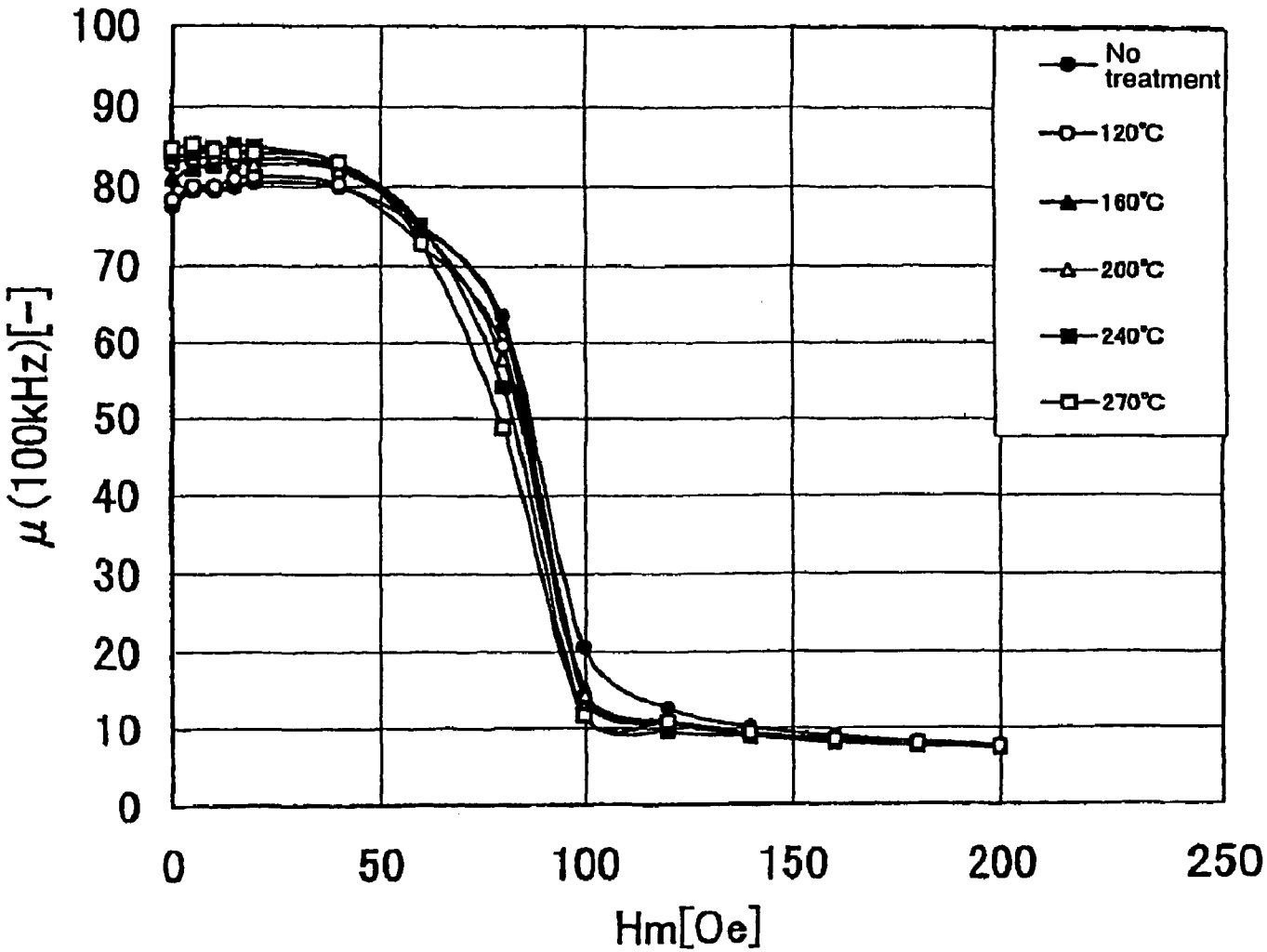
FIG. 34 graphically shows measured data of a variation of a DC superposition characteristic (magnetic permeability $\mu$) of a magnetic core using, as a magnetically biasing magnet disposed in a magnetic gap, the bond magnet (sample S-1) covered with an epoxy coating in Example 28, when the core is heat treated at different temperatures.

Each of sample S-1 and comparative sample S-2 was heat-treated for 30 minutes at a temperature every 40° C. increment from 120° C. to 270° C. It was taken out from a furnace just after every heat-treatment and was subjected to measurement of a surface magnetic flux and a DC superposition characteristic. The measured results are shown in FIGS. 32–34.

Figure 32:
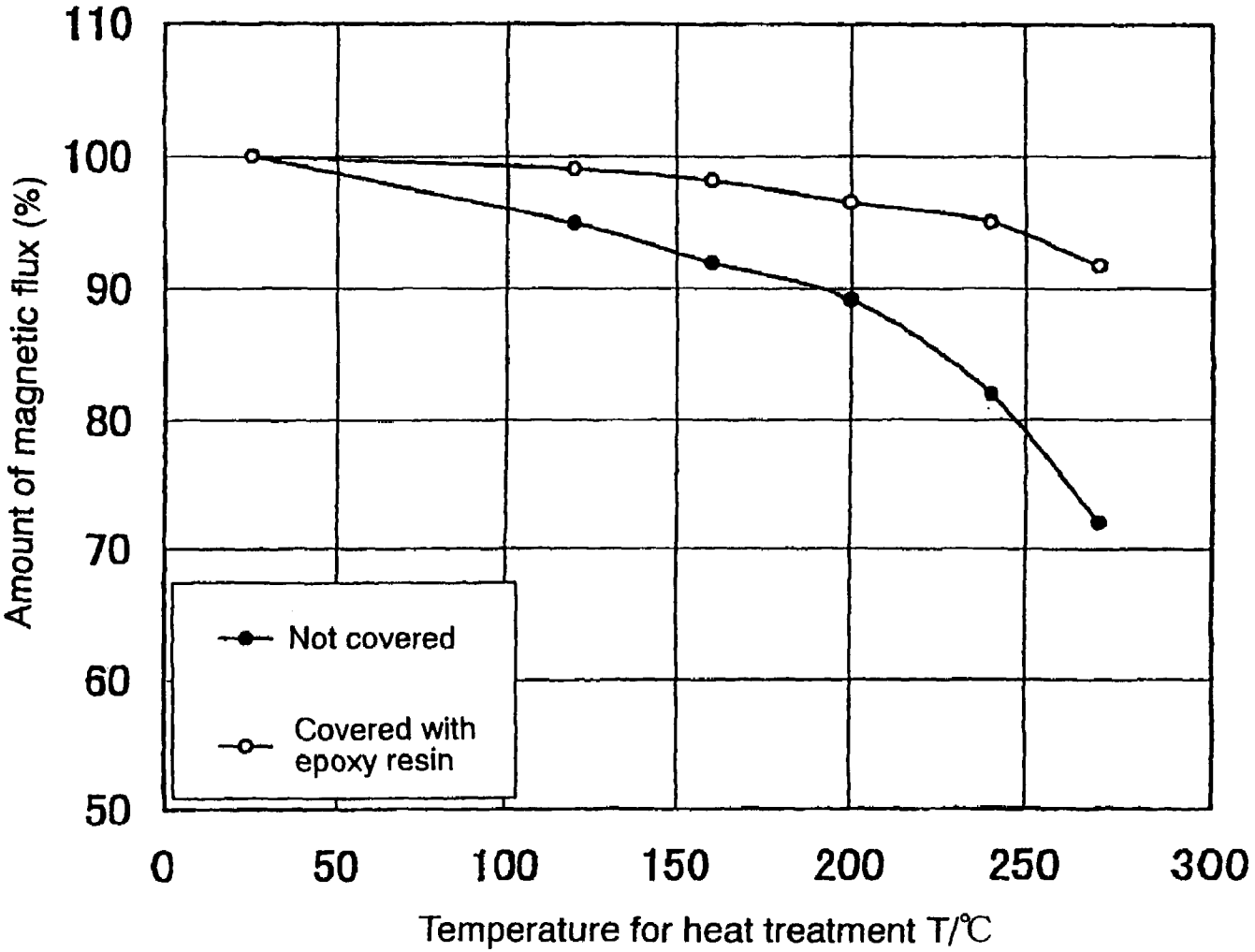
FIG. 32 graphically shows measured data of variation of a magnetic flux amount to different heat treatments of each of a bond magnet (S-2) uncovered with any plastic coating and another bond magnet (S-1) covered with an epoxy coating when the magnets are heat treated in Example 28.

FIG. 32 shows a variation of the surface magnetic flux responsive to the heat treatment. According to the results, the magnet of sample S-2 with no coating was demagnetized about 28% at 270° C. In comparison with this, it was found out that the magnet of sample S-1 coated with epoxy resin is very small in degradation caused by the heat treatment, that is, about 8% demagnetization at 270° C., and has a stable characteristic. This is considered that oxidation of the magnet is suppressed by the epoxy resin coated on the surface to thereby restrict reduction of the magnetic flux.

Further, each of the bond magnets is inserted in a magnetic gap of a magnetic core (FIGS. 1 and 2) and the DC superposition characteristic was measured. The results are shown in FIGS. 33 and 34. Referring to FIG. 33, it is seen that, in the core using the resin-uncovered magnet of sample S-2, the magnetic permeability shifts to a low magnetic field side about 15 Oe and the characteristic degrades significantly at a temperature of 270° C., because the magnetic flux from the magnet is reduced due to the heat-treatment as shown in FIG. 32 to reduce a biasing magnetic field from the magnet. In comparison with this, it shifts to the low magnetic field side only about 5 Oe at 270° C. in case of sample S-1 covered with epoxy resin as shown in FIG. 34.

Thus, the DC superposition characteristic is significantly improved by use of epoxy resin coating comparing with non-coating.

EXAMPLE 29

Relation Between Surface Coating of Magnet and Magnetic Flux

This is similar to Example 28 except that the binder and surface coating are polyimide resin and fluorocarbon resin, respectively.

Figure 36:
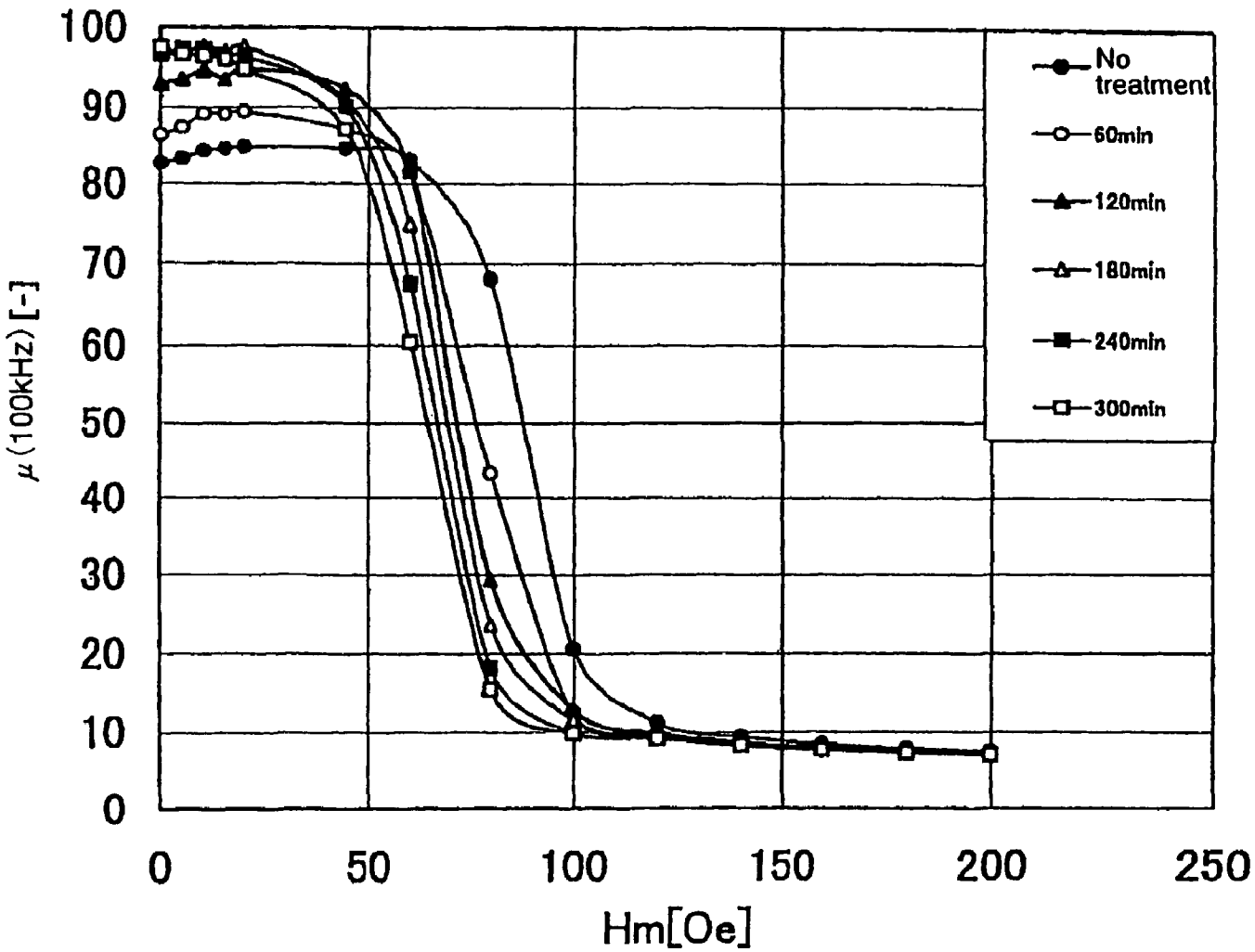
FIG. 36 graphically shows measured data of a variation of a DC superposition characteristic (magnetic permeability $\mu$) of a magnetic core using, as a magnetically biasing magnet disposed in a magnetic gap, the bond magnet (sample S-2) uncovered with any plastic coating in Example 29, when the core is heat treated at different temperatures.
Figure 37:
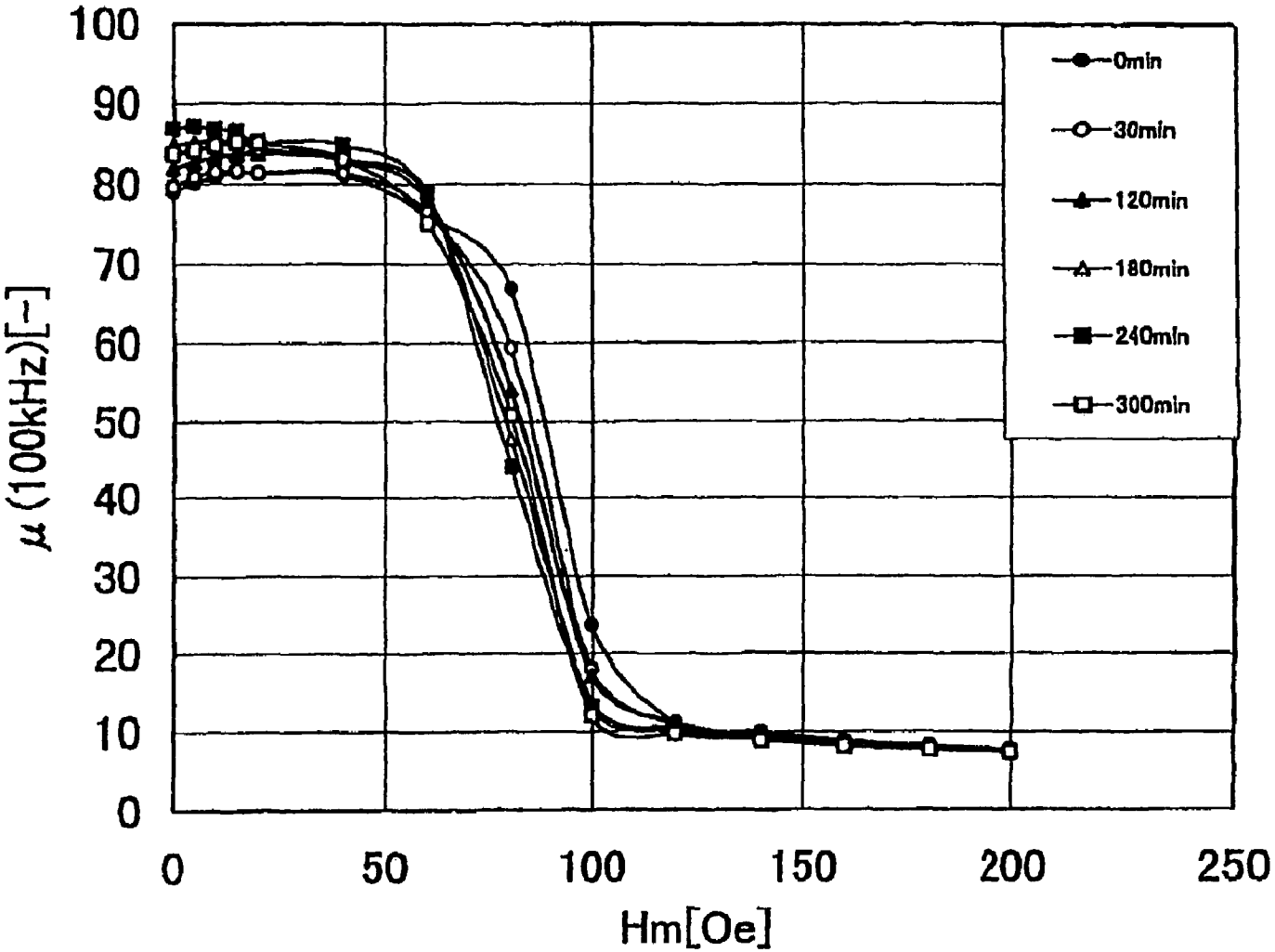
FIG. 37 graphically shows measured data of a variation of a DC superposition characteristic (magnetic permeability $\mu$) of a magnetic core using, as a magnetically biasing magnet disposed in a magnetic gap, the bond magnet (sample S-1) covered with the fluorocarbon resin coating in Example 29, when the core is heat treated at different temperatures.

Each of a bond magnet (sample S-1) covered with fluorocarbon resin and a comparative bond magnet (sample S-2) uncovered with any resin was heat treated in an atmosphere at 270° C. for five hours in total, but being taken out every 60 minutes to be subjected to the measurement of magnetic flux and the measurement of DC superposition characteristics. The results are shown in FIGS. 35–37.

Figure 35:
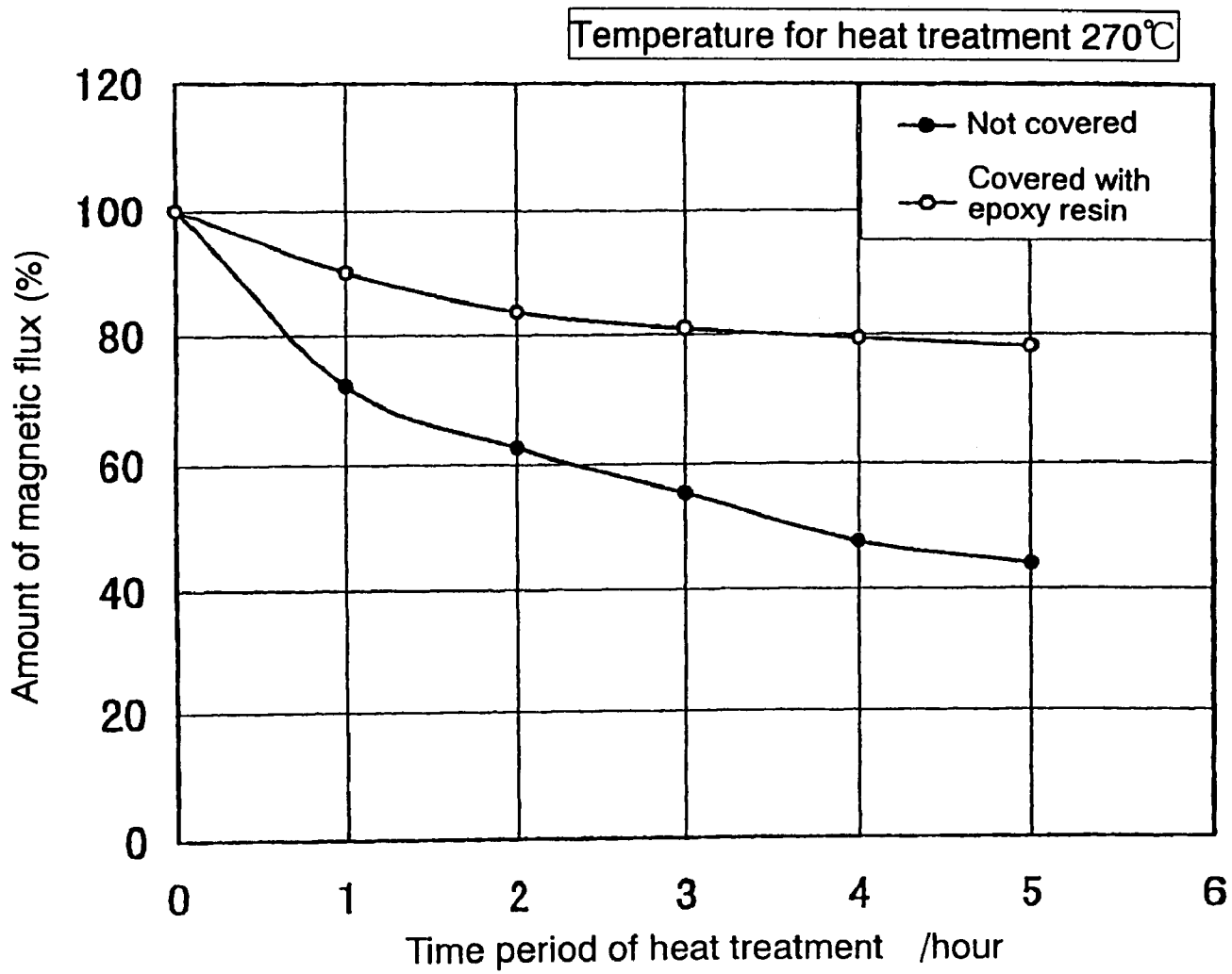
FIG. 35 graphically shows measured data of variation of a magnetic flux amount to different heat treatments of each of a bond magnet (S-2) uncovered with any plastic coating and another bond magnet (S-1) covered with a fluorocarbon resin coating when the magnets are heat treated in Example 29.

FIG. 35 shows a variation of the surface magnetic flux responsive to the heat treatment. It is seen from the results that, comparing with the uncovered magnet of sample S-2 being demagnetized by 58% after five hours, a core using sample S-1 magnet covered with fluorocarbon resin is very small in demagnetization such as 22% after five hours and exhibits a stable characteristic.

This is considered that the surface of the magnet is restricted from oxidation by coating of the fluorocarbon resin so that reduction of the magnetic flux can be suppressed.

The bond magnets of sample S-2 and S-1 were separately disposed in the same magnetic core and the DC superposition characteristic was measured. The results are shown in FIGS. 36 and 37.

Referring to FIG. 36, the core with the resin-uncovered sample magnet S-2 inserted was shifted in the magnetic permeability to the lower magnetic field side by about 30 Oe after five hours to significantly degrade the characteristics, because a biasing magnetic field from the magnet is reduced as the magnetic flux is decreased by the heat treatment as shown in FIG. 35. Comparing with this, in the core using the fluorocarbon resin-covered magnet of sample S-1, DC superposition characteristic was shifted only about 10 Oe to the lower magnetic field side, as shown in FIG. 37. Thus, the DC a superposition characteristic is significantly improved by covering with fluorocarbon resin than the uncovered one.

It will be noted from the above that the bond magnet having a surface covered with the fluorocarbon resin is restricted from oxidation and provides an excellent characteristics. Further, it has been confirmed that the similar results have been obtained by use of other heat resistant resin and heat resistant paint.

EXAMPLE 30

Relation Between Resin Content and Formability

Magnetic powder: $Sm_2Co_{17}$
- Average particle size: 5 μm
- Intrinsic coercive force: 17 kOe
- Curie point: 810° C.

Binder: polyimide resin

The magnetic powder was mixed with the resin as the binder at different resin contents in the range of 15–40 volume % and formed a magnet with a thickness of 0.5 mm by a hot pressing without application of aligning magnetic field.

As a result, it was seen that the formation could not be possible if the resin content is less than 30 volume %.

Similar results were obtained by use of any one of epoxy resin, polyphenylene sulfide resin, silicone resin, polyester resin, aromatic polyamide resin, and liquid crystal polymer.

EXAMPLE 31

Relation of DC Superposition Characteristics with Magnet Powder and Resin

Magnetic powder:
- S-1: $Sm_2Co_{17}$
  - Average particle size: 5 μm
  - Intrinsic coercive force iHc: 15 kOe
  - Curie point Tc: 810° C.
  - Content: 100 weight parts
- S-2: $Sm_2Co_{17}$
  - Average particle size: 5 μm
  - Intrinsic coercive force iHc: 15 kOe
  - Curie point Tc: 810° C.
  - Content: 100 weight parts
- S-3: $Sm_2Fe_{17}N_3$
  - Average particle size: 3 μm
  - Intrinsic coercive force iHc: 10.5 kOe
  - Curie point Tc: 470° C.
  - Content: 100 weight parts
- S-4: Ba ferrite
  - Average particle size: 1 μm
  - Coercive force iHc: 4 kOe
  - Curie point Tc: 450° C.
  - Content: 100 weight parts
- S-5: $Sm_2Co_{17}$
  - Average particle size: 5 μm
  - Intrinsic coercive force iHc: 15 kOe
  - Curie point Tc: 810° C.
  - Content: 100 weight parts Binder:
- S-1: Polyimide resin
  - Resin content: 50 weight parts
- S-2: epoxy resin
  - Resin content: 50 weight parts
- S-3: polyimide resin
  - Resin content: 50 weight parts
- S-4: Polyimide resin
  - Resin content: 50 weight parts
- S-5: Polypropylene resin
  - Resin content: 50 weight parts Production method of Magnet: Molding, without aligning magnetic field Magnet: Thickness: 0.5 mm
- Shape and area: corresponding to the section of a middle leg of the E-shape core
- Specific resistance: 1Ω·cm or more
- Intrinsic coercive force: same as magnetic powder Magnetization: Pulse magnetization machine
- Magnetizing field 4 T Magnetic core: E-E core (FIG. 1), MnZn ferrite
- Magnetic gap length G: 0.5 mm DC superposition characteristics (magnetic permeability):
- Measured at f=100 kHz and Hm=0 to 200 Oe varied In use of each of samples S-1 to S-5 in the same magnetic core, a treatment was repeated four times where the sample core was kept at 270° C. for 30 minutes and then cooled to the room temperature. DC superposition characteristic was measured before and after every heat treatment. The results obtained five times for each sample are shown in FIGS. 38–42.

Figure 42:
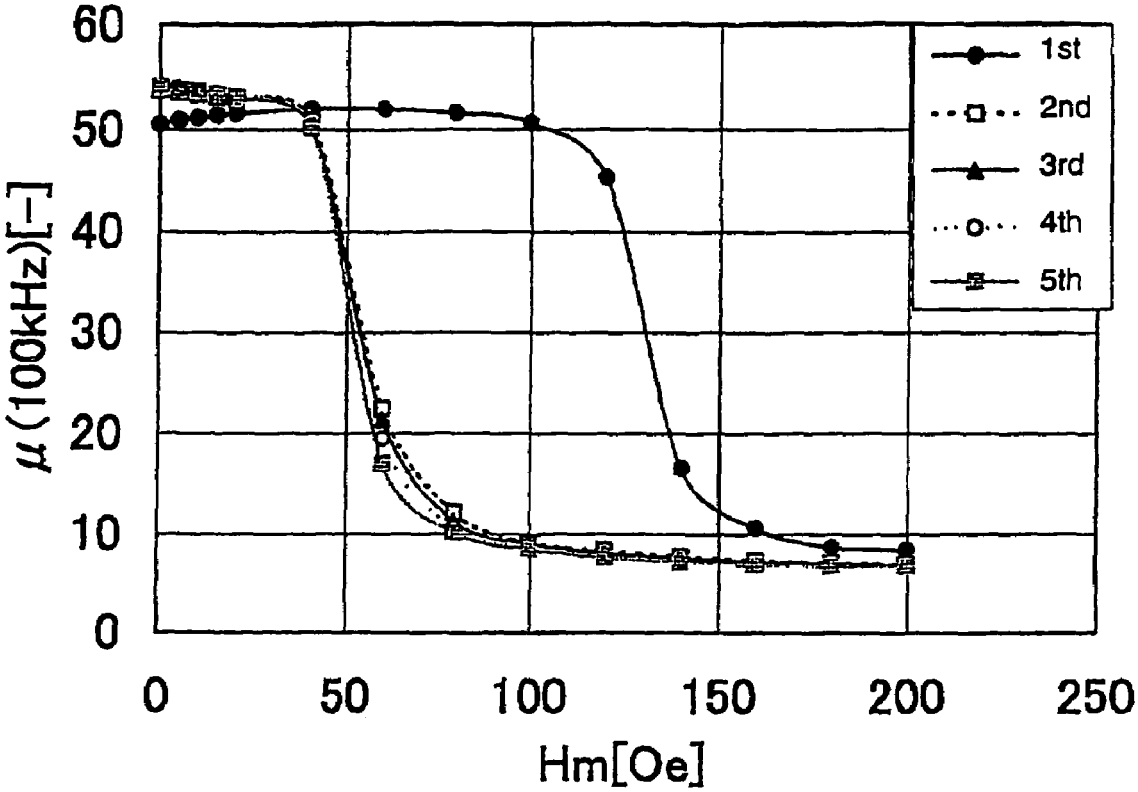
FIG. 42 graphically shows measured data of a variation of a DC superposition characteristic (magnetic permeability $\mu$) of a magnetic core using, as a magnetically biasing magnet disposed in a magnetic gap, a bond magnet (sample S-5) which comprises $Sm_2Co_{17}$ magnetic powder and polypropylene resin in Example 31, when the core is repeatedly subjected to a heat treatment.

It is noted from FIG. 42 that, in the magnetic core with a magnet of sample S-5 disposed therein which contain $Sm_2Co_{17}$ magnetic powder dispersed in the polypropylene resin, the DC superposition characteristic was significantly degraded after second or more times treatment. This is because the thin permanent magnet was deformed during the reflow treatment.

Figure 41:
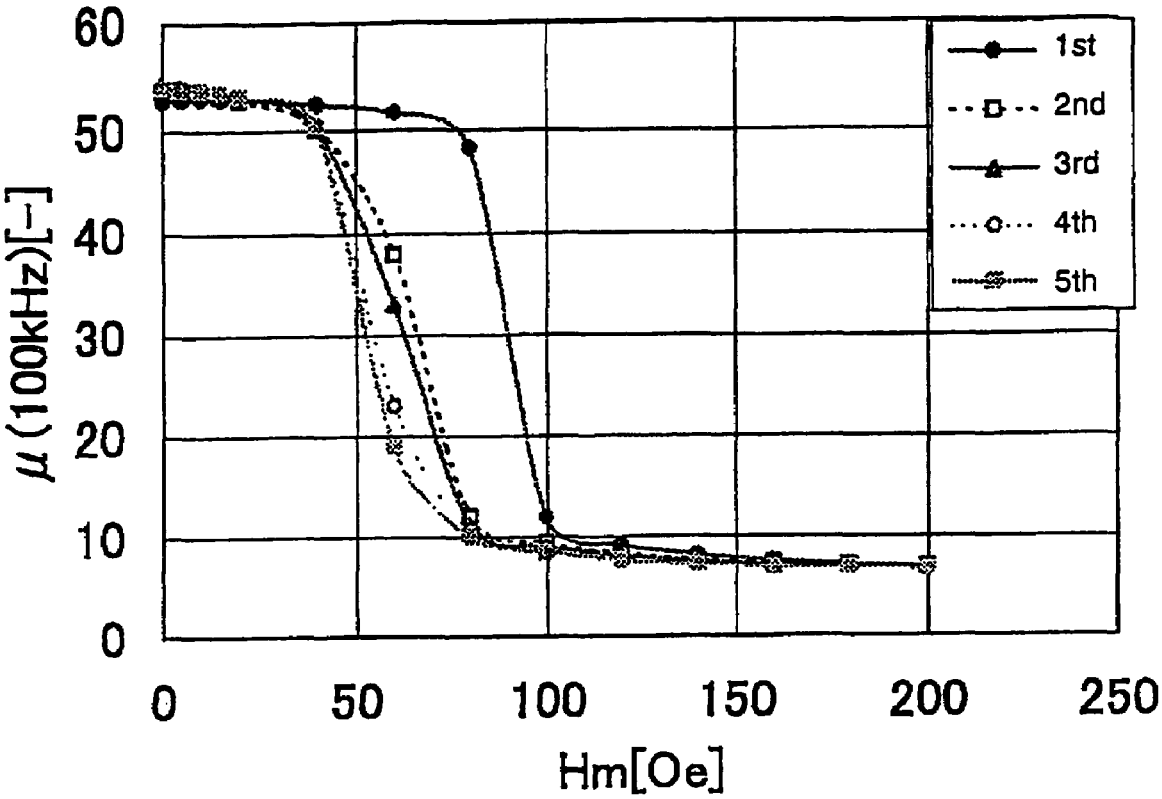
FIG. 41 graphically shows measured data of a variation of a DC superposition characteristic (magnetic permeability $\mu$) of a magnetic core using, as a magnetically biasing magnet disposed in a magnetic gap, a bond magnet (sample S-4) which comprises Ba ferrite magnetic powder and polyimide resin in Example 31, when the core is repeatedly subjected to a heat treatment.

It is seen from FIG. 41 that, in use of the magnetic core using therein a magnet of sample S-4 which comprises Ba ferrite having the coercive force of 4 kOe and dispersed in polyimide resin, the DC superposition characteristics was significantly degraded as increase of the measuring time numbers.

Figure 38:
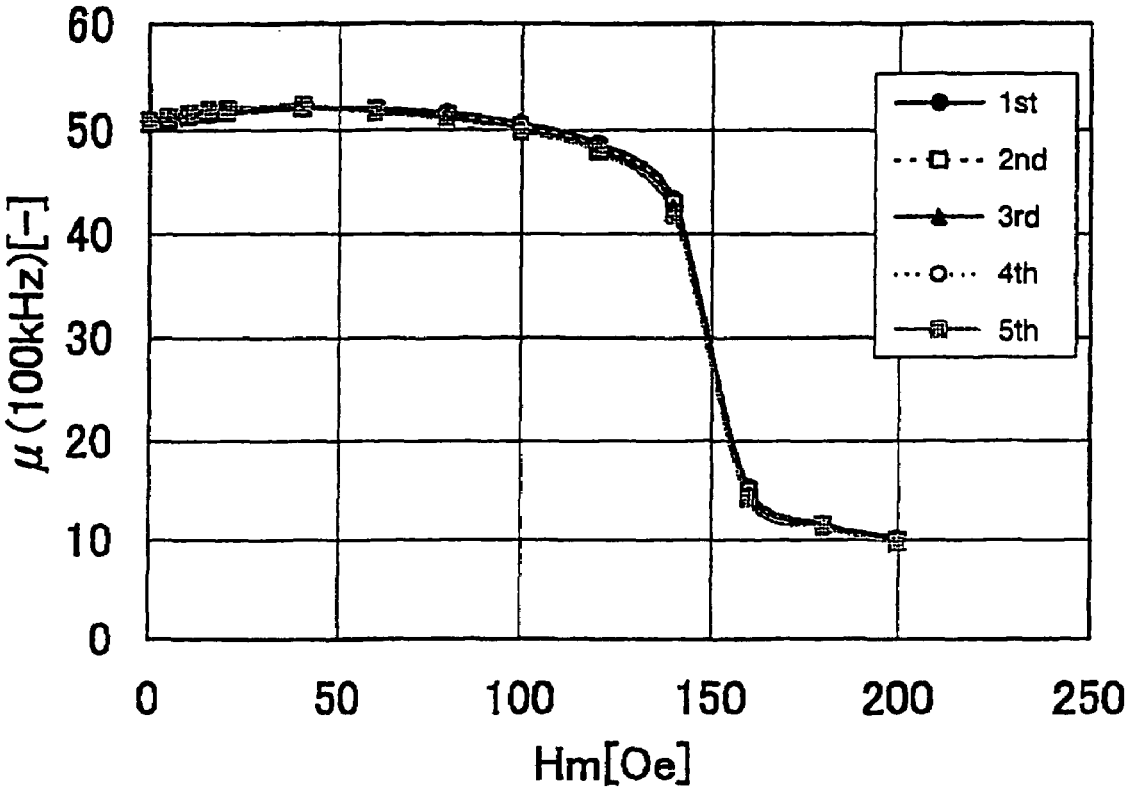
FIG. 38 graphically shows measured data of a variation of a DC superposition characteristic (magnetic permeability $\mu$) of a magnetic core using, as a magnetically biasing magnet disposed in a magnetic gap, a bond magnet (sample S-1) which comprises $Sm_2Co_{17}$ magnetic powder and polyimide resin in Example 31, when the core is repeatedly subjected to a heat treatment.
Figure 39:
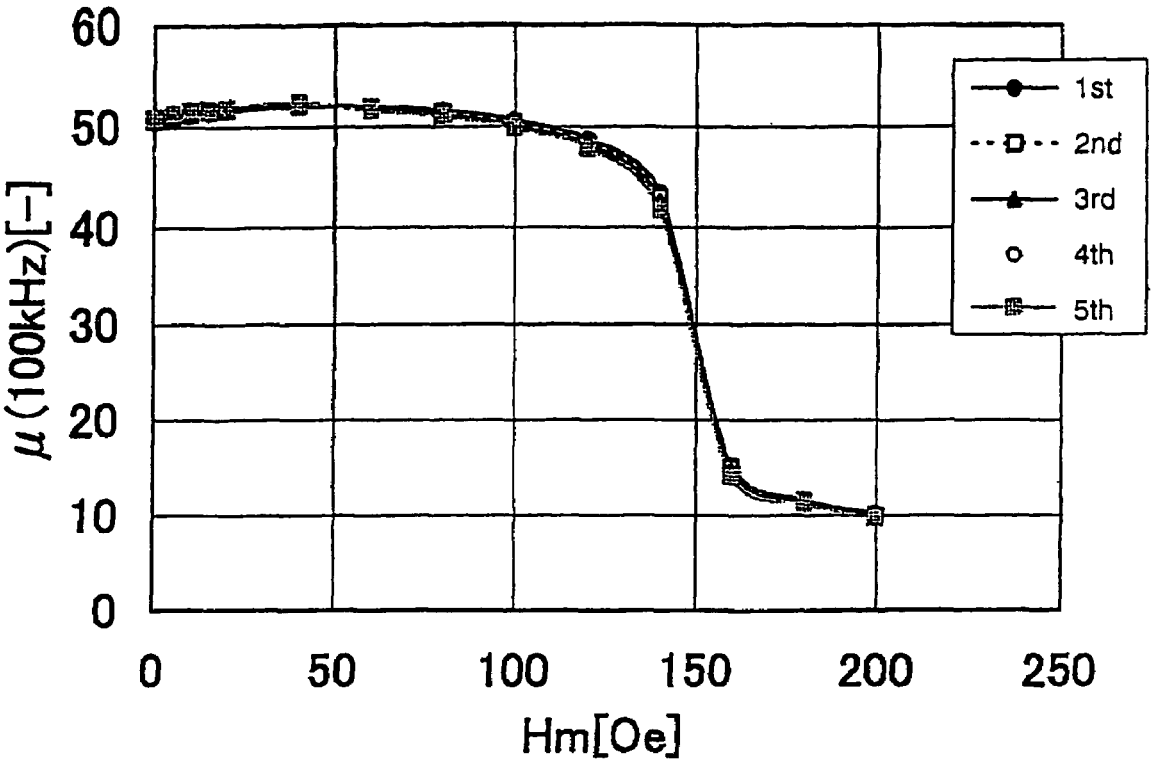
FIG. 39 graphically shows measured data of a variation of a DC superposition characteristic (magnetic permeability $\mu$) of a magnetic core using, as a magnetically biasing magnet disposed in a magnetic gap, a bond magnet (sample S-2) which comprises $Sm_2Co_{17}$ magnetic powder and epoxy resin in Example 31, when the core is repeatedly subjected to a heat treatment.
Figure 40:
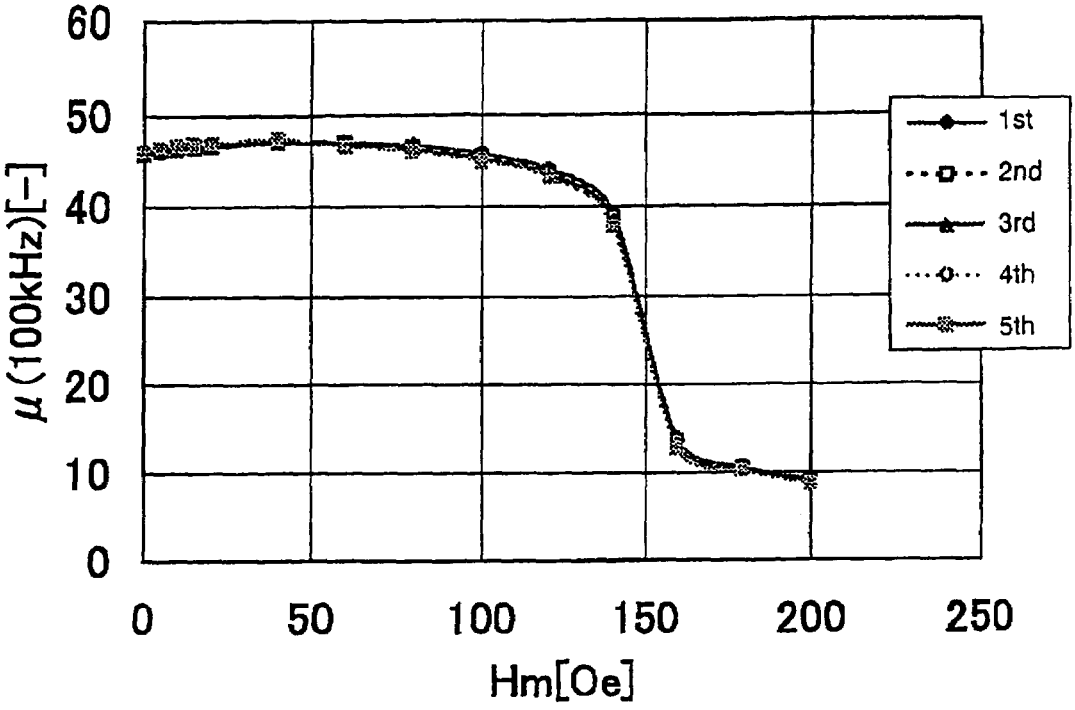
FIG. 40 graphically shows measured data of a variation of a DC superposition characteristic (magnetic permeability $\mu$) of a magnetic core using, as a magnetically biasing magnet disposed in a magnetic gap, a bond magnet (sample S-3) which comprises $Sm_2Fe_{17}N_3$ magnetic powder and polyimide resin in Example 31, when the core is repeatedly subjected to a heat treatment.

On the contrary, it is noted that, in the use of magnets of samples S-1 to S-3 where different magnetic powder having coercive force of 10 kOe dispersed in polyimide resin and/or epoxy resin, separately, the DC superposition characteristics do not significantly change by measurement repeated as shown in FIGS. 38–40, respectively, and were very stable.

It is considered from the results that the Ba ferrite bond magnet is small in the coercive force and therefore demagnetized or magnetized in opposite direction by a magnetic field applied to the magnet in the opposite direction, so that the DC superposition characteristics was degraded.

It was also seen that an excellent DC superposition characteristic can be obtained by use of a magnet having coercive force of 10 kOe or more as the magnet disposed in the magnetic gap.

Although it is not demonstrated here, that similar results were obtained in other combinations other than those in the present example and even by use of any one of epoxy resin, polyphenylene sulfide resin, silicone resin, polyester resin, aromatic polyamide resin, and liquid crystal polymer.

EXAMPLE 32

Relation Between Particle Size of Magnetic Powder and Core-loss

Magnetic powder: $Sm_2Co_{17}$
- Curie point: 810° C.
- S-1: Average particle size: 2.0 μm
  - Coercive force iHc: 10 kOe
- S-2: Average particle size: 2.5 μm
  - Coercive force iHc: 14 kOe
- S-3: Average particle size: 25 μm
  - Coercive force iHc: 17 kOe
- S-4: Average particle size: 50 μm
  - Coercive force iHc: 18 kOe
- S-5: Average particle size: 55 μm
  - Coercive force iHc: 20 kOe Binder: Polyphenylene sulfide resin
- Resin content: 30 volume %

Production method of Magnet: Molding, without aligning magnetic field

Magnet: Thickness: 0.5 mm
- Shape and Area: corresponding to the section of a middle leg of E-shape core
- Specific resistance:
  - S-1: 0.01Ω·cm
  - S-2: 2.0Ω·cm
  - S-3: 1.0Ω·cm
  - S-4: 0.5Ω·cm
  - S-5: 0.015Ω·cm
- Intrinsic coercive force: same as magnetic powder Magnetization: Pulse magnetizing machine
- Magnetizing field 4 T Magnetic core: E-E core (FIG. 1), MnZn ferrite
- Magnetic gap length G: 0.5 mm Core-loss: Measured at f=300 kHz and Ha=0.1 T
- The core-loss measured is shown in Table 14.

TABLE 14

| | Sample | | | | |
|---|---|---|---|---|---|
| | S-1 | S-2 | S-3 | S-4 | S-5 |
| particle size (μm) | 2.0 | 2.5 | 25 | 50 | 55 |
| Core loss ($kW/m^3$) | 670 | 520 | 540 | 555 | 790 |

It is seen from Table 14 that, by using, as the biasing permanent magnet, a magnet with a powder having an average particle size of 2.5–50 μm, the excellent core-loss is obtained.

EXAMPLE 33

Relation Between Gloss and Flux (Surface Magnetic Flux)

Magnetic powder: $Sm_2Co_{17}$
- Average particle size: 5 μm
- Coercive force iHc: 17 kOe
- Curie point Tc: 810° C.

Binder: polyimide resin
- Resin content: 40 volume %

Production method of Magnet: Molding (pressing pressure being changed), without aligning magnetic field Magnetization: Pulse magnetizing machine
- Magnetizing field 4 T Magnet: Thickness: 0.3 mm, 1 cm×1 cm
- Specific resistance: 1Ω·cm or more
- Intrinsic coercive force: 17 kOe The surface magnetic flux and the gloss were measured in each of samples pressed at different pressures and are shown in Table 15.

TABLE 15

| | | | | | | |
|---|---|---|---|---|---|---|
| Gloss(%) | 15 | 21 | 23 | 26 | 33 | 45 |
| Flux(Gauss) | 42 | 51 | 54 | 99 | 101 | 102 |

It is noted from the results in Table 15 that the bond magnet having a gloss of 25% or more is excellent in the magnetic properties. This is because the bond magnet having a gloss of 25% or more has a packing factor of 90% or more.

Further, it was also confirmed that similar results were obtained in use of a resin selected from a group of polyphenylene sulfide resin, silicone resin, polyester resin, aromatic polyamide resin and liquid crystal resin.

EXAMPLE 34

Relation of Gloss and Flux with Compressibility

Magnetic powder: $Sm_2Co_{17}$
- Average particle size: 5 μm
- Coercive force iHc: 17 kOe
- Curie point Tc: 810° C.

Binder: polyimide resin
- Resin content: 40 volume %

Production method of Magnet: Doctor blade method, without aligning magnetic field, hot-pressing after being dried (with pressing pressure varied)

Magnetization: Pulse magnetizing machine
- Magnetizing field 4 T

Magnet: Size: 1 cm×1 cm, Thickness: 500 μm
- Specific resistance: 1Ω·cm or more
- Intrinsic coercive force: 17 kOe Varying pressures in the hot pressing, six samples were produced which have different compressibility ratios in a range of 0 to 21(%).

The gloss and the surface magnetic flux were measured for each of samples. The results are shown in Table 16.

TABLE 16

| | | | | | | |
|---|---|---|---|---|---|---|
| Gloss(%) | 9 | 13 | 18 | 22 | 25 | 28 |
| Flux(Gauss) | 34 | 47 | 51 | 55 | 100 | 102 |
| Compressibility ratio(%) | 0 | 6 | 11 | 14 | 20 | 21 |

It is noted from the results in Table 16 that the excellent magnetic properties are obtained in a gloss of 25% or more. This is because the bond magnet having a gloss of 25% or more has a packing factor of 90% or more. With respect to compressibility ratio, excellent magnetic properties are also obtained when the compressibility is 20% or more. This is because the bond magnet having a compressibility ratio of 20% or more has a packing factor of 90% or more.

Further, it was also confirmed that similar results were obtained by using, as the binder, a resin selected from a group of polyphenylene sulfide resin, silicone resin, polyester resin, aromatic polyamide resin and liquid crystal resin.

EXAMPLE 35

Relation Between Addition of Surfactant and Core-loss

Magnetic powder: $Sm_2Co_{17}$
- Average particle size: 5.0 μcm
- Coercive force iHc: 17 kOe
- Curie point Tc: 810° C.

Additives: Surfactant:
- S-1: sodium phosphate 0.5 wt %
- S-2: carboxymethyl cellulose sodium 0.5 wt %
- S-3: sodium silicate
- S-4: no surfactant Binder: polyphenylene sulfide resin
- Resin content (volume %): 35 volume %

Production method of Magnet: Molding, without aligning magnetic field

Magnet: Thickness: 0.5 mm
- Shape and Area: corresponding to the section of a middle leg of E-shape core
- Specific resistance: 1Ω·cm or more
- Intrinsic coercive force: 17 kOe Magnetization: Pulse magnetizing machine
- Magnetizing field 4 T Magnetic core: E-E core (FIG. 1), MnZn ferrite
- Magnetic gap length G: 0.5 mm Core-loss: Measured at f=300 kHz and Ha=0.1 T
- The core-loss data measured are shown in Table 17.

TABLE 17

| | Surfactant | Core-loss ($kW/m^3$) |
|---|---|---|
| S-1 | sodium phosphate | 495 |
| S-2 | carboxymethyl cellulose sodium | 500 |
| S-3 | sodium silicate | 485 |
| S-4 | Non | 590 |

It is seen from Table 17 that the samples containing surfactant exhibit excellent core-loss characteristics. This is because the addition of the surfactant prevents primary particles from aggregating to thereby restrict eddy current loss.

This example demonstrated results of a test using phosphates. It was confirmed that excellent core-loss could also be obtained by use of other surfactants.

EXAMPLE 36

Relation Between Specific Resistance and Core-loss

Magnetic powder: $Sm_2Co_{17}$
- Average particle size: 5.0 μm
- Intrinsic coercive force iHc: 17 kOe
- Curie point Tc: 810° C.

Binder: polyimide resin
- Resin content: adjusted

Production method of Magnet: Molding, without aligning magnetic field

Magnet: Thickness: 0.5 mm
- Shape and Area: corresponding to the section of a middle leg of E-shape core
- Specific resistance (Ω·cm):
  - S-1: 0.05
  - S-2: 0.1
  - S-3: 0.2
  - S-4: 0.5
  - S-5: 1.0
- Intrinsic coercive force: 17 kOe Magnetization: Pulse magnetizing machine
- Magnetizing field 4 T Magnetic core: E-E core (FIG. 1), MnZn ferrite
- Magnetic gap length G: 0.5 mm Core-loss: Measured at f=300 kHz, Ha=0.1 T
- The core-loss measured is shown in Table 18.

TABLE 18

| | sample | | | | |
|---|---|---|---|---|---|
| | S-1 | S-2 | S-3 | S-4 | S-5 |
| Specific resistance (Ω · cm) | 0.05 | 0.1 | 0.2 | 0.5 | 1.0 |
| Core-loss ($kW/m^3$) | 1220 | 530 | 520 | 515 | 530 |

It is seen from Table 18 that, in a specific resistance of 0.1Ω·cm or more, the magnetic core exhibits an excellent core-loss. This is because the eddy current loss can be restricted by increase of specific resistance of the thin plate magnet.

EXAMPLE 37

Relation of Specific Resistance with Core-loss and DC Superposition Characteristics Magnetic powder: $Sm_2Co_{17}$
- Average particle size: 5.0 μm
- Intrinsic coercive force iHc: 17 kOe
- Curie point Tc: 810° C.

Binder: polyimide resin
- Resin content: adjusted (as shown in Table 19)

Production method of Magnet: Molding, without aligning magnetic field, hot pressing Magnet: Thickness: 0.5 mm
- Shape and Area: corresponding to the section of a middle leg of E-shape core
- Specific resistance (Ω·cm):
  - S-1: 0.05
  - S-2: 0.1
  - S-3: 0.2

S-4: 0.5
S-5: 1.0
Intrinsic coercive force: 17 kOe
Magnetization: Pulse magnetizing machine
Magnetizing field 4 T
Magnetic core: E-E core (FIG. 1), MnZn ferrite
Magnetic gap length G: 0.5 mm
Core-loss: Measured at f=300 kHz, Ha=0.1 T
DC superposition characteristics (magnetic permeability): Measured at f=100 kHz and Hm=0–200 Oe varied Using the same magnetic core, the core-loss for each of the samples is measured. The measured results are shown in Table 19.

TABLE 19

| Sample | Magnetic powder | Resin content (vol %) | Specific resistance (Ω · cm) | Core-loss (kW/m$^3$) |
|---|---|---|---|---|
| S-1 | $Sm_2Co_{17}$ | 20 | 0.05 | 1230 |
| S-2 | | 30 | 0.1 | 530 |
| S-3 | | 35 | 0.2 | 520 |
| S-4 | | 40 | 0.5 | 515 |
| S-5 | | 50 | 1 | 530 |

It is seen from Table 19 that, in a specific resistance of 0.1Ω·cm or more, the magnetic core exhibits an excellent core-loss. This is because the eddy current loss can be restricted by increase of specific resistance of the thin plate magnet.

Figure 43:
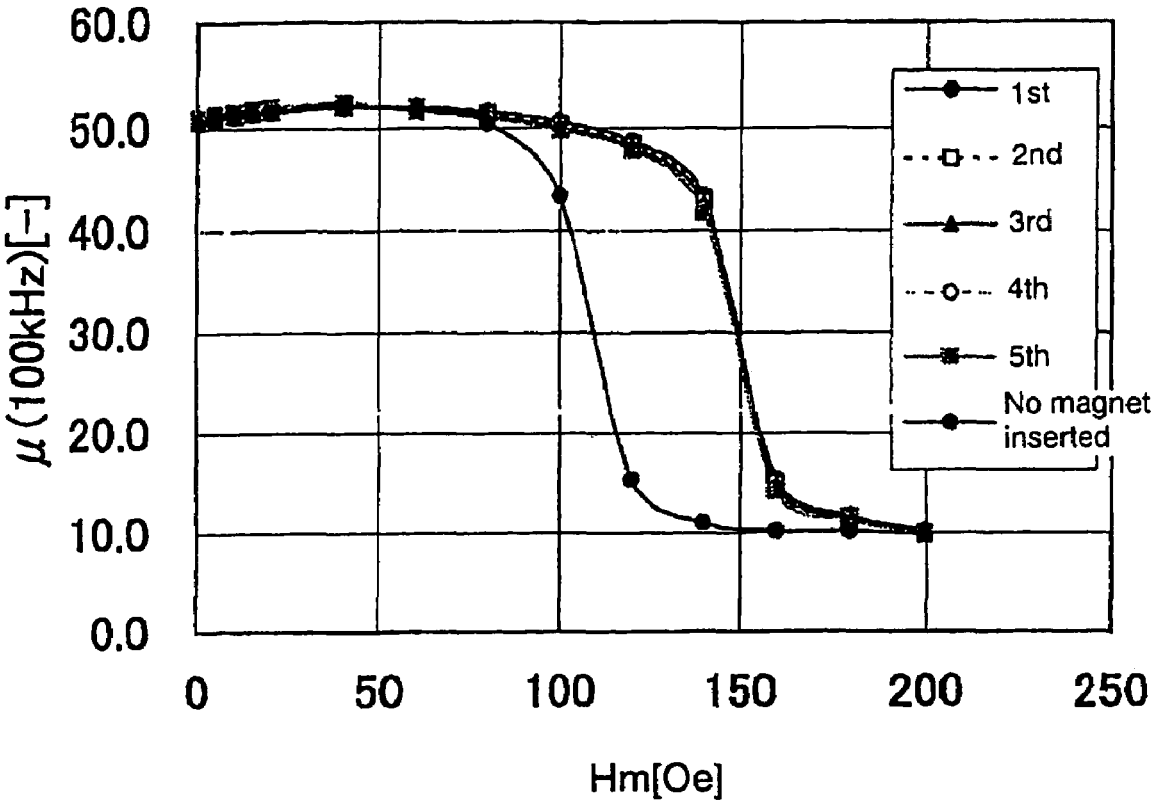
FIG. 43 graphically shows measured data of a variation of a DC superposition characteristic (magnetic permeability $\mu$) of a magnetic core using, as a magnetically biasing magnet disposed in a magnetic gap, a bond magnet of sample S-2 in Example 37, when the core is repeatedly subjected to a heat treatment.

On the contrary, it is noted from FIG. 43 that, in the magnetic core using the magnet of sample S-2 having the coercive force of 15 kOe, the DC superposition characteristics do not significantly change by measurement repeated and is very stable.

EXAMPLE 38

Relation of Surface Magnetic Flux of the Magnet with the Particle Size of the Magnetic Powder and the Center-line Average Roughness Magnetic powder: $Sm_2Co_{17}$
Average particle size (μm): See Table 20
Binder: polyimide resin
Resin content: 40 volume %
Production method of Magnet: Doctor blade method, without aligning magnetic field, hot-pressing
Magnet: Thickness: 0.5 μm,
Shape and area: corresponding to a section of a middle leg of the E shape core
Specific resistance: 1Ω·cm or more
Intrinsic coercive force: 17 kOe
Magnetic core: E-E core (FIGS. 1 and 2): MnZn ferrite
Magnetic gap length G: 0.5 mm Varying pressures in the hot pressing, samples S-1 to S-6 shown in Table 20 were produced.

The surface magnetic flux, the centerline average surface roughness and biasing amount were measured. The results are shown in Table 20.

TABLE 20

| Sample | Average particle size (μm) | Sieve diameter (μm) | Pressure in Hot press (kgf/cm$^2$) | Center surface roughness (μm) | Flux (Gauss) | Magnetic biasing amount (Gauss) |
|---|---|---|---|---|---|---|
| S-1 | 2 | 45 | 200 | 1.7 | 30 | 600 |
| S-2 | 2.5 | 45 | 200 | 2 | 130 | 2500 |
| S-3 | 5 | 45 | 200 | 6 | 110 | 2150 |
| S-4 | 25 | 45 | 200 | 20 | 90 | 1200 |
| S-5 | 5 | 45 | 100 | 12 | 60 | 1100 |
| S-6 | 5 | 90 | 200 | 15 | 100 | 1400 |

Further, in use of magnet of sample S-2 in the same magnetic core, a treatment was repeated four times where the sample core was kept at 270° C. for 30 minutes and then cooled to the room temperature. DC superposition characteristic was measured before and after every heat treatment, and the results measured by five times in total are shown in FIG. 43. For the comparison, a DC superposition characteristics in a case without any magnet disposed in the magnetic gap is shown in FIG. 43.

Figure 44:
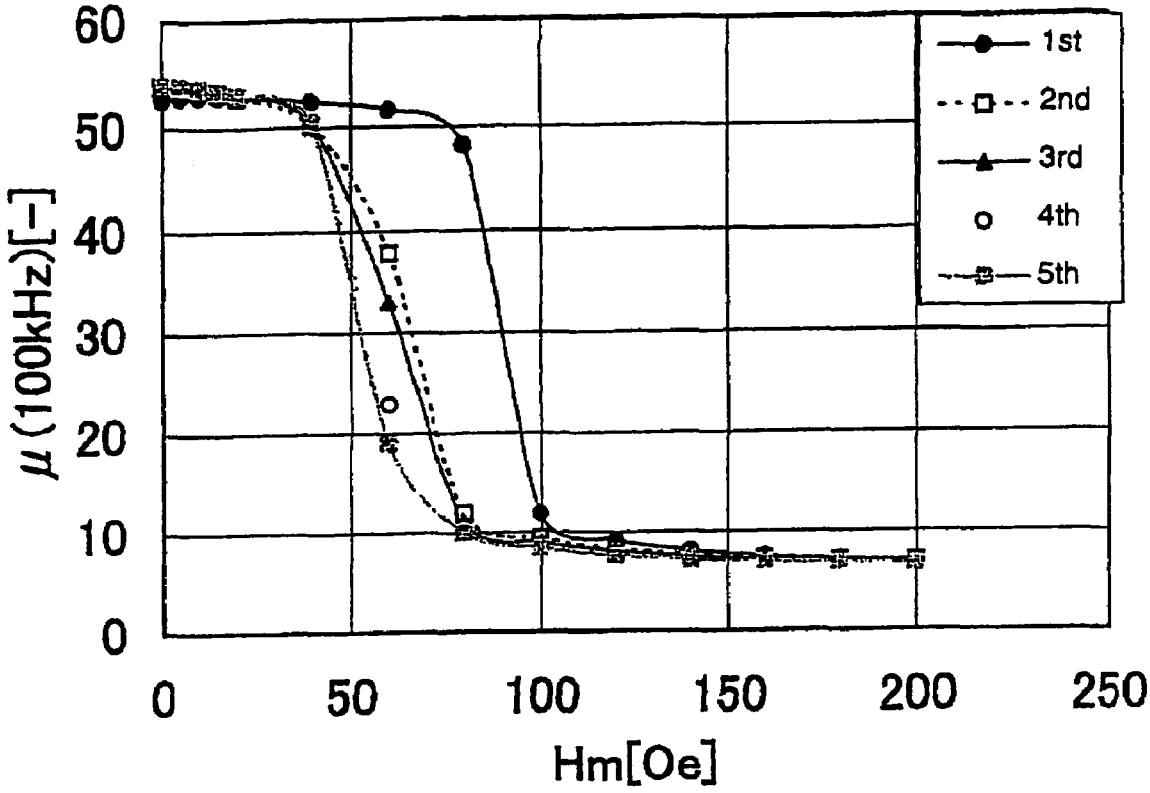
FIG. 44 graphically shows measured data of a variation of a DC superposition characteristic (magnetic permeability $\mu$) of a magnetic core using, as a magnetically biasing magnet disposed in a magnetic gap, a bond magnet of a comparative sample (S-6) in Example 37, when the core is repeatedly subjected to a heat treatment.

Further, in use of the magnetic containing Ba ferrite powder (iHc=4 kOe) as a comparative sample (S-6), the similar result measured is shown in FIG. 44.

It is seen from FIG. 44 that, in the core with the thin magnet using the Ba ferrite having the coercive force of only 4 kOe, the DC superposition characteristics was significantly degraded as increase of the measuring times. This is considered by the reason why it is small in the coercive force and therefore demagnetized or magnetized in opposite direction by a magnetic field applied to the magnet in the opposite direction, so that the DC superposition characteristics was degraded.

The sample S-1 having an average particle size of 2.0 μm is low in the flux and provides small in a magnetic biasing amount. This is considered due to a reason why oxidation of the magnetic powder was advanced during the production processes.

Further, sample S-4, which is large in an average particle size, is low in the powder-packing ratio and is therefore low in the flux. It is also large in the surface profile roughness and is therefore low in contact with the magnetic core so that the permeance constant becomes low and the magnetic biasing amount is low.

In sample S-5 small in particle size but large in surface roughness because of insufficient pressing pressure, the magnetic flux is low because of a low powder-packing ratio and the magnetic biasing amount is small.

In sample 6 having coarse particles mixed therein, the surface profile roughness are large. Therefore, it is considered that the biasing amount is reduced.

It is noted from these results that the excellent DC superposition characteristics can be obtained by inserting into the magnetic gap of the magnetic core a thin magnet which has a center-line average surface roughness Ra of 10

μm or less and uses a magnetic powder which has an average particle size of 2.5 μm or more but up to 25 μm and is 50 μm at maximum particle size.

EXAMPLE 39

Relation Between Kind of Magnet (Intrinsic Coercive Force) and DC Superposition Characteristics Magnetic powder: six kinds of S-1 to S-6 (magnetic powder and contents are shown in Table 21)
Binder: kinds and their contents are shown in Table 21
Method for production of magnet:
- S-1, S-4, S-5, S-6: Molding and hot press, without aligning magnetic field
- S-2: Doctor blade method and hot press
- S-3: Molding and then curing Magnet: Thickness: 0.5 mm
- Shape and area: corresponding to a section of a middle leg of E-shape core
- Specific resistance: 0.1Ω·cm or more in all samples
- Intrinsic coercive force (iHc): same as the magnetic powders Magnetization: Pulse magnetizing machine
- Magnetizing field 4 T Magnetic core: E-E core (FIG. 1), MnZn ferrite
- Magnetic gap length G: 0.5 mm DC superposition characteristics (magnetic permeability):
- Measured at f=100 kHz and Hm=35 Oe Each of samples was subjected to a heat treatment in a reflow furnace at 270° C. for 30 minutes and thereafter, again measured for the DC superposition characteristics.

The similar measurement was carried out for the magnetic core without any magnet inserted in the magnetic gap, as a comparative sample. In this case, the DC superposition characteristics (effective magnetic permeability) had a constant value of 70 before and after the heat treatment and were not changed by the heat treatment.

The measured results of those samples are shown in Table 21.

TABLE 21

| Sample | Magnetic powder Resin | iHc (kOe) | Mixing parts | μe Before reflow treating (at 35 Oe) | μe After reflow treating (at 35 Oe) |
|---|---|---|---|---|---|
| S-1 | $Sm(Co_{0.742}Fe_{0.20}Cu_{0.055}Zr_{0.029})_{7.7}$ | 15 | 100 wt. parts | 140 | 130 |
| | Aromatic polyamide | — | 100 wt. parts | | |
| S-2 | $Sm(Co_{0.742}Fe_{0.20}Cu_{0.055}Zr_{0.029})_{7.7}$ | 15 | 100 wt. parts | 120 | 120 |
| | Soluble polyimide | — | 100 wt. parts | | |
| S-3 | $Sm(Co_{0.742}Fe_{0.20}Cu_{0.055}Zr_{0.029})_{7.7}$ | 15 | 100 wt. parts | 140 | 120 |
| | Epoxy | — | 100 wt. parts | | |
| S-4 | $Sm_2Fe_{17}N_3$ Magnetic powder | 10 | 100 wt. parts | 140 | 70 |
| | Aromatic polyamide | — | 100 wt. parts | | |
| S-5 | Ba ferrite magnetic powder | 4.0 | 100 wt. parts | 90 | 70 |
| | Aromatic polyamide | — | 100 wt. parts | | |
| S-6 | $Sm(Co_{0.742}Fe_{0.20}Cu_{0.055}Zr_{0.029})_{7.7}$ | 15 | 100 wt. parts | 140 | — |
| | Polypropylene | — | 100 wt. parts | | |

Figure 45:
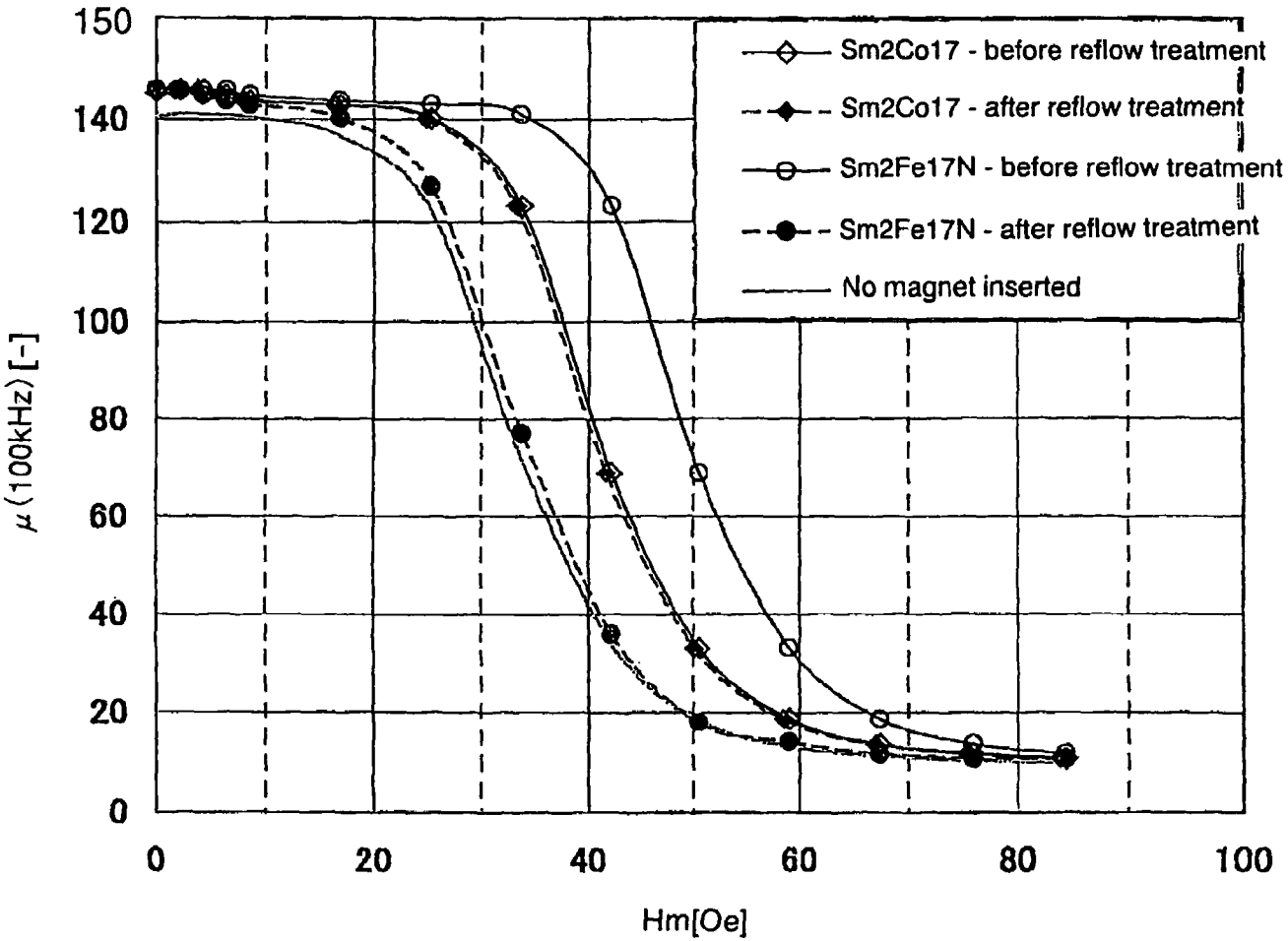
FIG. 45 graphically shows measured data of a variation of a DC superposition characteristic (magnetic permeability $\mu$) before and after a reflow soldering treatment of a magnetic core with use or without use of, as a magnetically biasing magnet disposed in a magnetic gap, each of bond magnets of S-2 and S-4 in Example 39.

The DC superposition characteristics (magnetic permeability) of samples S-2 and S-4 and the comparative sample are shown in FIG. 45.

According to these results, the Ba ferrite bond magnet (sample S-5) is low in the coercive force. Therefore, it is considered that the bond magnet is demagnetized or magnetized in the reverse direction by an opposite magnetic field applied thereto, to thereby cause the degradation of the DC superposition characteristics.

The SmFeN magnet (sample S-4) is low in Curie point such as 470° C. although it is high in the coercive force, so that thermal demagnetization is caused to which demagnetization due to application of the opposite magnetic field is added. This is considered a reason why the characteristics were degraded.

On the other hand, it is noted that, as a bond magnet inserted in the magnetic gap of the magnetic core, bond magnets (samples S-1 to S-3 and S-6) having coercive force of 10 kOe or more and Tc of 500° C. or more can provide an excellent DC superposition characteristics.

EXAMPLE 40

Relation Between Specific Resistance and Core-loss

Magnetic powder $Sm(Co_{0.742}Fe_{0.20}Cu_{0.055}Zr_{0.029})_{7.7}$
- Average particle size: 5 μm
- Coercive force iHc: 15 kOe
- Curie point Tc: 810° C.

Binder: Polyamideimide resin
- Resin content: adjusted (see Table)

Method for production of magnet: Doctor blade method, hot-press after being dried, without aligning magnetic field Magnet: Thickness: 0.5 mm
- Shape and area: corresponding to the section of a middle leg of E-shape core
- Specific resistance (Ω·cm):
  - S-1: 0.06
  - S-2: 0.1
  - S-3: 0.2
  - S-4: 0.5
  - S-5: 1.0
- Intrinsic coercive force: 15 kOe Magnetization: Pulse magnetizing machine
- Magnetizing field 4 T Magnetic core: E-E core (FIG. 1), MnZn ferrite
- Magnetic gap G: 0.5 mm Core-loss: Measured at f=300 kHz and Ha=0.1 T Using each of sample magnets in the magnetic core, the core-loss was measured. The measured results are shown in Table 22.

TABLE 22

| Sample | Magnetic powder | Resin content (vol %) | Specific resistance (Ω · cm) | Core loss (kW/m$^3$) |
|---|---|---|---|---|
| S-1 | $Sm(Co_{0.742}Fe_{0.20}Cu_{0.055}Zr_{0.029})_{7.7}$ | 25 | 0.06 | 1250 |
| S-2 | | 30 | 0.1 | 680 |
| S-3 | | 35 | 0.2 | 600 |
| S-4 | | 40 | 0.5 | 530 |
| S-5 | | 50 | 1.0 | 540 |

As a comparative sample, the same E-E core having the gap with no magnet therein has a core-loss of 520 (kW/m$^2$) which was measured at the same measuring condition. According to Table 22, the magnetic core has an excellent core-loss property in use of the magnet having the specific resistance of 0.1Ω·cm or more. This is considered that use of a thin magnet having the high specific resistance can suppress to produce the eddy current.

INDUSTRIAL APPLICABILITY

According to this invention, it is possible to easily provide with a low cost a magnetic core excellent in DC superposition characteristics and core-loss property, and an inductance part using the same. Specifically, it is possible to produce a biasing magnet as a thin magnet having a thickness of 500 μm or less, to thereby enable to make the magnetic core and the inductance part in a small size. Further, a thin biasing magnet is realized which is resistant to the temperature in the reflow soldering process, so that it is possible to provide a magnetic core and an inductance part which are small in size and can be surface-mounted.

What is claimed is:

1. An inductance part comprising a magnetic core formed with a magnetic gap having a gap length of about 50–10,000 μm at least one position in a magnetic path thereof, a magnetically biasing magnet disposed in the vicinity of the magnetic gap for supplying a magnetic bias from both ends of the magnetic gap, and a coil winding wound on the magnetic core by at least one turn, wherein:

said magnetically biasing magnet is a bond magnet comprising a plastic resin and magnetic powder dispersed in the plastic resin and has a specific resistance of 1Ω·cm or more;

said magnetic powder being a rare-earth magnetic powder which has an intrinsic coercive force of 5 kOe or more, a Curie Point Tc of 300° C. or more, the maximum particle size equal to or less than 150 μm, and an average particle size of 2–50 μm, said rare-earth magnetic powder being one selected from a group of Sm—Co magnetic powder, Nd—Fe—B magnetic powder, and Sm—Fe—N magnetic powder.

2. An inductance part as claimed in claim 1, wherein said magnetically biasing magnet is produced by molding.

3. An inductance part as claimed in claim 2, wherein said magnetically biasing magnet has a compressibility of 20% or more by compacting.

4. An inductance part as claimed in claim 1, wherein said magnetically biasing magnet has a surface coating of a heat resistant paint or a heat resistant resin having a heat resistance temperature of 120° C. or more.

5. An inductance part as claimed in claim 1, wherein a content of said plastic resin is 20% or more on the base of a volumetric percentage, and said plastic resin is at least one selected from a group of polypropylene resin, 6-nylone resin, 12-nylone resin, polyimide resin, polyethylene resin, and epoxy resin.

6. An inductance part comprising a magnetic core formed with a magnetic gap having a gap length of about 50–10,000 μm at least one position in a magnetic path thereof, a magnetically biasing magnet disposed in the vicinity of the magnetic gap for supplying a magnetic bias from both ends of the magnetic gap, and a coil winding wound on the magnetic core by at least one turn, said inductance part adapted to be subjected to a reflow soldering treatment, wherein:

said magnetically biasing magnet is a bond magnet comprising a plastic resin and magnetic powder dispersed in the plastic resin and has a specific resistance of 1Ω·cm or more;

said magnetic powder being a Sm—Co rare-earth magnetic powder which has an intrinsic coercive force of 10 kOe or more, a Curie Point Tc of, 500° C. or more, the maximum particle size equal to or less than 150 μm, and an average particle size of 2.5–50 μm.

7. An inductance part as claimed in claim 6, wherein said magnetically biasing magnet is produced by molding.

8. An inductance part as claimed in claim 7, wherein said magnetically biasing magnet has a compressibility of 20% or more by compacting.

9. An inductance part as claimed in claim 6, wherein said magnetically biasing magnet has a surface coating of a heat resistant paint or a heat resistant resin having a heat resistance temperature of 270° C. or more.

10. An inductance part as claimed in claim 6, wherein said Sm—Co rare-earth magnetic powder is one represented by:

$$Sm(Co_{bal}Fe_{0.15-0.25}Cu_{0.05-0.06}Zr_{0.02-0.03})_{7.0-8.5}.$$

11. An inductance part as claimed in claim 6, wherein a content of said plastic resin is 30% or more on the base of a volumetric percentage, and said plastic resin is at least one selected from a group of polyimide resin, polyamideimide resin, epoxy resin, polyphenylene sulfide, silicone resin, polyester resin, aromatic polyamide resin, and liquid crystal polymer.

12. An inductance part comprising a magnetic core formed with a magnetic gap having a gap length equal to or less than 500 μm at at least one position in a magnetic path thereof, a magnetically biasing magnet disposed in the vicinity of the magnetic gap for supplying a magnetic bias from both ends of the magnetic gap, and a coil winding wound on the magnetic core by at least one turn, wherein:

said magnetically biasing magnet is a bond magnet comprising a plastic resin and magnetic powder dispersed in the plastic resin and has a specific resistance of 0.1Ω·cm or more and a thickness equal to or less than 500 μm;

said magnetic powder being a rare-earth magnetic powder which has an intrinsic coercive force of 5 kOe or more, a Curie Point Tc of 300° C. or more, the maximum particle size equal to or less than 150 μm, and an average particle size of 2.0–50 μm, said rare-earth magnetic powder being one selected from a group of Sm—CO magnetic powder, Nd—Fe—B magnetic powder, and Sm—Fe—N magnetic powder.

13. An inductance part as claimed in claim 12, wherein said magnetically biasing magnet is produced from mixed slurry of said plastic resin and said magnetic powder by a thin film forming process such as a doctor blade method, a printing method or the like.

14. An inductance part as claimed in claim 12, wherein said magnetically biasing magnet has a compressibility of 20% or more by compacting.

15. An inductance part as claimed in claim 12, wherein said magnetically biasing magnet has a surface coating of a heat resistant paint or a heat resistant resin having a heat resistance temperature of 120° C. or more.

16. An inductance part as claimed in claim 12, wherein a content of said plastic resin is 20% or more on the base of a volumetric percentage, and said plastic resin is at least one selected from a group of polypropylene resin, 6-nylone resin, 12-nylone resin, polyimide resin, polyethylene resin, and epoxy resin.

17. An inductance part comprising a magnetic core formed with a magnetic gap having a gap length of about 500 μm or less at at least one position in a magnetic path thereof, a magnetically biasing magnet disposed in the vicinity of the magnetic gap for supplying a magnetic bias from both ends of the magnetic gap, and a coil winding wound on the magnetic core by at least one turn, said inductance part adapted to be subjected to a reflow soldering treatment, wherein:

said magnetically biasing magnet is a bond magnet comprising a plastic resin and magnetic powder dispersed in the plastic resin and has a specific resistance of 0.1Ω·cm or more and a thickness of 500 μm or less;

said magnetic powder being a Sm—Co rare-earth magnetic powder which has an intrinsic coercive force of 10 kOe or more, a Curie point Tc of 500° C. or more, the maximum particle size equal to or less than 150 μm, and an average particle size of 2.5–50 μm.

18. An inductance part as claimed in claim 17, wherein said magnetically biasing magnet is produced from mixed slung of said plastic resin and said magnetic powder by a thin film forming process such as a doctor blade method, a printing method or the like.

19. An inductance part as claimed in claim 17, wherein said magnetically biasing magnet has a compressibility of 20% or more by compacting.

20. An inductance part as claimed in claim 17, wherein said magnetically biasing magnet has a surface coating of a heat resistant paint or a heat resistant resin having a heat resistance temperature of 270° C. or more.

21. An inductance part as claimed in claim 17, wherein Sm—Co rare-earth powder is one represented by:

$$Sm(Co_{bal}Fe_{0.15-0.25}Cu_{0.05-0.06}ZrO_{0.02-0.03})_{7.0-8.5}.$$

22. An inductance part as claimed in claim 17, wherein a content of said plastic resin is 30% or more on the base of a volumetric percent and said plastic resin is one selected from a group of polyimide resin, polyamideimide resin, epoxy resin, polyphenylene sulfide, silicone resin, polyester resin, aromatic polyamide resin, and liquid crystal polymer.

* * * * *